United States Patent [19]

Horan

[11] 4,342,278

[45] Aug. 3, 1982

[54] MINIATURE INFLATABLE CONTAINMENT AND DRY-WATER-ENTRY VESSELS

[76] Inventor: John J. Horan, 60 Deerpath Rd., Chalfont, Pa. 18914

[21] Appl. No.: 197,321

[22] Filed: Oct. 15, 1980

[51] Int. Cl.[3] ..... B63B 7/08

[52] U.S. Cl. ..... 114/345; 114/349; 441/87; 441/102

[58] Field of Search ..... 9/2 A, 330–332, 9/4 R, 11 A, 14; 182/3, 7, 234, 235, 231

[56] References Cited

U.S. PATENT DOCUMENTS

| | | | |
|---|---|---|---|
| 616,439 | 12/1898 | Shepherd | 9/4 R |
| 704,000 | 7/1902 | Conley | 9/332 |
| 1,284,968 | 11/1918 | Anderson | 9/4 R |
| 1,401,677 | 12/1921 | Dade | 9/332 X |
| 2,327,168 | 8/1943 | Bucknell | 9/11 A |
| 2,399,494 | 4/1946 | Manson et al. | 9/2 A |
| 2,962,732 | 12/1960 | Marz | 9/2 A |
| 3,259,926 | 7/1960 | Otterman | 9/4 R |
| 3,768,467 | 10/1973 | Jennings | 9/11 A |
| 4,090,270 | 5/1978 | Horan | 9/2 A |
| 4,187,570 | 2/1980 | Simone | 9/11 A |

FOREIGN PATENT DOCUMENTS

| | | | |
|---|---|---|---|
| 1238922 | 7/1960 | France | 9/2 A |
| 607106 | 7/1960 | Italy | 9/2 A |

*Primary Examiner*—Sherman D. Basinger

[57] ABSTRACT

The miniboats introduced in my U.S. Pat. 4,090,270 were basically novel in configuration, method of construction, ease of boarding by a swimmer, flotation effectiveness relative to lightness and compactness when stowed, degree of hypothermia protection achieved, and security in wind and water far beyond the capabilities of comparable pneumatic craft of traditional design; but they were not well adapted for entry by persons desiring to board them without a wetting. The vessels disclosed herein have overcome that problem. They have structurally integrated decks with dry-access openings that provide twice the retained buoyancy, a barrier to wave influx over the gunwales, an inherent self-righting capability, unprecedented storm security, ride stability, and magnified hypothermia protection. Some have integral leg articulation and propulsion and/or vessel-integrated suspension system for retarding descent to water from high elevations, auxiliary propulsion provisions, etc. Models sharing design characteristics of these life-support craft are highly adapted for expansion of seasonal, latitude, and ambulatory opportunity for scientific work and for recreation. Their diminutive weight and bulk enable transport to shores and banks that become inaccessible when carrying watercraft of greater weight and bulk and lesser portageability, seaworthiness, and wide-spectrum protective capability.

72 Claims, 52 Drawing Figures

PLD-DG
166
147
150
151
146
144
146
166
70D
182
63D
64D
163A
81D
163
63D
75D
86D
51
183
65D
184
193
63D
179A
74D
175
73D
52
181
65D
179
184
194
64D
63D
178
72D
144
177
176
62D
167
161
61D
76D
73D
73T
86D
73S
167
171

167
168
171
170
169
145
64B
64B
131
138A
65B
65B
137C
142L
86B
137D
142R
86B
137A
132R
132L
137
139
137B
138
140
139

167
176
177
167

161
73D
65D
62D
167
64D
193K
72D
165
193
61D
167
72K

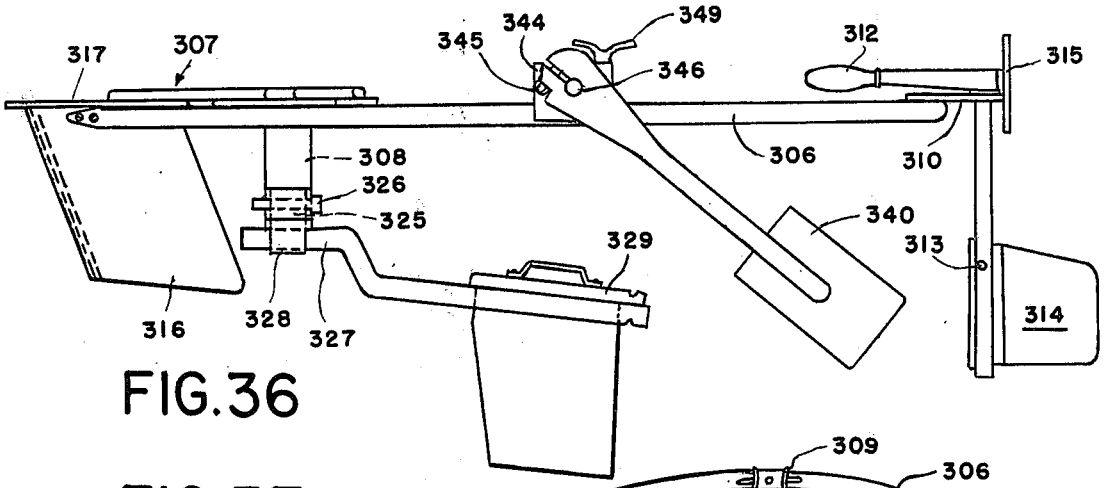
FIG.36
FIG.37
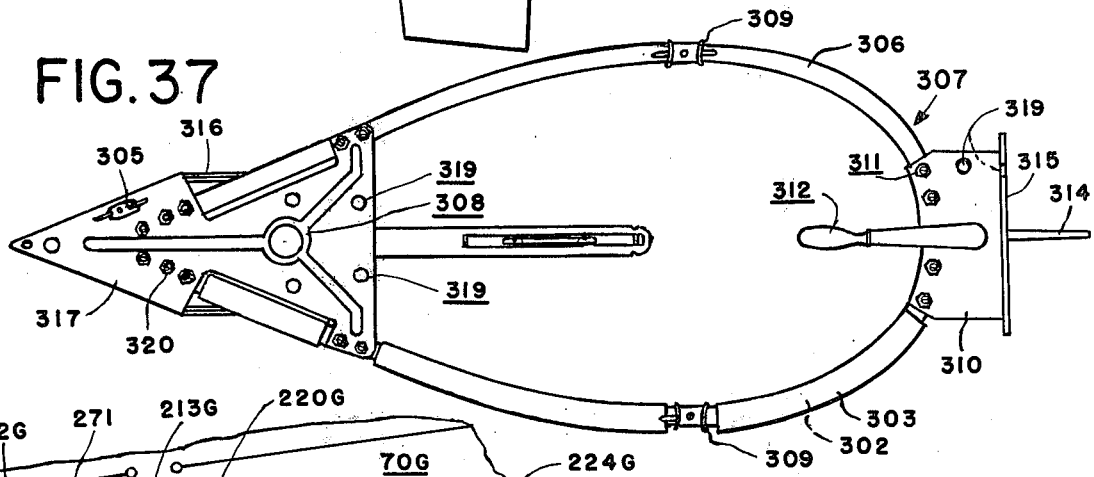
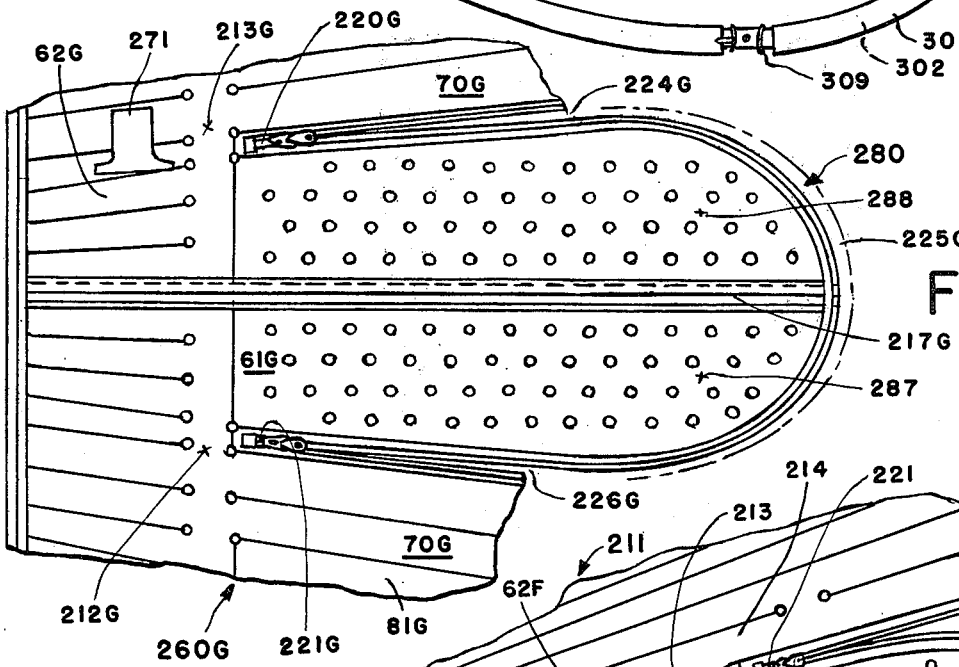
FIG.33
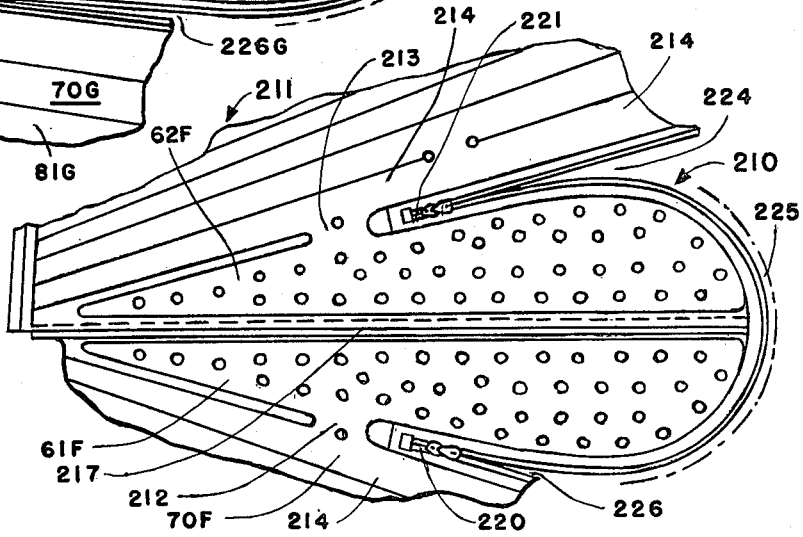
FIG.28

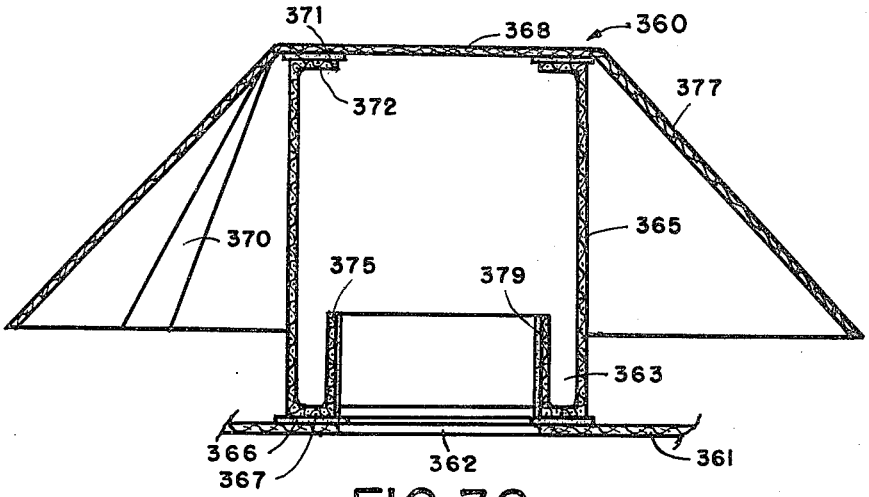
FIG.38
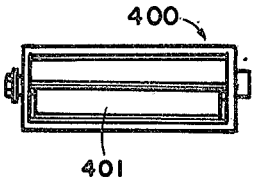
FIG.42
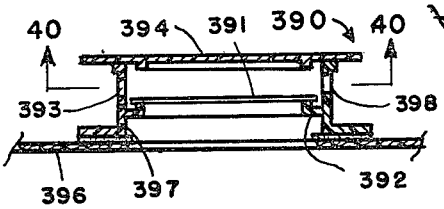
FIG.39
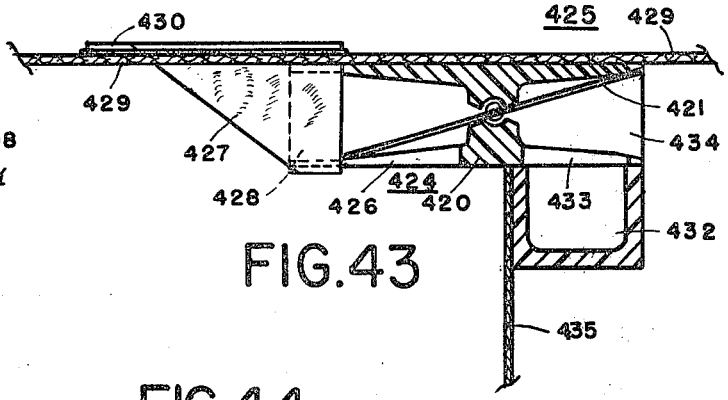
FIG.43
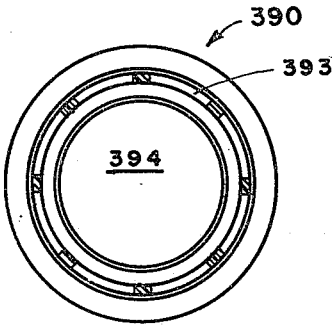
FIG.40
FIG.44
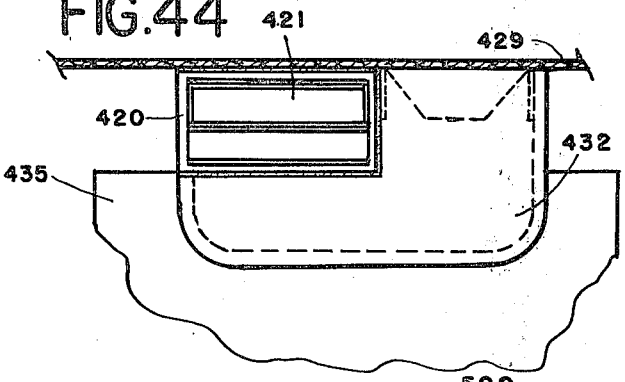
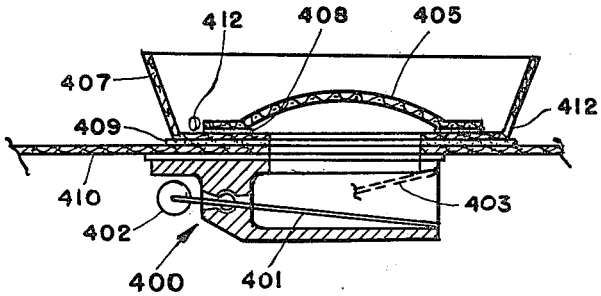
FIG.41
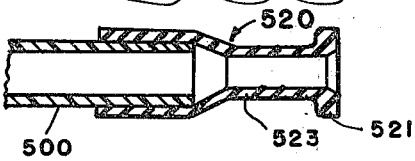
FIG.49
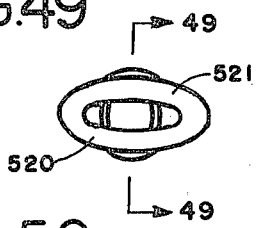
FIG.50

MINIATURE INFLATABLE CONTAINMENT AND DRY-WATER-ENTRY VESSELS

BACKGROUND OF THE INVENTION

This invention advances the design and performance of miniboats, first described in my U.S. Pat. No. 4,090,270; and it improves and extends their applicability to new areas not previously discussed in connection therewith. The nearest related art, containing nothing having the character of miniboats, encompasses life rafts of many styles and sizes, the larger of which are often very useful. However, as the designed-in seating capacity and bouyancy are reduced, so is the protection afforded the occupant of a one-man raft, whose body and center-of-gravity heights remain undiminished, so that he now towers precariously over a tiny platform that cannot be ballasted by human occupancy. The inevitable consequence of this loss of stability and seakeeping capability in rough water is that the occupant becomes a virtually free body, subject to being thrown about, washed out, and thrown out, often being ejected even by the downwash of a rescue helicopter, which keeps pushing the raft (but not the miniboat) out of rescue reach, and forcing his reimmersion.

Boarding a one-man life raft from the water requires a strong, vaulting, upward plunge out of the water to get over the taut hull, which often responds by tilting so that the would-be boarder must slide back to try again and again. Often boarding cannot be accomplished in cold water without the higher-pressure fill that the inflation gas delivers best when the water is warm, because the hull buckles and tilts, rejecting occupants who would otherwise have enough strength to occupy it. Leakage of oil from a damaged vessel not only inflames the eyes so severely as to disorient survivors in the water but also makes it extremely difficult and often impossible to board a raft because of the consequent slipperiness of the skin, the raft surfaces, and wet, oily clothing. Injured and shocked personnel may be unable to board any raft without help, which is unavailable to parachutists and other lone individuals; and cold-water fatigue will soon rob them of whatever faculties they might otherwise retain.

Growing concern regarding immersion hypothermia spurred makeshift raft add-ons such as inflated floors and cushions, which made the rafts even less stable in open water, and tent-like canopies draped over the occupants' heads, some inflated, which aggravated instability in wind and added so much bulk that the redesigned rafts could no longer be accommodated in the aircraft for which their development had been scheduled.

Though the patented miniboat required much less fabric area than did a raft, weighed less, and needed only oral inflation or a tiny, disposable 2-oz or 56 gram-capacity $CO_2$ cartridge (vs a mandatory 8-oz or 224 gram requirement for the raft) for primary inflation before boarding, supplemented by oral inflation thereafter, the miniboat revealed none of the above-noted deficiencies of small life rafts. The patented miniboat proved itself to be the quickest and easiest of all flotation devices for a swimming survivor to use unassisted. In fact, swimmers could board it more readily than they could don so-called "life preservers". Open-sea testing overcame initial skepticism; and the Navy has set up several programs for issue of miniboats to its aviators. The presence of oil, though still a hindrance to coordinated effort in the water, will scarcely impede sliding or rolling into a miniboat; and the miniboat, unlike a raft, can then be effectively paddled by hand away from the dangerous surface pool.

Nevertheless, the value of the patent remains limited in that it was focussed upon vehicles that were to be boarded by persons already in the water, who remain thereafter susceptible, especially in colder seasons and latitudes, to severe exposure hypothermia by reason of their prior immersion and body heat loss through their drenched clothing. Even the slow evaporation of the water they bring with them adds to the thermal load upon their weakened vitality.

Should a would-be occupant desire to enter the patented miniboat from a shallow beach, he will find his own weight pinning the hull down on the sand; and he will abrade its thin skin if he tries to slide himself out into the water. If he wades out to boarding depth he becomes partly wet and brings in water. Moreover, if the would-be occupant tries to step from a low pier, it still remains almost impossible to get inside with a dry skin because it lies lightly on one side or other for ease of boarding by a swimmer only; its very lightness, lack of inherent balance and susceptibility to wind when unoccupied become the means by which it eludes personnel transfer from above, unless it has been ballasted, ironically, with a partial water fill. If a would-be occupant should stand or sit within to jump or be thrown from a pier or other structure into the water, he is likely to find it stripped away from him upon impact with the water's surface.

While dry water entry from other media may not be impossible, those who attempt it unaided do so at risk of a thorough wetting. In short, the patented miniboat derived its outstanding character as a vessel solely from the occupant, after he had achieved a position within it, an easy task only for one who is either already immersed in the water or unafraid of a wetting.

Although the severity of wave action that will cause flow over the gunwales of the patented miniboat is much higher than that required for flooding small rafts, whose low-lying tubular hulls are a poor defense, water can still accumulate in the bottom. Precipitation, spray and wind chill are also inducers of hypothermia.

SUMMARY OF THE INVENTION

Fortunately, it has been found that the narrowness, depth and buoyancy distribution of the basic miniboat hull enables bridging the gap across the gunwales with a substantially flat or slightly arched structural upper deck that can be integrated as an additional, transverse structural member, with an additional weight and bulk penalty usually measured in ounces rather than pounds. The structural deck directly complements the hull to create a cargoballasted, self-righting, watertight, buoyant and snug pneumatic structure shielding the occupant most efficiently against hypothermia. The air above and around the occupant's body is retained, howevermuch the vessel is thrust about by stormy seas; thus, the vessel's basic buoyancy is magnified so it escapes and rises stably above huge crests. Moreover, as the air temperature rises by confinement around the occupant, it extracts less body heat and becomes an additional insulative weather barrier against precipitation and cold-air convection upon the occupant. Since the deck can also be made inflatable, it will then further increase the structural stiffness beyond that of the single-sheet-decked vessel in compression and bending as well as in tension. When complemented by the deck, which reciprocally receives and transmits stress, all three planar members of the new vessels yield resiliently and cooperatively with each other; and the fully enclosed structure's magnified buoyancy keeps it rising despite attempts by waves to envelop or swamp it. The transverse cross section of the patented miniboat was essentially v-shaped. But the deck-equipped hulls of this invention have the cross section of an inverted isosceles triangle. Thus, the structural deck boxes the miniboats's hull into a most effective housing for occupant survival against the might of the sea. With the exception of several embodiments having a second deck and quadrangular in cross section, the cross section becomes the delta (Δ) or triangle, the basic chain component of architectural trusses, which are the most weight-efficient of all structures for supporting roofs and floors. A glance at the profile reveals that it, too, is basically triangular, neglecting its radiused apex and the small offset at the bow, giving the vessel the contour of an inverter pyramid, with its broad and buoyant base positioned for the near-absolute maximum in life-support stability achievable at the airwater interface. Such stability of wave ride, it must be acknowledged, this vessel derives in part from the pendulous gravitational contribution of the confined occupant's body mass. By confining him between deck and keel, with his buttocks conformably pocketed at the pyramidal apex, the vessel keeps the spinal axis well aligned between its walls and along its centerline.

Unlike all other man-made vehicles, the total mass of the basic decked vessel (assume a very generous 5 pounds or 2.27 kg) is dwarfed by the mass of its occupant in an unprecedented ratio that typically ranges between 1:25 and 1:50. This tiny mass is invested in the total peripheral area of its compliant, pneumatically insulated and cushioned skin, with zero potential for inflicting direct injury from secondary impact and relatively great potential for attenuating forces that develop between the occupant's inertia and the uneven motion of the surrounding waters. In short, this near-perfect so-constituted pendulum suspends him in a yielding, tough-membraned, double-walled sac, an isolating and insulating womb that effectively resists efforts by tilted wave fronts to destabilize his gravity alignment.

The gunwales of the original v-hulled miniboat were subject to cantilevered deflection by the transient lateral water-pressure surges induced by strong waves crossing the hull. Wave-pressure buildups on one side of an occupied miniboat, which thereby possesses all of the inertia of the occupant's non-uniformly distributed weight, as well as the unevenly distributed stiffness of his body, tend to push the hull inwardly, while suction on the other side, toward which the occupant's body tends to tilt, pulls at the hull outwardly, thus inducing a tendency for the gunwale to buckle locally and facilitating inflow of small amounts of water aboard, especially if, for any reason, inflation is not taut.

For deep-ocean survivability, where rescue may be remote in both distance and time, the occupant needs superior and continuous protection, first from immersion and second, from the subsequent rapid deterioration of body temperature. A structural deck, designed to impart tension across the gunwales, not only renders the vessel highly resistant to localized gunwale buckling, but itself constitutes an absolute barrier to wave overspill.

The structural deck introduced with these inflatable vessels is also a physical retainer not only for the occupant but also for the large quantity of contained breathing air, approximately equal to the entire inflation capacity of the hull and occupying all of the space between the ballasting occupant and the waterproof ceiling thus tightly stretched across the top of the gunwale over his head. The additive buoyancy margin, applied directly beneath the structural deck, speeds the rise of the vessel through the above-intruding waves, regardless of vessel-roll angle or wave-inclination angle, while barring water entry. The total lifting force the decked vessel could muster, if necessary, approximates a quarter ton, handily overmatching the weight of its human cargo to thrust its way surfaceward across the wavefront itself and through its crest.

When the deck is made inflatable, it will add comparatively little buoyancy. However, it will not only supplement the occupant's insulative protection but will further stiffen the vessel in transverse tension, compression and bending, thus still better maintaining the occupied vessel's shape and pitch/roll behavior under the onslaught of heavy seas.

Rugged, strongly attached, and quickly closable access fasteners, which may be of the hook-and-toothed-pile variety but are preferably of those types known as zippers, either of the toothed or the interlocking plastic-strip kind, are located within the deck or between deck and hull. They generally provide access for occupant entry into the vessel from a standing position, the occupied vessel then being wholly or partially inflated prior to water entry. Despite the emphasis on dry entry and on the several modes of such entry, most of these vessels will give already-immersed survivors an opportunity for self separation from the immersion medium, their new capabilities affording enhanced hypothermia protection to such already wetted occupants, who may bail out the water that pools in the bottom with a handkerchief or a provided sponge by slightly opening the access fastener.

The innovations do not end with the deck itself; rather, the deck serves as the basis for most of the others. Occupants may now board the vessels and then jump off piers or distressed yachts for dry water entry; others may escape while remaining dry by wading or floating through flooded compartments of ships and climbing to elevated departure points for slow-speed, controlled descent to dry water entry; still others may descend via ladders from endangered oil rigs and step into the water to float, the while remaining dry and able to propel themselves away from the danger zone. Crews of ocean and Great Lakes vessels may actually perform duties on exposed decks, especially in emergencies, with the assurance that, if caught by green water, they, too, will float dry until rescued.

Not only will the escapees remain dry and protected from water-immersion hypothermia, their persons, including eyes, skin and clothing, will also remain protected from oil and other chemical contaminants released into the surrounding water by ship and/or oil-rig damage and they will also be able to make their way out of the contaminated zone.

Recreational variants of these emergency vessels will provide full latitude for ventures by fishermen, campers, backpackers, hunters and trappers, as well as limnologists, oceanologists, wildlife specialists and other scientists to gain dry access to shore, shoal and bank areas unreachable by boat-ferrying automobiles and trucks, whereon they may carry on with fun or research, as the case may be. Seasonal and latitude expansion of such ventures and scientific work will be still another important dividend.

OBJECTS OF THE INVENTION (1) The vessels of this invention are particularly distinguished from the prior art in that their structure enables the users of the tiny craft to transfer themselves directly from dry environments, i.e., positions on oil rigs, ships, boats, piers, docks, beaches, etc., to dry flotation on the surface of the water, with no intermediate immersion stage and no shipping of water therein during the boarding and/or water-entry processes. This is a principal object of the invention.

(2) An object of this invention is to supplement the protection from immersion with maximized continuous protection from wave-washover, spray, precipitation, wind and hypothermia, as well as ejection, in a totally and structurally enclosed miniature vessel.

(3) An object of this invention is to provide vessels that enable dry water entry of occupants and have a buoyancy magnitude and distribution that impart a self-righting characteristic thereto, regardless of the angle and attitude at water entry.

(4) An object of this invention is to provide vessels that will enable persons desiring water-borne recreation to leave a beach, pier, larger boat or high-decked ship and accomplish water entry therein while remaining dry, warm and comfortable and thereafter carrying on with whatever ventures they seek with dry clothing.

(5) An object of this invention is to provide expeditious automatic and semi-automatic encapsulation means for persons desiring to enter and escape within their protective structures.

(6) An object of this invention is to provide vessels for safely enclosing ship and oil rig escapees during speed-regulated descent, with assurance of dry water entry and face-up flotation.

(7) An object of this invention is to provide vessels from which occupants can also depart from flotation on water, again without wetting.

(8) An object of this invention is to provide dry-entry vessels having hull configurations that offer excellent directional stability for enabling occupants to gain headway effectively by paddling, even with hands or feet, for navigation toward safety or recreational rendezvoux, as desired.

(9) An object of this invention is to provide vessels with waterproof observation means in the deck thereof.

(10) An object of this invention is to provide dry-entry vessels having means for leg articulation by the occupant to facilitate and speed his departure from the vicinity of the distressed vessel.

(11) An object of this invention is to provide dry-entry vessels adapted for receiving and supporting oars, motors, or sails, at choice, for cruising purposes.

(12) An object of this invention is to enable occupants of dry-entry vessels to disable temporarily, in whole or in part, such portion of the protective shelter available as may be appropriate for obtaining visual command thereabout or for giving attention to desired tasks, and to restore such shelter when its protection again becomes essential.

(13) An object of this invention is to minimize emergency-escape time and provide the ultimate in water-borne safety and protection at the minimum penalties in cost, stowed weight, and bulk that are compatible with such protection.

(14) An object of this invention is to provide all of the decked vessels with ventilation means for protecting the occupant from the serious combination of hypoxia and hypercapnia that could otherwise result from prolonged respiration within a fully closed container.

(15) An object of this invention is to provide the new capabilities designed into the vessels of this invention without negation of their usefulness to survivors already in the water.

BRIEF DESCRIPTION OF THE DRAWINGS

FIG. 28 is an inflated plan view of an alternative integral access deck 210 in the open position for use with vessel 60 and derivatives thereof.

FIG. 33 is a plan view of open integral access deck 280, a derivative of deck 210, showing its adaptation for use with leg-encasement assembly 161 (or 161E) and the hull of dry-entry vessel 260G, in turn a derivative of vessel 260.

FIG. 36 is a side elevation of superstructure 307 of dry-entry vessel 260H.

FIG. 37 is a plan view of superstructure 307 of dry-entry vessel 260H.

FIG. 38 is a sectional elevation of a ventilator and its installation in a vessel of this invention.

FIG. 39 is a sectional elevation of an exhaust valve and its installation in a vessel of this installation.

FIG. 40 is a transverse section of the exhaust valve of FIG. 39.

FIG. 41 is a sectional elevation of an inlet valve and its installation in a vessel of this invention.

FIG. 42 is an end view of the valve of FIG. 41.

FIG. 43 is a partly sectioned side elevation of a 2-way exhaust/inlet valve and its installation in a vessel of this invention.

FIG. 44 is a forward-looking elevation of the valve and installation of FIG. 43.

FIG. 49 is a sectional elevation of an exhalation mouthpiece that may be substituted for the bellows of FIG. 48.

FIG. 50 is a frontal elevation of the mouthpiece of FIG. 49.

DESCRIPTION OF THE PREFERRED EMBODIMENTS

Figure 1:
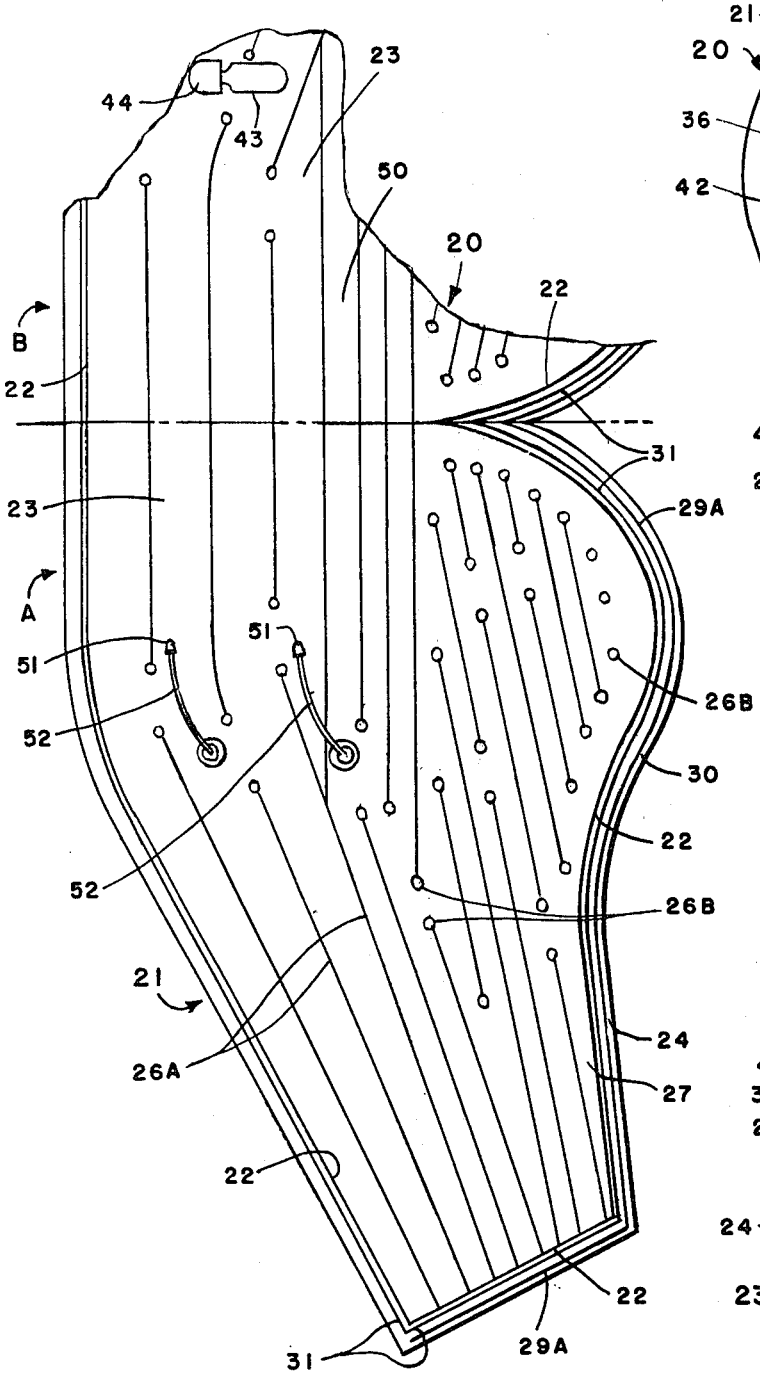
FIG. 1 is a partly cutoff view of the plan of the symmetrical welded hull compartment of dry-entry vessel 20 of this invention.
Figure 2:
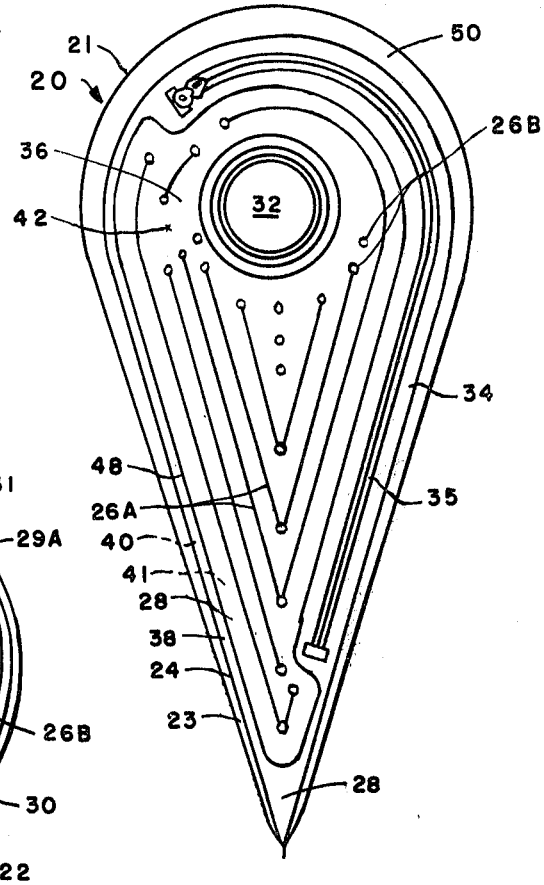
FIG. 2 is a plan view of the inflated structural deck as bonded across the inflated hull of vessel 20, the fastener being in the closed position.
Figure 4:
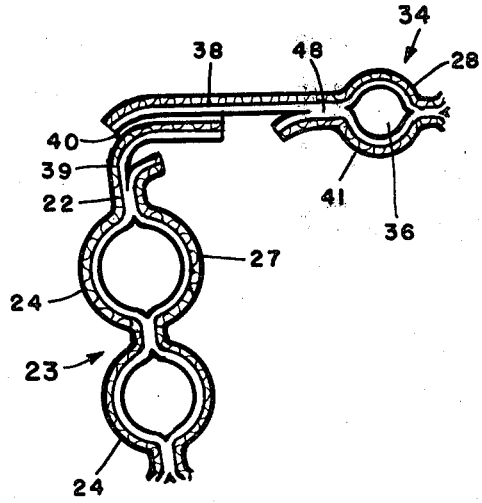
FIG. 4 is a post-inflation cross-sectional view of the bonded joint by which the deck is assembled to the hull of vessel 20.
Figure 3:
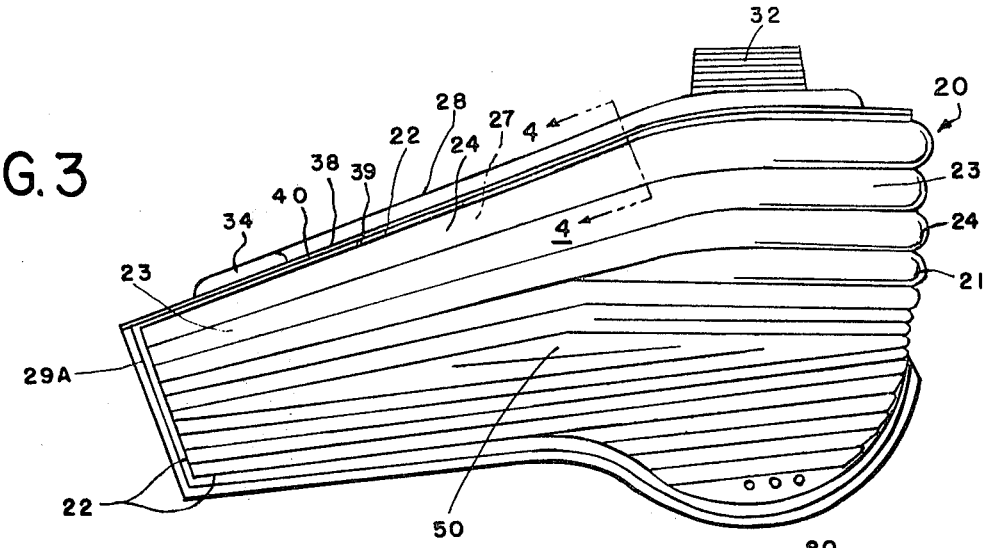
FIG. 3 is a post-inflation side elevation of vessel 20.

Referring now to FIGS. 1–4, there is shown a dry-entry vessel 20, having an inflatable hull formed by welding together, along the ruled lines of FIG. 2, including pneumatic outline 22 and the pattern of linear 26A and spot or ring welds 26B, the thermoplastic-coated surfaces of two similar and symmetrical sheets 24, 27, which can be made of a single-coated nylon, polyester, "Nomex", or "Kevlar" fabric, whether knit, woven, unwoven or scrim, in order to form segment and cell boundaries for the inflatable portion of the hull proper 21 and properly proportion the hull thickness and distribute its buoyancy. Other materials such as sheet elastomers, generally thicker than the coated fabrics, double-coated fabrics, and even two-ply fabrics will be superior for certain applications. Insofar as hull 21 is concerned, sheets 24 and 27 are comparable respectively to outer and inner panels 16 and 34 of my prior U.S. Pat. No. 4,090,270, which established the miniboat art, except that the sheets will generally be somewhat larger in order to properly accommodate the occupant below the new structurally integrated deck 34 that is required for the new services envisioned for vessel 20.

The welded half B, on the right of FIG. 1, which is generally symmetrical with welded half A except as described hereinbelow, is lifted and folded over along midline C in the manner of the patented miniboat. Then halves A and B of outer sheet 24, which in FIG. 1 is mostly hidden from view under inner sheet 27, are welded together along line 29A in the external seam-edge strip means 30 from its lower intersection with midline C to the distal extremity to form the keel and bow of hull 21 of vessel 20. Half B will then become the port side of the hull and half A the starboard side. To facilitate this second welding operation, the seam edge strip of inner sheet 27 may be either pre-trimmed away or folded back along line 31. Further discussion of seam-edge bonding will appear hereinafter in connection with FIGS. 8, 9, 10 and others. The term "bonding" is considered generic with respect to both welding, as the principal technique for forming the inflatable cells and segments and making joints between hulls, decks, and inserts, and adhesion via the application of cements to seam edge joints and to intersections between such joints which may be difficult to reach via electrodes or other heat-application tooling, as well as to local reenforcements and inserts.

Deck assembly 34, appearing in inflated plan in FIG. 2, wherein it is shown assembled to hull 21, begins with a single outer sheet of coated fabric 28, to which the smaller inner sheet 41 may optionally be welded via cell outline weld 48 to form inflatable deck cell 36. Deck cell 36 enhances the insulative value derived from cells 23 and 50 in hull 21. As in hull 21, additional linear welds 26 and spot or ring welds 26B, together, constitute the discontinuous lines that form the inflatable segments controlling the inflated thickness of cell 36. If inflation is not provided for, sheet 28 of deck 34 will be cut smaller in area to compensate for lack of inflation shrinkage.

Sealably inset into deck 34 is an observation turret 32, made of soft clear plastic that is normally folded flat in modified bellows or accordion fashion. It will ordinarily be pushed outwardly into the position shown in FIG. 3 only after the occupant is afloat in the vessel. Following the welding operation, which will normally outline cell 36 and create segment boundaries with a single brief delivery of high-frequency energy from a patterned electrode transversely through the fabric layers, heavy-duty, water resistant access fastener 35 will be inset in deck 34. Fastener 35 will preferably have both inner and outer operating tabs, as will other fasteners associated with decks hereinafter.

A peripheral seam edge strip 38 bounds sheet 28 of deck 34, outwardly of pneumatically sealing seam 48. It is seen in the fragmentary cross section of FIG. 4, as is the similar seam-edge strip 39, part of hull outer sheet 24, which extends upwardly past seam 22, defining the gunwale along the top of upper null cell 23. Seam-edge strip 38 of sheet 28 is superposed to make a lap joint over seam-edge strip 39 of sheet 24 of the hull, bringing the coated face of sheet 28 over the uncoated surface of sheet 24, to which it would make an inferior weld unless strip 39 has first been precoated at 40. For expediency it is generally easier to apply 40 as a self-curing adhesive or cement which provides an enduring lap seam of much greater width than the narrow welded seams that ordinarily suffice between coated surfaces. The joint thus made at 40 provides structural bridging across the gunwales of hull 21 by deck 34. Comparisons among alternative techniques for structural bonding together of deck and hull, including optional use of an additional bonded joint that enables incorporation of the seam edge strips of inner hull sheet 27 and lower deck sheet 41 for further fortification of the juncture between deck and hull, will be seen in FIGS. 8, 9, and 10. In FIGS. 4, 8, 9 and 10, together with other cross-sectional figures hereinafter, the thickness of the coating on the fabric, as little as 0.001" (0.025 mm), and that of the fabric itself, which may range upwardly from 0.005" (0.125 mm), have necessarily been greatly exaggerated by comparison with the dimensions of the fabric surfaces. Relative exaggerations also appear in the transverse dimensions of seam-edge strips in hull plans by comparison with their longitudinal dimensions.

Just as the hull of vessel 20 becomes shallower in depth when inflated (and occupied) and shorter in length as the stern portion is dilated to embrace the occupant's body (compare corresponding areas in FIGS. 1 and 3), deck 34 will also shrink in area when inflated. Likewise, an inflation-proportioned deck 34 would be subject to sagging if left uninflated and would not properly interact with the hull, though the joints themselves would not be inherently weakened. The area of a non-inflatable deck will normally be smaller than the area circumscribed by the seam that describes the inflated gunwale. An inflatable deck will normally have an inflated area smaller than that circumscribed by the gunwale seam, so it pulls the hull slightly inwardly. Vessel 20 with an inflated deck will yield superior hypothermia protection for the same combination of water and air temperature and duration of exposure, assuming that other conditions such as wind velocity, sea state, and initial physiological and psychological condition of the occupant are also balanced. Stowage space and weight limitations and relative cost versus a relatively small thermal protection differential for short-term anticipated exposure may be countervailing considerations.

An oral inflation valve for the inflated version of deck 34 depends downwardly from inner sheet 41 at cross-marked point 42 for access by the occupant when or if he desired the additional insulative and structural protection available therefrom. Normally, if sea and weather are mild, he will deflate cell 36, if present, and open zipper fastener 35 in deck 34 unless he desired to rest or sleep.

To facilitate an escapee's emergency ingress into vessel 20, deck zipper fastener 35 will ordinarily be left open when vessel 20 is stowed vertically, bow down, in its ready-service locker. To enter, the escapee steps backwardly through the opening, pull-closing zipper fastener 35 upwardly through about half of its travel in front of himself. He inflates upper hull cell 23 via disposable $CO_2$ cartridge 43, threaded into valve 44, to erect vessel 20 about his standing person, then pulls the tab of zipper 35 all the way closed. He will also inflate deck cell 36 if he can and then jump off the stricken boat or yacht for dry and self-righting water entry. He can enjoy the same dry entry if the jump is made from a recreation pier. Once in the water, the occupant normally inflates lower cell 50 via valve 51, terminating tubular connector 52, use of a compressed gas bottle being optional.

Figure 30:
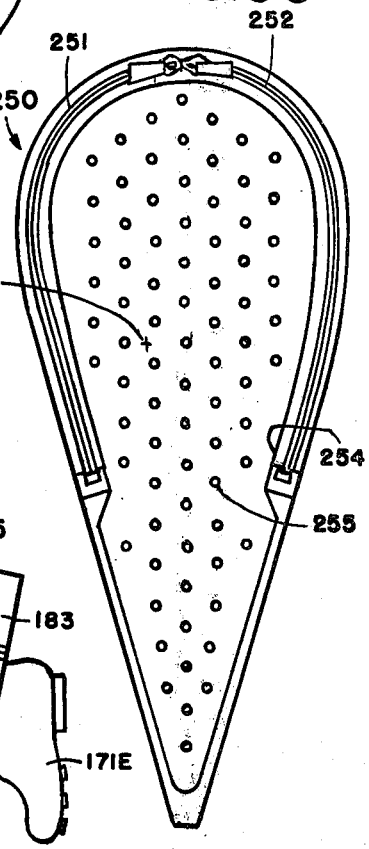
FIG. 30 is an inflated plan view of an alternative structural, non-integral, access deck 250 in the closed position for optional use with vessels of this invention.
Figure 15:
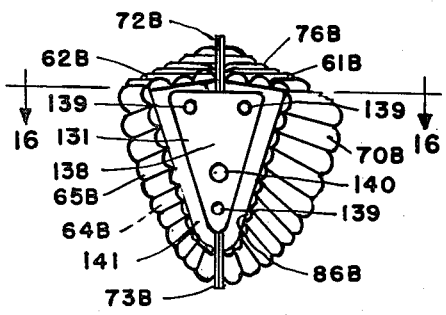
FIG. 15 is a view from ahead of the platform installed at the bow of vessel 60B.

For easy access by occupants, identical oral inflation valves 51 are located to the right on inner hull sheet 27 where they will be convenient to the occupant. Compressed-gas inflators may be located either next to the oral inflators or directly opposite them on the left inboard side, as indicated in FIG. 1. In an emergency requiring instant inflation of the upper cell, gas inflation is necessary, otherwise oral inflation will be chosen. Oral inflation means is required in order to enable corrective action when afloat if either underfill by the bottle or a pinhole fabric leak should occur. When in the water, the occupant may extend turret 32 and project the top of his head thereinto for a look around while remaining shielded from adverse weather; but he must not have his head therein during water entry. Weather permitting, he may reopen zipper fastener 35 for an unlimited view and for paddling toward rescue. Other deck configurations, including those of FIGS. 28 and 30, are also applicable to miniboat 20.

Figure 5:
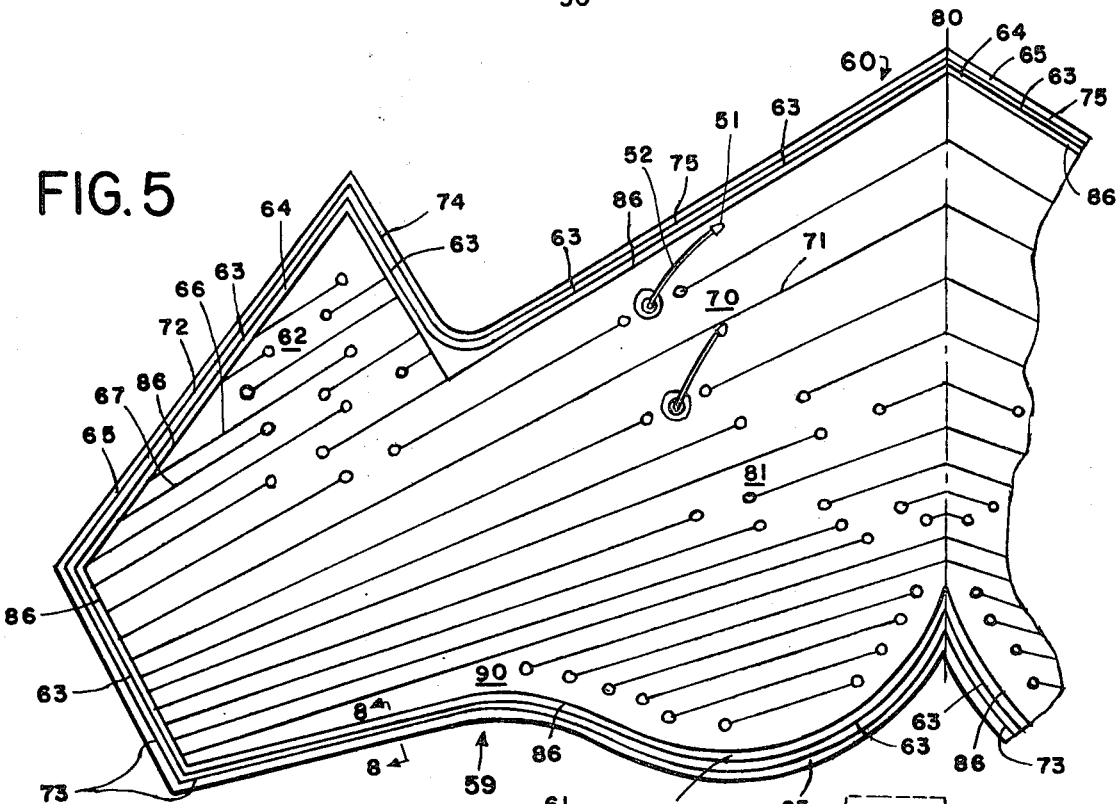
FIG. 5 is a partly cutoff view of the plan of the symmetrical hull and foredeck of vessel 60 of the present invention.
Figure 6:
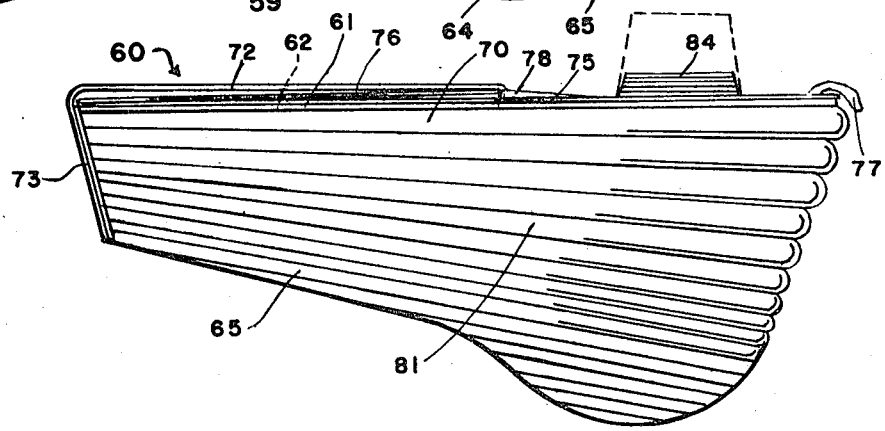
FIG. 6 is a side elevation of inflated vessel 60.
Figure 7:
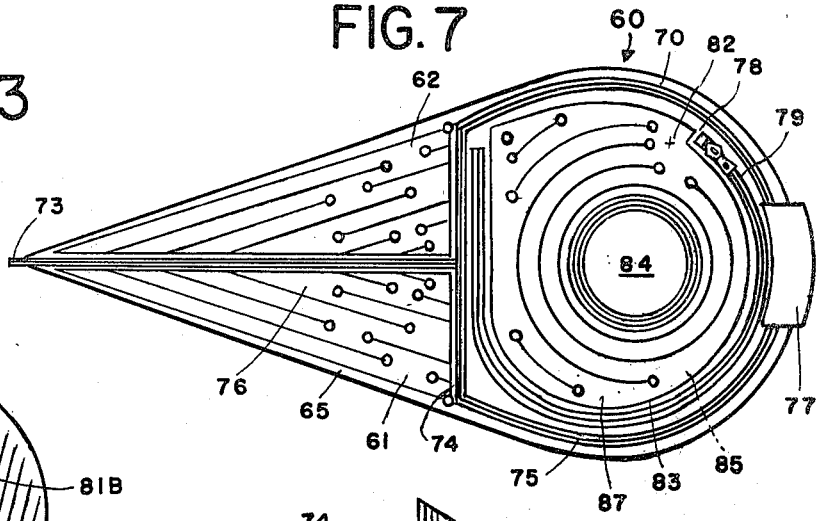
FIG. 7 is a plan view of the foredeck and afterdeck of inflated and closed vessel 60.

Referring now to FIGS. 5, 6, and 7, there is seen dry-entry vessel 60, the symmetrical, inflatable hull portion being laid out in FIG. 5 to utilize a maximum ratio of fabric from the bolt and to accelerate the self-righting process from the instant of water entry, if for some reason the impact attitude should be unfavorable. Vessel 60 is seen to be designed for symmetrical folding about axis 80 after the pneumatic confinement welding of and within inflation periphery 86 is completed. Right-hand upward extension 62 comprises a number of small, parallel, longitudinal segments 66, 67, etc., intercommunicating with longitudinal segment 68 of upper cell 70, which may be of selectable depth and may comprise an additional segment or two, if desired, via preplanned displacement downwardly of continuous weld line 71, defining the inner-cell boundary it shares with lower cell 81. Left-hand extension 61, mirror imaged, is located at the remote end of the cut-off portion of FIG. 5. Such displacement would require capacity increase in the gas bottle used for rapid filling of upper cell 70. Otherwise the fill arrangement will be similar to that of vessel 20.

As in vessel 20, the pair of seam-edge strips extending beyond line 86 offer several options as to the manner of seam jointure to form, first, the bow and keel and, second, the foredeck, which will include upward extensions 61 and 62. The method selected for vessel 60 is similar to that used for vessel 20, with the exception that line 63 becomes the fold or cutoff line for inner sheet 64 all the way from its lower intersection with midline 80 along the keel, the bow and the midline juncture of extensions 61 and 62. The weld is located in outer sheet 65 along line 72, the entire keel, bow and midline of foredeck 76 thus being formed in one operation. Thus, when cell 70 is inflated by an occupant, the smaller and less stiff segments of extensions 61 and 62 will be pulled downwardly to form slightly arched foredeck 76, structurally bridging the forward portion of hull 59. An alternative seam construction for foredeck 76 is seen in the derivative decks of FIGS. 28 and 33, hereinafter, wherein the seam-edge strip of the right-hand upward extension is superposed over that of the left-hand upward extension in the manner of FIG. 4 to produce an adhesed joint.

After deck 78, seen in the post-inflation view of FIG. 7, is dished upwardly around its entire curved periphery and pinch-welded to the seam-edge strip of hull outer sheet 65 along weld line 75 and similarly joined to foredeck 76 along weld line 74. Other feasible joint methods appear hereinafter in FIGS. 8, 9 and 10. The alternative deck of FIG. 28 would replace both foredeck 76 and afterdeck 78.

As in vessel 20, wherein it was shown that deck 34 may have an inner sheet 41 welded to the principal deck sheet to provide for deck inflation, afterdeck 78 may optionally be lined with inner sheet 85, the outline weld 83 indicating the inflatable perimeter of afterdeck cell 87. The oral inflator therefor is attached to inner sheet 85 directly below cross-marked point 82.

The would-be occupant of vessel 60 will, if he must escape from a high ship's deck, assure that the upper terminus of the suspension line of a personnel-lowering device (PLD) 129 (not shown here but seen within vessel 60B in FIG. 13) is connected to an elevated structure adapted to overhang outboard of the above-mentioned deck. He will then insert the PLD, with attached body harness and reserve-suspension-line dispenser attached to either the PLD or its harness, through the outer end of optional tubular boot 77, which is preferably of limp material that will collapse after wetting against afterdeck 78 and thus foil water entry after flotation.

Stepping backwardly through opened access fastener 79 to enter vessel 60, he will couple the body harness to his person, adjusting it as snugly and securely as possible. He will actuate valve 44, carrying $CO_2$ gas bottle 43 and located as previously shown in FIG. 1 for vessel 20, to inflate upper cell 70, which erects vessel 60 around him. If he has time, he may also inflate any or all other cells, following which he will close access fastener 79 via its inside-located operating tab. Grasping and squeezing PLD 129 firmly in his hand, he may step, leap, or slide off the deck edge and lower himself at low speed into the water. Such descent is equally applicable to vessel 20 if it has been provided with a boot comparable to boot 77. Similarly, vessel 60, like vessel 20, is equally suited for egress at low elevations without the PLD.

After water entry, the occupant may disconnect the PLD or sever its polyester suspension line, releasing himself from attachment to the distressed vessel. He will be well advised to open fastener 79 then and paddle himself, with his hands if necessary, away from the danger zone. He may inflate lower cell 81 orally as soon as practicable and may inflate cell 87 if its insulative supplement is needed. Turret 84, a thin, clear plastic bag secured over an opening in afterdeck 78, enables insertion of the occupant's head for viewing his surroundings.

Other vessels, such as vessel 60B, actually provide the load-transfer function without the discomfort, potential trauma and hazards attendant upon the use of body harnesses or other PLD suspension accessories, while speeding safe departure from danger and assuring better attitudes for touchdown on hard surfaces such as docks and the decks of rescue vessels.

Figure 8:
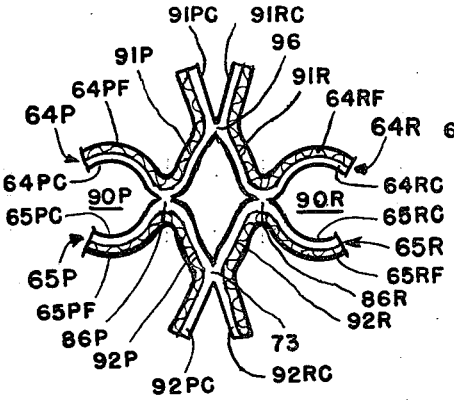
FIG. 8 is a cross-sectional view of a welded structural joint applicable to dry-entry vessels of this invention.
Figure 9:
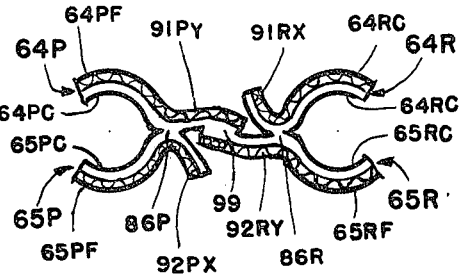
FIG. 9 is a cross-sectional view of a lap-welded structural joint between adjacent structural elements of dry-entry vessels of this invention.

Referring now to FIGS. 8 and 9, there are shown in detail some of the preferred means for making welded seams in single-coated fabrics that are applicable, though not exclusively so, to most of the vessels disclosed herein. Wherever it is desired to employ welding only, without solvent-containing or polymerizing cements for making bow and keel seams or making the joints between hulls and decks, these arrangements will be suitable. Sewn seams may be used provided that they do not permit egress of inflation gas/air or ingress of water into the vessel. Such seams should be well coated for waterproofing.

A preferred sealing geometry for butted seams of single-coated fabric is illustrated in FIG. 8. It bears a close relationship to the keel and bow seam previously indicated for vessel 60, to which it is a superior alternative; and it is also generally applicable to joints between any contiguous inflated panels, including hulls and decks. In the enumeration of indicated parts, the numeral 64 again refers to the inner sheet and 65 to the outer sheet, the letter P refers to the left or port side of vessel 60's hull, and the letter R refers to the right side of vessel 60 at any site (8—8) along the keel or bow. The suffixes F and C refer respectively to the fabric side of the sheet and the coated face in which the actual weld is made. Welds 86P and 86R are the opposite ends of the peripheral pneumatic sealing weld 86 indicated below segment 90 of vessel 60 in FIG. 5, the seam-edge strips lying outwardly of the segment being represented by 91P and 91R on the inside and 92P and 92R on the outside of vessel 60. Thus, seam-edge strip 92P is actually a part of the left side of outer sheet 65P and seam-edge strip 91R is part of the right side of inner sheet 64R.

Although the joint of FIG. 8 is somewhat comparable to the single weld between the opposite ends of outer sheet 65 that was previously indicated for vessel 60, it is superior, particularly for long service, because it involves two welds, one at 73, as in vessel 60, and an additional weld between the opposite halves of sheet 64 at 96. In practice, weld 96 can best be made by turning the uninflated hull inside out after weld 73 has been completed its full length.

Alternatively, as shown in FIG. 9, a single lap weld may be employed. Seam-edge strips 91RX, a part of sheet half 64R, and 92PX, which is a part of sheet half 65P, are cut off short so that heat can be applied conveniently between seam-edge strips 91PY and 92RY, resulting in lap weld 99. If preferred, of course, by cutting off the latter two-edge strips instead, the weld could have been made between 91RX and 92PX. If the type of service intended permits the use of adhesive bonding, a variety of well-known cementing techniques may be used, in addition to the prior example of FIG. 4.

Figure 10:
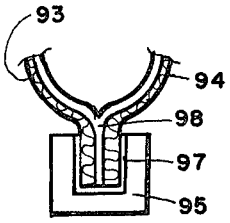
FIG. 10 is a cross-sectional view of a taped structural joint between elements of dry-entry vessel 60A, a derivative of vessel 60.

One of the more reliable assembly techniques, which also provides an outer reenforcement for seams, is shown in FIG. 10. A tape 95, which may be of a gauge heavier than the basic fabric, is adhesively bonded 97 over the edge of the seam, thus effectively closing the gap between seam-edge strips 93 and 94. The bond material 97 may have been pre-applied to the outer fabric of the seam-edge strips, to the tap itself, or to all of the thus-bonded surfaces. If desired for any reason, the coated interior surfaces may first be pre-welded at 98.

Figure 11:
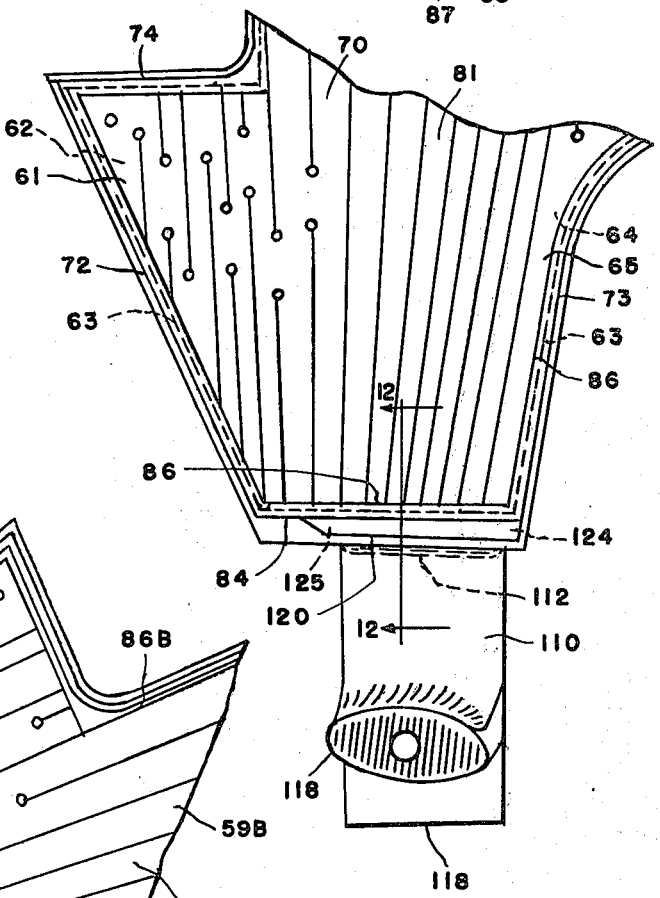
FIG. 11 is a cutaway drawing of the closed bow end of completed but uninflated dry-entry vessel 60A, a derivative of vessel 60.
Figure 12:
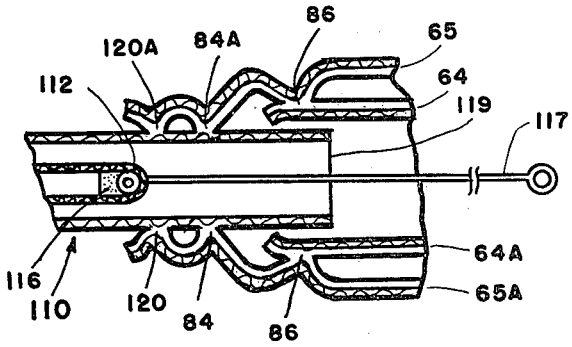
FIG. 12 is a cutaway cross section of the structural joint arrangement of vessel 60A.

Referring now to FIGS. 11 and 12, there is seen in FIG. 11 a fragmentary portion of the uninflated hull, as viewed from the left side of vessel 60A, a version of vessel 60 that is unchanged except for broadening of the seam-edge strips along the bow to provide for sealed admission of an inserted foot support in the form of a crotch-joined 112 pair of foot encasements 110 between the left and right side panels. The upward extensions 61, 62 that will form the deck are again welded to each other along their paired seam-edge strips via weld line 72, which again becomes part of the deck centerline after inflation.

However, the weld outline for closing the bow seam is interrupted for admission of foot-encasement pair 110, which extends forwardly thereof to admit the occupant's shod feet. The partial section of FIG. 12 reveals the manner of joining encasement assembly 110 to the hull of vessel 60A. A retrieval cord 117 is passed through crotch 112 and sealed 116 with a material such as the widely used, non-hardening butyl-rubber caulking. This arrangement will, after the occupant is afloat, enable him to draw the pair of encasements into vessel 60A, one at a time, without leakage, after he has first removed his feet therefrom, also one at a time.

As in vessel 60, weld line 86 describes the inflation perimeter for vessel 60A. This weld does not need to be invaded for admittance of encasement assembly 110, between the left and right sides of the bow. Weld line 73 closes the keel only and not the bow, the weld closure for the bow now being described by weld lines 84 and 84A, supplemented by weld lines 120 and 120A, which serve as sealed bow-closure means for the opposite seam-edge strips of coated-fabric outer sheet 65A, to which the rim 119 of the intervening encasement assembly 110 is peripherally bonded, as detailed in FIG. 12. To prevent any possible leakage via the weld-area transitions across the upper and lower edges of inserted overbooty assembly 110, non-hardening sealant plugs of butyl or similar elastomer are post-injected at 124 and 125.

Encasement assembly 110 enables limited articulation of the feet for shuffling or waddling across a deck area from a centrally located vessel locker to a deck edge or gate in the rail, where the user may inflate upper cell 70 and close the hatch in afterdeck 78 prior to leaping or, assuming that the encasements and their manner of assembly to vessel 60A have been made sufficiently strong to support a suspended occupant, being lowered by PLD 129 into the water, thereafter retracting his legs, sitting up and inflating lower cell 81. At his option he may retract encasement assembly 110 via retrieval cord 117 into the vessel interior for more efficient paddling toward shore or a rescue ship. It will be obvious that the modification of vessel 60A is equally applicable to vessel 20.

Referring now to FIGS. 13–16, vessel 60B's structural modification to basic dry-entry vessel 60 now makes it possible for the vessels to perform all of the useful functions of personnel harnesses previously required by anyone using personnel lowering device (PLD) 129, but with none of the undesirable characteristics of such harnesses, in addition to the other new functions hereinbefore associated with vessels 20 and 60. It will now become obvious that, if the encasement structure of vessel 60A and its securement to a standing line 145 (or to the yoke 176 of vessel 160D, hereinafter disclosed) are made sufficiently strong, the PLD 129 system of vessel 60B will also become directly applicable to vessel 60A. In fact also, the widened forward ends of upward extensions 61B and 62B of vessel 60B would provide room for greater leg movement in vesel 60A if the encasement assembly of vessel 60A were conformally widened at its upper rim for assembly to the hull in the manner that will be employed in assembling leg encasements to the hulls of vessels 160D and 160E, as hereinafter disclosed.

The installation of PLD 129 shown in FIGS. 13–16 eliminates all need for training of shipboard personnel and passengers to adjust and fit their legs properly to buttock straps and then fit and secure the torso portions around their bodies before they can use PLD's to escape from elevated zones. Nor is there any longer an excuse for substituting a simpler but far more dangerous harness, such as a chest grip which, to prevent slipping, with resultant arm-shoulder injuries or, worse, falling free of the PLD altogether, must be secured so snugly as to inflict severe pain and possible rib fractures from the instant of suspension upon persons who have either not been specially trained in PLD use or are not in prime physical condition. The open shoulder sling, used for PLD demonstrations by highly trained and fit personnel, is wholly unfit for use by untrained amateurs. Still more importantly, when group departures must be made from an elevated deck, much cumulative time that otherwise would be lost in fitting individual harnesses before successive departures, especially in darkness and peril of panic, will be saved. No harnesses are required; and even relatively infirm persons can apply both hands for squeeze-controlling of PLD 129 which regulates descent speed inversely to squeeze (or braking) force applied to the control arm.

Moreover, unless "life preservers" are put on after the prior art PLD sling or harness is donned, in which case they may interfere with its use, inflation with a cartridge may result in inflation-cell rupture, leaving the escapee with no means of flotation whatever. As is well known now, however, a so-called life preserver is almost valueless anyway in cold water, its user being subject to quick death from hypothermia or a combination of drowning and hypothermia, which is even quicker. Decked vessel 60B offers unprecedented advances in descent and flotation protection; and it enables doing away with auxiliary flotation devices and PLD harnesses.

Figure 13:
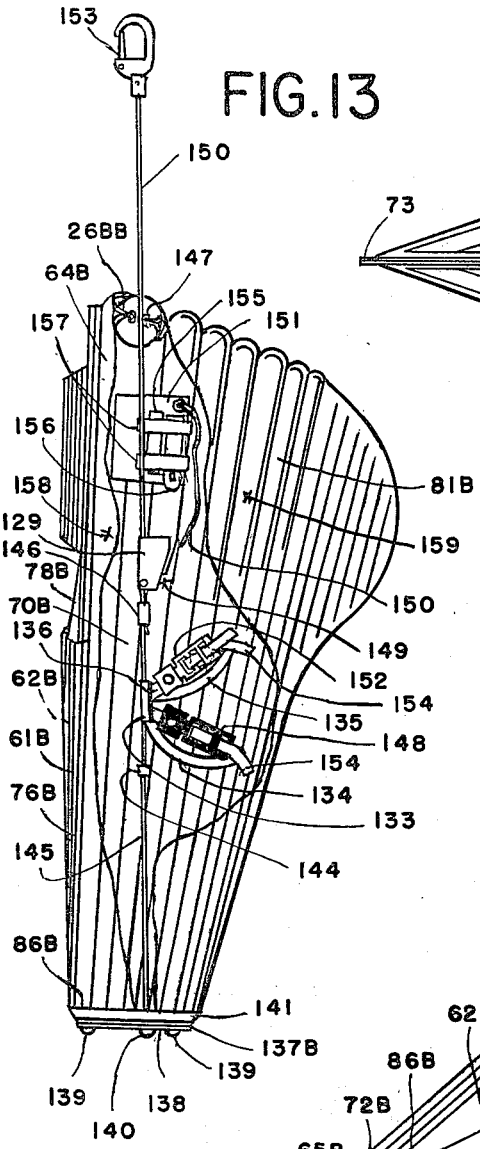
FIG. 13 is a partly cutaway drawing of inflated dry-entry vessel 60B, a derivative of vessel 60.

As shown in FIG. 13, a manually speed-controlled PLD 129 can be anchored via standing line 145 to any suitable point in a decked vessel that will enable the occupant to hold PLD 129 within his grasp in a manner that enables him to exercise control over descent speed. In vessel 60B, which the occupant can enter by stepping backward through the opened fastener 79 hatch of afterdeck 78B and inflate form within, he stands on platform 131, to which standing line 145 is anchored between his feet, the upper end of standing line 145 passing into PLD 129 to anchor it in turn so that the PLD carries the full weight of the occupant and his descent vehicle.

When suspended under a PLD and carrying live loads that may range up to 300 pounds and possibly higher, the bow weld seam 73 of prior vessel 60, if not reenforced, might be subject to failure, not of the fabric, but through possible peeling of the bow seam in the coating under the wedging action of a large occupant's shoes. Strength considerations can be satisfied by firm, lap-bonded or possibly even sewn securement of a medial fabric floor across the triangular gap between the hull sides and the end of foredeck 76. Better still is the lap bonding of medially widened seam-edge strip means as discussed below.

Figure 14:
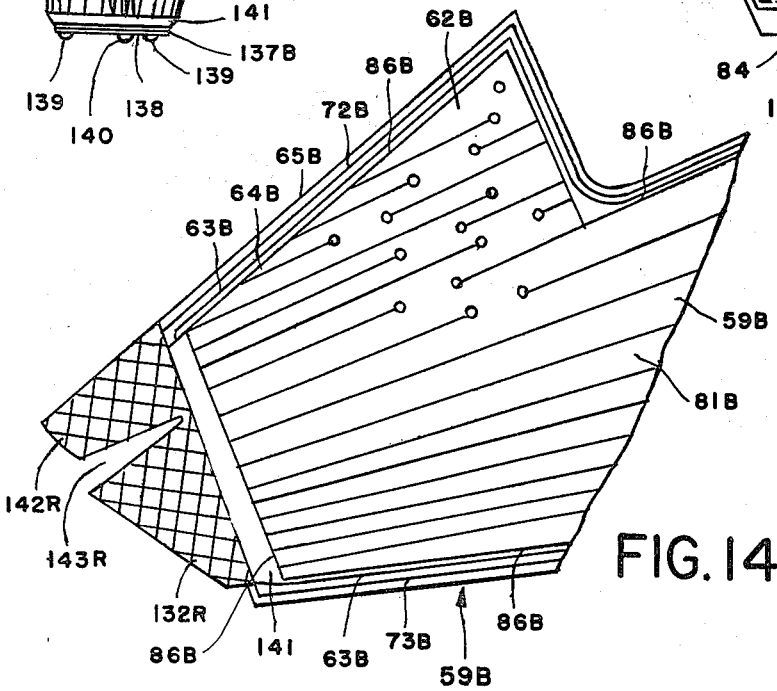
FIG. 14 is a view from the left of the forward portion of the right side of the uninflated hull of vessel 60B.

FIG. 14 is a view from the left of the forward portion of the right side of symmetrical hull 59B, including upward extension 62B. The inflation perimeter is indicated by line 86B, which also encompasses upward extension 62B, except for the seam-edge strip means in which weld line 72B is located for joining this right-hand upward extension 62B to symmetrical left-hand upward extension 61B along the centerline of thus-constituted foredeck 76B. These upward extensions taper less sharply than do those in vessel 60; so foredeck 76B will be wider at its forward end than was the foredeck 76 of vessel 60. The distal seam-edge strip means projecting forwardly beyond pneumatic outline weld 86B is made extra wide to include portions 132R and 132L (the latter not seen) respectively projecting distally forwardly of the right and left sides of hull 59B, as well as 142R and 142L (also not seen), projecting distally forwardly of the right and left upward extensions 62B, 61B. Strip means 142R and 142L thus respectively also represent the distal strip means for the right and left sides of foredeck 76B, which will be constituted by bonding upward extensions 61B and 62B together along line 72B, which thereby becomes the foredeck centerline. Widened strip means 132R is separated from strip means 142R by slot 143R to accommodate the right-angle bend between the hull and foredeck 76. Strip means 132L and 142L, not seen but bearing a mirror relationship to 132R and 142R, are similarly separated by unseen slot 143L.

Widened seam-edge strip means 132R and 132L are then lapped across each other frontally from right to left. Strip means 142R and 142L are also lapped frontally but downwardly across the first two so that they may also be included in the stiffened medial seam shown in FIG. 16 and united by intervening adhesive layers 137D, 137A and 137. They are then compressed together and sandwich-cured dielectrically to form a strong, wide, thick seam for supporting the occupant during descent via PLD.

Figures 16, 17, 18, 19, 21, 22:
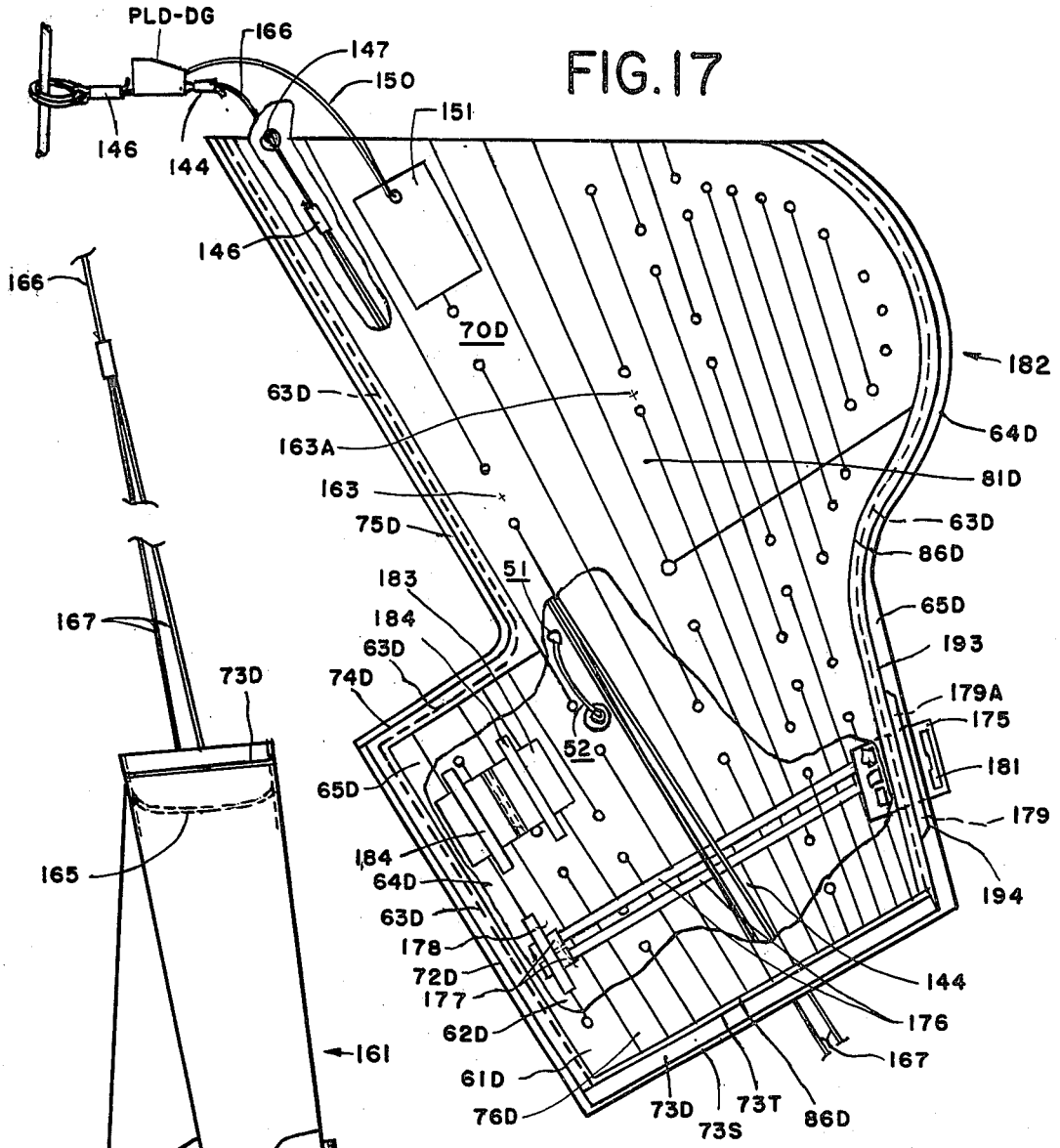
FIG. 16 is a cross section of the platform installation in vessel 60B.
FIG. 17 is a partly cutaway view of the installation made in the hull portion of dry-entry vessel 160, a derivative of vessel 60.
FIG. 18 is a transverse cross section, looking downwardly, from the waist level of the standing occupant during descent in vessel 160, illustrating his confinement in the trapeze posture.
FIG. 19 is a view of the leg-encasement portion of vessel 160.
FIG. 21 is a cross-sectional view of the joint between the leg encasement assembly and the hull of vessel 160.
FIG. 22 is a cross-sectional view of the anchorage of the standing line in the boot of vessel 160.

If it is adjudged that the occupant will be safer from ankle injury in the event of landing elsewhere than on the water with his shoes firmly planted side by side on a flat platform, the sandwich and a pair of triangular or trapezoidal reenforcing plates 138, 138A may be drilled and rivetted 139 together or, alternatively, bonded with intervening adhesive layers 137B, 137C holding the assembly in place at the bow and thus forming platform 131 of FIG. 16. Standing line 145 will be passed through a snug or sealed central hole and its strands spread radially for imbedment in a solder layer on the underside of disc or washer 140. Platform 131 provides firm, side-by-side shoe support, but adds weight, bulk, and cost that may often prove objectionable. It will rarely be needed.

Because of drawing and reproduction limitations upon the representation of thin materials in FIG. 16 and because of the number of layers of fabric (which total only about 0.048 inch thick (1.2 mm) overall), in addition to the comparable total thickness for the combined 5 layers of adhesive, (137, 137A, 137B, 137C and 137D). FIG. 16 appears excessively thick in relation to platform width, which contrariwise, has been scaled down from the width necessary to accommodate a pair of large shoes side by side. While FIG. 16 indicates, for clarity, that the fabric and adhesive interlayers are trimmed precisely to the edge contour of end plates 138 and 138A, it is more likely that the manufacturer will reasonably choose to pack down a moderate amount of fabric projecting beyond the end-plate edges and recover area 141 between inflation periphery 86B and platform sandwich 131 with an adhesed cosmetic outer skin of fabric.

The upper end of standing line 145 is then passed around the anchoring pin inside PLD 129 and secured to itself by compression clamp 146, as in FIG. 13.

Dispenser 151, containing the reserve supply of suspension line 150, of length at least equal to that required for safe descent to water, is secured here to the face of vessel inner sheet 64B by any appropriate means, such as a pair of hook-and-pile fasteners hidden therebehind. Alternatively, dispenser 151, or any form of dispenser, may be affixed directly to PLD 129 or other PLD that pays out suspension line in a similar manner. The end of suspension line 150 is then threaded through PLD 129 via a recess in control arm 149 and passes outwardly therefrom through the stern of vessel 60B. The passageway consists of a small grommet 147 set into the center of a spot or ring weld 26BB set at the intersection between midline 80B and the weld separating the two top hull segments of cell 70B. (Weld 26BB is similar to, but may be larger than, the spot or ring welds 26B used for termination of linear inter-segment welds, as previously discussed in connection with FIG. 1.) Again because of drawing limitations, grommet 147, spotweld 26BB, and fabric thickness (typically 0.007" or 1/6 mm) have had to be shown enlarged in the inset circle. Weld 26BB prevents escape of inflation gas from cell 70B. Suspension line 150 then terminates in snap hook 153 or in any appropriate means for connecting vessel 60B to an extraneous overhead suspension means. Thus, payout line 150 is the working line that drives the internal pulleys of PLD 129, which in turn drive the internal braking mechanism that governs the PLD's descent speed as an inverse function of the squeeze exerted against control arm 149. Descent speeds have, upon occasion, been slowed to as little as about 2 feet per second for lightweight individuals.

One of the preferred types of extraneous overhead suspension means is an overhead boom (not shown) that is pivotable and may be swung from inboard stowage to 90° outboard of the ship's deck edge. The boom may have an initial downward tilt or be adjustable to the proper tilt if the ship has acquired a list. It will carry at its inboard end a number of small trolleys, each of which carries one vessel 60B and is capable of individual release to roll outwardly along the boom to a stop fixed at the outboard end thereof, via a sharp downward pull by the occupant, after the vessel has been inflated by himself or extraneous agency, who is facing after deck 78B after closing its hatch via access fastener 79. The occupant applies the downward force while standing on a pedestal; and he may jump upwardly to clear any possible obstruction as he departs. The trolley will carry the occupied vessel outwardly along the boom past the deck edge until it reaches the stop at the end of the boom, enabling descent at controlled speed to the relatively soft, feet-first, dry and self-righting entry into the water that is assured by the design and buoyancy distribution of structurally closed vessel 60B.

During the descent, the occupant's enclosure between the vessel hull 59B and the well-secured combination of foredeck 76B and afterdeck 78B makes it impossible for him to fall out during descent; and the continuous tension on standing line 145 gives him a stanchion-like vertical support during the descent inverval. He will have maximized all-around protection against lateral impacts with the side of a rolling ship if all cells have been pre-inflated before departure from the high level.

Simultaneous inflation of the cells may be automated, of course, either by means of a manifolded supply, which can be incorporated into the inflation pattern itself, or by simultaneous electrical initiation of diaphragm rupture of the gas bottles to individual cells via switch means, or via sequential inflation, triggered mechanically or electrically by expansion of other cells in the vessel. Inflation of the foredeck together with the upper cell has been shown in connection with vessels 60, 60A and 60B, though other arrangements are feasible, and inflation of the entire deck and the upper hull cell will be seen in connection with deck 210 in FIG. 28 hereinafter.

If it is desired to seal off the cells from each other once they have been inflated by a single agency or a single $CO_2$ bottle, one-way check valves may be sealed into inter-cell venting openings so that damage to the primary inflation cell, or manifold, will not vent the others.

A firm operating grip on PLD 129 will provide sufficiently good balancing guidance for the occupant who stands on the medially bonded seam edge strips discussed hereinbefore or on platform 131; but he will also have another hand available for holding on to line 145. However, since the occupant's body represents nearly all of the suspended weight and since his own center of gravity cannot fall precisely along the axis of standing line 145, the resulting slight unbalance, which presently affects all users of the various PLD personnel harnesses, could conceivably result in injury, despite the impact-absorbing capability inherent in the inflated hull, if the descent should terminate upon machinery either on the deck of a rescue vessel or on a dock if the ship is in port. Accordingly, an optional pelvic harness 133, adapted to slide vertically along standing line 145 between lower limit stop 144 and compression clamp 146 to suit a wide range of occupant sizes, is shown. It consists of a pair of strap belts 134, 135, each comparable to automotive or aircraft seal belts, cross-mounted together upon loop-fitted pelvic pad 136, which provides guidance and support. The occupant will receive instructions that, before inflating and descending, he first will pass the lower strap 134, carrying black buckle 148, around his body immediately below the fleshly part of his buttocks and couple it to the lower, or black, latch, then pass upper strap 135, with the chrome buckle 152, around the small of his back above the buttocks and couple it to the chrome, or upper, latch, snugly pull-tightening both adjustment straps 154, 154.

Following his flotation, the occupant may cut polyester suspension line 150 free above PLD 129 via knife 155, seen on the face of dispenser 151. He then may open the afterdeck hatch via fastener 79, seen previously in FIG. 7 in connection with vessel 60, of which vessel 60B is a direct derivative. Floatable flashlight 156, carried on dispenser 151 by a pair of straps 157, enables the occupant to refer to instructions printed on the face of dispenser 151 or elsewhere on inner sheet 64B before commencing descent. Dispenser 151 can be built into a pack large enough to carry a thermally reflective blanket, provisions, etc. The former need for boot 77 is eliminated. Inflators for cells 70B and 81B may be located on the face of inner sheet 64B at cross-marked points 158 and 159, respectively.

Referring now to FIGS. 17 through 22, the history of ship disasters is replete with instances wherein hundreds of potential survivors who had managed to reach the water died quickly of exposure hypothermia (which accelerates drowning, especially if the water is agitated) in their so-called "life preservers". Lifeboats, of course, have often been disabled by listing of the ship or by direct damage thereto; or they become inaccessible to would-be escapees because of intervening ship damage, smoke, fire, fumes, or compartment flooding. Large ships with elevated decks and many levels of compartments below pose a special accessibility problem. Personnel fleeing fire jump desperately to death or incapacitating injury from high levels and others drown within the ship while vainly seeking escape. Had vessel 160 been available and accessible where workers performed duties and where passengers slept or enjoyed recreation heretofore, countless lives would have been saved.

Vessel 160, also a derivative of vessel 60, as well as of 60A and 60B, expands the leg-articulation principle introduced in vessel 60A with fully articulable legs that enable wearers to climb and descend ladders, to accomplish their exits via hatches or around obstructions and even to pass through partly flooded compartments in remote zones of a distressed and wave-racked ship so as to achieve an open deck, portal or overside ladder. FIG. 17 is a partly cutaway view of the uninflated hull portion 182 from the left. FIG. 19 shows the leg-encasement means 161, not yet assembled medially to the open distal end of hull 182 and foredeck 76D. Ship crews and passengers, as well as workers on oil rigs, may now descend via available ladders or stairs to the surface of the water, with complete confidence that they are far better prepared for survival than individual escapees on the surface ever have been before.

Figure 20:
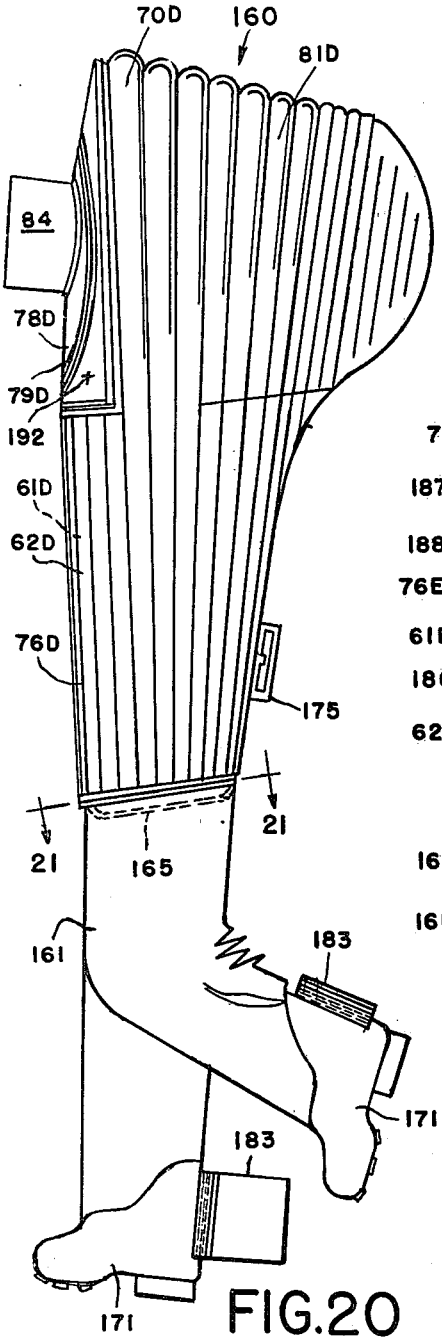
FIG. 20 is a side elevation of the inflated assembly of vessel 160.

Afterdeck 78D is similar to that used in vessel 60B and is also joined to upward extensions 61D and 62D (foredeck 76D) in the same manner that afterdecks were joined in vessels 60, 60A and 60B. The centerline edges of upward extensions 61D and 62D that complete cell 70D are joined by welding along line 72D. In FIG. 20, afterdeck 78D is assumed inflated, but repetition of segment details is omitted for clarity. The segment pattern does not have to be the same as that shown in FIG. 7. Cell 70D's oral inflation means 51, 52 is located inwardly on the right side; its cartridge inflator would normally be located either directly opposite on the left side or further aft beneath cross-marked point 163. Inflation means for cell 81D will preferably be beneath cross-marked point 163A.

In FIGS. 20 and 21, the latter a cross section of the joint between leg encasement 161 and hull 182, the bond between hull 182 and leg encasement means 161 is complete. Its location with respect to the hull is best seen defined in zone 73D extending between lines 73S and 73T of FIG. 17, where the upper rim of leg-encasement means 161 is circumferentially sandwiched and welded or cemented circumferentially and medially between the paired distal seam-edge strip means lying outwardly of pneumatic sealing weld 86D in inner and outer sheets 64D and 65D. Alternatively, the bond may be made between the outer surfaces of the distal seam-edge strip means and the inner surface of the rim or vice versa. The joint may be reenforced if necessary by circumferentially taped strips adhesed on the outer and/or inner surface around the surface discontinuity between the hull and leg encasement 161. FIG. 20 portrays the welded, completed, closed, and inflated vessel 160 before the occupant begins to retract his legs and move aft to float in the normal attitude.

Encasement assembly 161 can be compared to crotch-equipped "hip waders" used by fishermen; but, as a part of vessel 160, its actual function in most of the ocean emergencies for which it was conceived resides in the safe shipboard mobility it provides the individual who is threatened with death, perhaps deep in the ship's interior, to gain access to a departure point from which he can reach the water below the vessel. Regardless of egress route or eventual point of departure, one who has been expressely taught to take it along before leaving work station or recreation area can enter the water within vessel 160 free from the twin threats of drowning and immersion hypothermia.

Vessel 160 has a slim insert member 175 bonded on both of its sides along lines 193 and 194 medially between the seam-edge strip means projecting from inner sheet 64D and outer sheet 65D to complete keel 182. Inserted butyl sealing plugs 179, 179A guard against water leakage via such seam discontinuities as may possibly exist along the edges of insert 175. Insert 175 has inward openings at three heights (with respect to the occupant when he stands within the articulating leg-encasement assembly 161) to accommodate belts 176, two of which are shown in place, though one will suffice if placed by the user in the proper opening. The openings enable belt-height adjustment to fit a wide range of occupant sizes, as do the long, military-type belts 176, with their infinitely adjustable buckles 177. Belts 176 are anchored for stowage around both left and right sides of inner sheet 64D by hook-and-pile fasteners 178 in order that the occupant may move about the ship before departure. The belts have a second purpose in that one of them can be cinched around the user's waist during transit through the ship to an escape point with the aft overhang of uninflated cells 70D and 81D tucked down behind his back and cinched in place with the second belt. When he desires to make water entry, he can pull out the fabric and re-cinch the belt (s) before inflation of cells 70D and 81D. He may do this in order to pass through flooded zones as well as before abandoning ship. Since the bulk of the packed vessel is comparable with that of a loaf of bread, he can optionally carry it under the arm or in a body-attached pack until he needs it functionally.

Insert 175 also has a supplemental opening 181 exterior to the hull, which enables him to secure other survival supplies thereto. Such items can, if desired, be pre-attached while the vessel is stowed in a ready-service locker.

Figure 25:
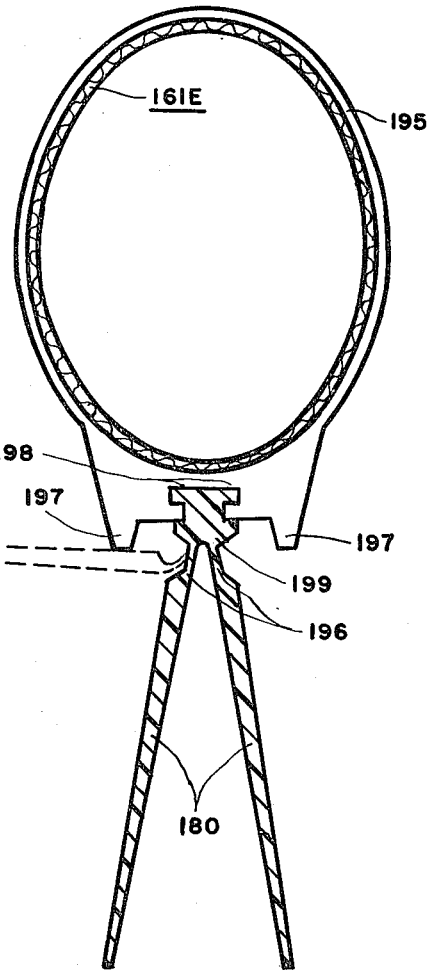
FIG. 25 is a view of the kick-fin assembly mounted on one leg of vessel 160E's leg encasement means, said means appearing in cross section.

So as not to interfere with egress to a ship-departure point over the cluttered debris associated with ship damage, two kick-fin pairs 183, 183A, which are optional and are detailed in FIG. 25, are preferably stowed within vessel 160, one pair being shown stowed in FIG. 17 behind hook-and-pile tapes 184, 184. Each pair is ready for insertion into one of the elastomeric groves identical to the kick-fin grooves 198 detailed in FIG. 25 but molded onto the backs of boots 171 (FIG. 20).

One kick-fin pair is shown in the propulsion attitude it will take on the down and aft stroke of the left leg in FIG. 20, the one on the right leg being in the streaming attitude it will take during forward and upward motion of the leg. Normally, the fins will not be slipped into place until the user has arrived at the point from which he will make water entry. The occupant will find fins 183 highly effective in quickly gaining distance on the water from the distressed ship and possibly also for making headway toward shore or rescue. Further details are discussed in connection with FIG. 25.

The occupant also retains capability for moving back into a seated posture and paddling either with hands or a stowed, telescoping paddle. For maximized comfort and visual command through the turret or bubble 84 in afterdeck 78D, he may release belt(s) 176 and slide aft and out of encasement 161, then seat himself aft in the usual manner, orally filling cell 81D (if not already filled for PLD descent) to keep the vessel at optimum balance. Before venturing to paddle himself clear, he may reduce the drag of now-empty encasement 161 by drawing it aft via yoke 166 and collapsing it into the bow, then folding a bight in yoke 166 and passing it through one of the internal openings in insert 175, whereupon, via a hitch, he can retain encasement 161 in its folded, retracted, and thus-compressed position to streamline the craft and maximize his own thermal isolation from the water.

Unless wave action or precipitation threaten him, he may alternatively open fastener 79 in afterdeck 78D and, if necessary, depending on his reach, bleed some gas out of cell 70D via its oral inflator to soften the gunwale in order to facilitate padding toward a safer spot on the surface, after which he may orally top off cell 70D and close fastener 79 over most of its length for sleep while awaiting rescue.

The flotation cell arrangement for vessel 60 necessarily differs from the layouts in vessels preceding, the entire bow portion now being part of the large, initially-inflated cell 70D. For optimum thermal protection, afterdeck 78D would also include optional inflatable afterdeck cell 87D, like that for vessel 60; but there will be situations wherein the bulk of such a cell will be undesirable, as when the afterdeck is to be fitted with sleeves, one at cross-marked point 192 for the left arm, the right sleeve location being symmetrically opposite in hybridized versions of vessels 160 and 160E, to be discussed later.

The PLD-DG 129D, signifying what the manufacturer calls a "descent governor", is a further innovation in the design of personnel lowering devices. PLD-DG 129D, illustrated in FIG. 17, closely resembles PLD 129 used in vessel 60B except that, in place of the former extending control arm 149, a small internal bell-crank lever has been so fitted therewithin that it applies additional snubbing pressure to the suspension line passing therethrough that enhances its braking capability as a function of the magnitude of the suspended weight, thus compensating for a wide range of occupant weights and enabling manufacture of the device to a desired descent speed (usually either 6 ft/sec or 12 ft/sec) that is for practical purposes independent of the weight of the occupant and does not require him to perform any speed-control function. The reserve-line dispenser 151D is relocated to the outer surface of vessel 160 at the stern. Use of PLD-DG, 129D, does not, therefore, limit its location to within convenient reach of the hands; in fact, it may be located any where above its vessel attachment and may even be incorporated into the extraneous suspension structure thereabove, with the suspension line also stored therein, perhaps on a continuous payout reel, if preferred by the designer of the ship or oil rig, in which case hook 153 will be replaced by a "come along" or other suitable mid-line attachment. The knife and flashlight should remain inside for handy access by the occupant. The automatically speed-controlled or governed PLD-DG 129D may be substituted for the manually controlled PLD in vessel 60B or in any of the vessels described herein which may be adapted for descent from high elevations.

To illustrate the wide range of placement freedom for PLD-DG 129D, it is shown on the stern outside the vessel, which will hang in the legs-down attitude for receiving the standing occupant. Vessel 160, when stored in quantity in a ready-service locker at a normal point of departure, may have any kind of suspension terminus, in place of hook 153, that may be suited to the extraneous overhead suspension means. When stored in internal work or passenger spaces, other types may be more suitable; or the line may be left bare so that it may be lashed to pipes, rails or any object projecting from the ship or oil rig.

The stem of inverted yoke 166, which replaces the standing line of vessel 60B, is seen passing through grommet 147, which has become visible in FIG. 17 via the artifice of tearing free a small contiguous portion of the left side of the hull. Grommet 147 has been relocated to a spot or ring weld implanted through the middle of the uppermost inflatable segment of cell 70D at the stern centerline. The presence of the annular weld around grommet 147 again prevents pneumatic leakage at the point of yoke exit.

Inverted yoke 166 has a pair of depending arms 167. As seen in the detail of FIG. 22, the end of each arm 167 (preferably of polyester so it may be cut with a knife after touchdown) may be opened slightly and passed several times through the openings in small grid 168, which is dipped into self-hardening epoxy mix to accumulate a coating thick enough to create a mechanically strong bond. These termini are molded into heels 170, which are then joined to boots 171 of leg encasement assembly 161. Above boots 171, arms 167 are taped to opposite walls of leg encasement 161 so that they will not interfere with occupant entry between them. After leg encasement 161 has been joined to hull 182, the upwardly aligned stem of yoke 166 is attached to PLD-DG 129D in the same manner as was done in vessel 60B, except that this juncture is made behind the stern of vessel 160.

The purpose for so elevating the PLD-DG 129D for vessel 160 suspension therebelow is to permit the occupant to stand with his weight perfectly balanced between the elongated arms 167 during the descent to water. He can assure safe retention in this fully balanced trapeze posture by employing one of the belts 176 for this third purpose. As seen in FIG. 18, belt 176 has been wound one turn at waist level around left-hand yoke arm 167, then passed behind the occupants's body, represented by the shaded, modified ellipse, wound another turn around the right hand yoke arm, and buckled in front.

If such an occupant must escape fire, he can engage hook 153 above PLD-DG 129D to a nearby suspension point and go over the side quickly and safely, remaining dry while awaiting rescue in the water. He may even work within the vessel with sufficient suspension line paid out to give freedom for limited movement. If he should fall overboard or be carried over by green water while so enclosed, his first response will be to actuate the automatic inflator for cell 70D or, preferably, an actuator (not shown) for simultaneous inflation of all cells, enabling him to ride safely off the ship to flotation on open water with full protection from wetting and hypothermia until rescue.

These specially tailored vessel 160/160E hybrids can thus also solve particular escape problems for which neither vessel 160 or 160E can cover all possible eventualities. Moreover, availability of these hybrids and rigorous training in their mild-weather use may enable the ship's captain to postpone or avert the morale breakdown that occurs in endangered ships when inexperienced or fearful crew members hesitate or refuse to perform dangerous exposed duties in ship crises, thus perhaps precipitating premature ship disablement and abandonment, with greater hazard of personnel casualties.

The bi-pedal yoke of vessel 160 is also applicable to vessels 60A and 60B with certain limitations. In the case of vessel 60A, yoke arms may be attached to the foot encasements provided that the attachment means is made sufficiently strong to carry the suspended weight of the occupant. Only the stem of the yoke can be attached to a PLD. If the yoke arms extend above the occupant's head to a stem thereabove, the manually controlled PLD 129 becomes unsuitable and use of the weight-compensated PLD-DG 129D is indicated. Yoke arms may extend well beyond the sterns of vessels 60A and 60B if separate grommets or a sponge-closed slit are provided with proper spacing therebetween. The weight-compensated PLD-DG 129D may be directly substituted for PLD 129 in any vessel.

Figure 24:
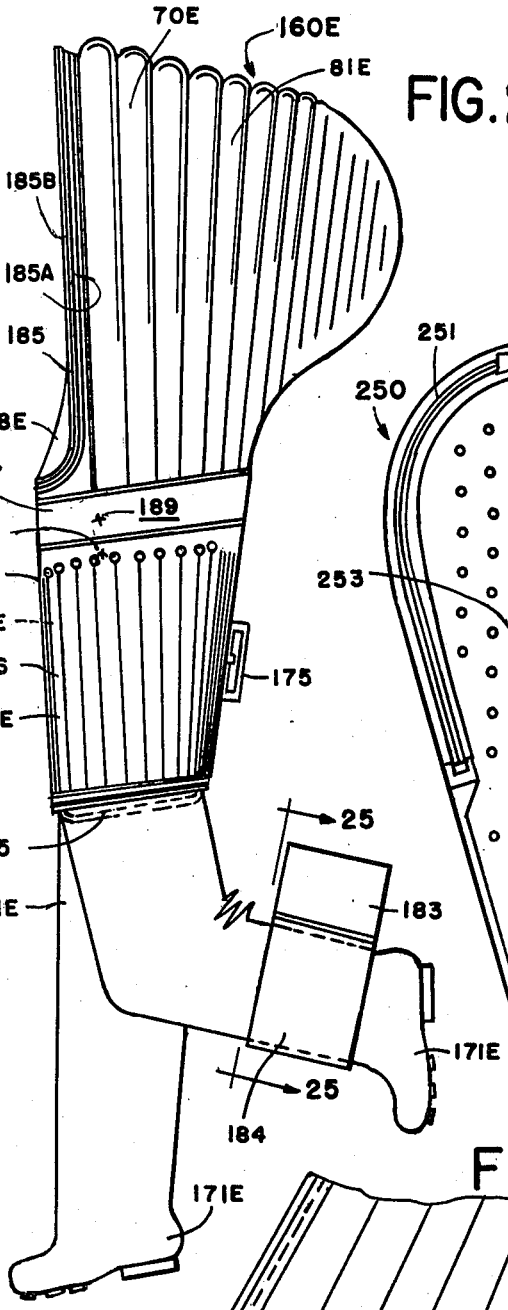
FIG. 24 is an inflated side elevation of dry-entry vessel 160E.
Figure 23:
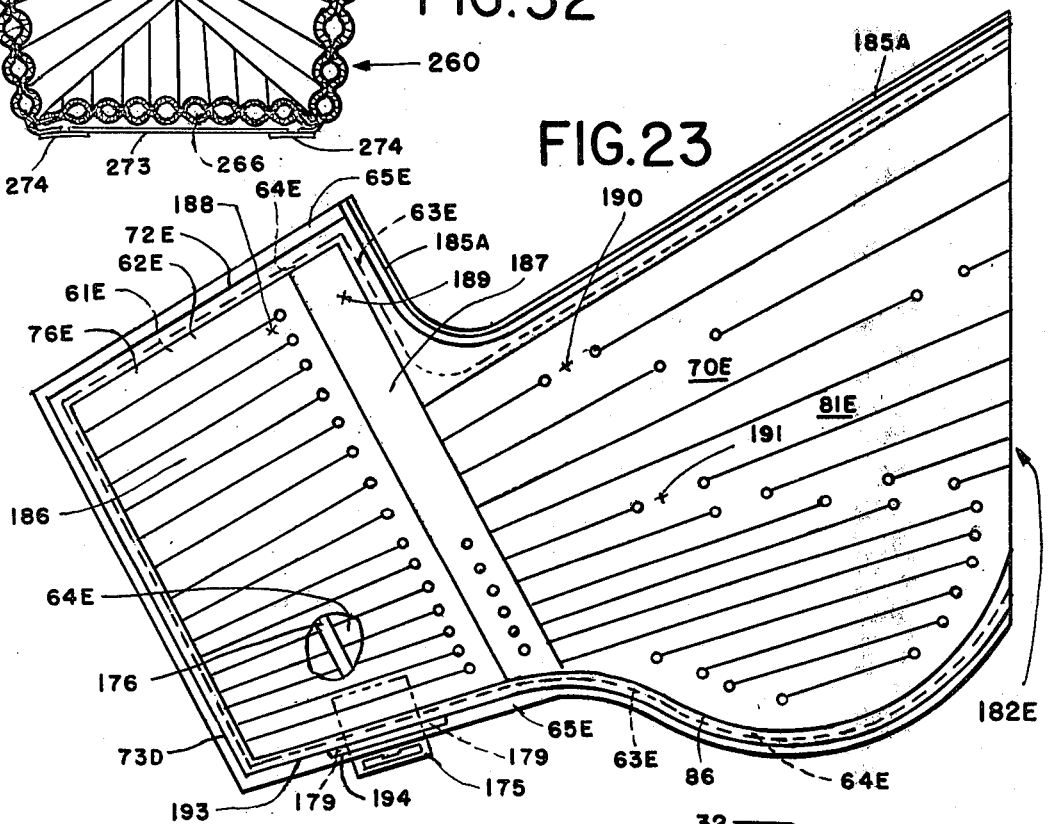
FIG. 23 is a partly cutaway elevation of the uninflated hull portion 182E of dry-entry vessel 160E, a derivative of vessels 60 and 160.

Referring now to FIGS. 23–25, vessel 160E, a derivative of vessels hereinbefore described, further expands the leg articulation capability to enable fishermen and others seeking water recreation, as well as limnologists, scientists studying fish survival, etc., whether they approach water afoot, by bicycle, recreation vehicle or automotive vehicle, to launch themselves in bad weather easily and repeatedly without wetting their persons in order to reach deep water, cross it and achieve distant shores or islands. It enables fishermen to wade, as with conventional waders, and, when they desire, to continue over any depth inaccessible to others in the comfort of a soft, dry, waterborne seat in search of greater success. The inherent superiorities in vessel performance ratio to stowed weight and bulk, water safety, thermal insulation, and capability for easy, stable, dry and safe navigation of the high-freeboard vessel over other unpowered craft are conspicuous enough. When equipped with leg encasement 161E, the combination of shore, boat, and pier launchability and dry water entry is unprecedented. These vessels will open new horizons for fishermen, hikers, and back-packing adventurers (the latter possibly preferring larger sizes like vessel 260G in some cases). They are also useful in that they can replace heavy and bulky dinghies for reaching boats that have to be moored and for going ashore therefrom. Afterdecks may be omitted for pedestrian entry from bank, beach, shore or very low pier or deck from which the occupant can lower himself slowly and slide via a handhold for dry water entry. In these latter instances cells 70E, 186 and 187 should first be fully inflated.

Afterdeck 78E of vessel 160E is slightly longer (6–12" or 15–30 cm) than afterdecks preceding it to compensate for the correspondingly abbreviated length of foredeck 76E, upward extensions 61E and 62E having been foreshortened to clear the armpits of the wide range of sizes of occupants who will need to use it in the wading mode part of the time. Afterdeck 78E is attached to the upper seam-edge strips of the hull and to the aft seam-edge strips of foredeck 76 via a heavy duty peripheral fastener 185 in the manner to be described in connection with FIGS. 29 and 30, hereinafter. Zipper fastener 185 with its separable halves or sides enables users to dispense with the afterdeck or to stow it inside during favorable weather without sacrifice to the dry water-entry characteristic from beaches, banks and shores afforded by leg-encasement means 161E, augmented by cells 186, 187 and 70E, which extends into foredeck 76E. Afterdeck 78E enables dry plunge entry from piers and boats and also provides a shelter supplement for campers and backpackers. Since afterdeck 78E is fastener-attached to the seam-edge strip means projecting upwardly from the gunwale of vessel 160E, there is no need for hatch fastener 79. Afterdeck 78E is optionally inflatable. Peripheral "zipper" fasteners also enable campers to substitute a cover similar in shape to afterdeck 78E but having a screen panel within its zipper-half for sleeping in warm, insect-infested areas. Vessel 160E will greatly expand the latitudes and seasons for many kinds of outdoor recreation and suggests wholly new kinds of water and land-water sports.

As previously indicated in connection with vessel 160, hybridization via combination of features of vessel 160E therewith can become highly desirable and practicable for certain ventures and types of work. Aside from elimination of PLD-associated items, redistribution of length between afterdeck and foredeck, changes in cell boundaries, etc., the two hulls are quite similar. Their leg encasements are also similar except for the higher placement of kick fins on leg encasement 161E to facilitate wading in stony streams and replacement of the former yoke attachment 166 with a simpler and cheaper loop required only for retraction of the boots for collapsed stowage of leg-encasement assembly 161E at the bow.

The bow portion of vessel 160E comprises two cells. Bow cell 186 is short, so as to clear the armpits of users up to medium height, who may fold uninflated mid-cell 187 downwardly before folding the aft portion of vessel 160E behind their backs and tucking it inside belt 176, which they will cinch around their waists at proper height in insert 175 before stepping into the water. Tall and portly users should inflate mid-cell 187 to at least a soft fill. Short or short-legged users can tape down circumferential folds in each leg or may cement these folds permanently for their personal use. A demand is likely to grow for customized fits. The oral inflators for cells 168 and 187 are located inwardly beneath the cross-marked points 188 and 189 respectively. Longer inflation hoses should be substituted if reaching down is awkward. Oral inflators for upper aft cell 70E and lower aft cell 81E are located beneath cross-marked points 190 and 191.

Bow cell 186 should be inflated orally while the user is still in very shallow water. When the water level covers the knees, the user has the option of releasing aft cells 70E and 81E from their cinched position within belt 176, reclosing the belt, topping off mid-cell 187 and fully inflating cell 70E, then reclining himself on the water within vessel 160E. Experienced waders and active fishermen who are familiar with the local bottom and are in clear, calm, and slow water may instead prefer to continue wading until their hips are immersed, as they do when wearing ordinary chest waders, when they begin to sense their growing buoyancy and, consequently, the growing instability imposed by current, tide, breakers or streams bottomed with algae-grown rocks, all of which have heretofore severely limited their range.

However, the original miniboats and their vessel derivatives were invented to enhance safety and not to abet foolhardiness. Their purpose of keeping the wearer warm and dry will be defeated by a premature fall, such as wading fishermen (who seldom carry flotation means) are often seen to suffer, thus abruptly terminating the day's recreation. At least by the time the water reaches crotch 165, vessel 160E should be put into flotation mode by fully inflating mid-cell 187 and upper cell 70E and, preferably, at least partially inflating lower aft cell 81E, whereupon the occupant may lie back and float. He may release belt 176 and finish inflating cell 81E while he is retracting his legs from encasement means 161E and moving aft. Then, with his hands or a small paddle, he may propel himself on a desired course.

If he prefers, the occupant may optionally avail himself of kick-fin propulsion without need for disengaging belt 176 or moving aft. Attached to the left leg of articulatable leg encasement assembly 161E in FIG. 24 is seen one of a pair of kick fins 184 in the streaming attitude that they will take when the leg is moving forwardly, the legs normally being splayed apart a distance greater than the span of a pair of fins unless the kicking is being performed synchronously, with the legs moving in phase. While a pair of fins on one leg only or a single fin on each leg might suffice, the use of two pairs will generally be favored. The fins may, alternatively, be made to rotate behind the calf about an axis transverse to the leg. The adapter cuff 195, shown with fins assembled in FIGS. 24 and 25, will be molded of relatively firm elastomer, matched and bonded to the circumference of the leg encasement 161E above boot 171E. Mechanical attachment means would be acceptable provided that such means can be properly keyed against rotation of cuff 195 around the wader leg and does not constrict the leg against free withdrawal of the occupant's footwear at any time that he desires either to move to the orthodox aft position or to leave vessel 160E.

Each adapter cuff 195 is equipped with a removable pair of fins 180 articulating independently via their so-called "living hinges" 196. Backward motion of the legs in water forces the fins outwardly until they are stopped at the 90° attitude by buttresses 197, 197, in which attitude they have maximum effectiveness for forward propulsion. When the feet move forwardly between backward kicks, the fins trail with a minimum of water friction. They are best made of a one-piece molding of polypropylene or other material which combines the key properties of buoyancy (useful in case of disengagement from grooves 198 in cuff 195) and capability for integral molding of the "living hinges" 196. These hinges, when fully flexed while still warm from the mold, develop a unique molecular alignment that enables ready yielding thereafter to low forces, with a flexure life of hundreds of thousands or even millions of cycles. The two "living hinges" connect the fins to an integral rail member 199 of the cross section seen in FIG. 25, which may be slid downwardly into groove 198 behind the leg. Steering is accomplished by differentially greater or faster movement of the leg that is on the side opposite to the direction in which the turn is to be made.

Figure 27:
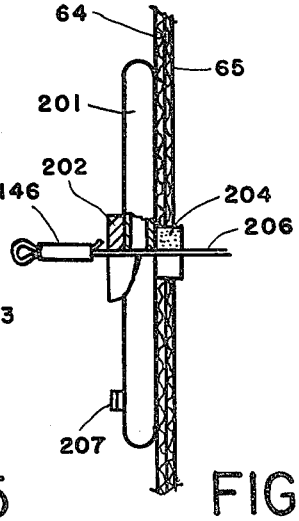
FIG. 27 is a side view of the arrangement of FIG. 24.
Figure 26:
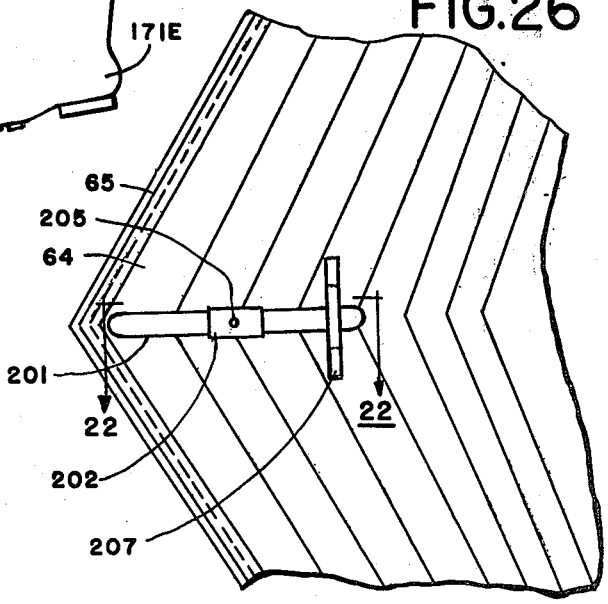
FIG. 26 is a partial view from the interior of a lift-connection termination arrangement for use with a fixed-speed lowering device of the character described in connection with FIG. 16.

Referring now to FIG. 26 and to partially sectioned FIG. 27, there is shown one of various suitable constructions for terminating the lift connection between a weight-compensated PLD-DG 129D (not manually controlled) and the aft end (or upper end when suspended) of vessel 60D or any vessel of this invention or other lightweight descent vehicle having sufficient strength at the bow end to bear the suspended weight of an occupant thereon.

FIG. 26 is a fragmentary view from inside of the aft end of the uninflated hull (or upper end when suspended) of vessel 60B, 160, or 160E. These drawings are representative of all of the vessels of this invention, whether or not previously so illustrated, when intended for use with a weight-compensated PLD-DG 129D or any self-regulated PLD or a payout reel means contained in extraneous overhead structure. Load spreader 201 is a smoothly finished, light-weight tube having rounded or tapered ends. When the occupant's weight is delivered centrally of load spreader 201 (optionally via soldered-on saddle 202, which may have a radiused interfacing surface as shown in partly sectioned FIG. 27), load spreader 201 will transfer and spread said load across a width of the adjacent fabric sufficient to guarantee a low-tensile loading to that portion of the fabric of outer and inner sheets 65, 64 that is stressed thereby. When the vessel is inflated before the load application to tube 201 is initiated, the fabric will normally tend to slide endwise from midlength of tube 201 as the gas/air is squeezed out locally at initiation of descent, but is restored upon load relief at water touchdown, when the vessel resumes its normal shape. Tube 201 is loosely confined in the alignment shown in FIG. 26 by nylon strap 207, adhered to the inner sheet 207 of the vessel hull at both ends thereof. The tube midpoint may be located along the weld line between adjacent segments of a cell, between segments of adjacent cells or even within a segment, that is, at the center of a spotweld or ring weld that excludes leakage of inflation gas through hole 205 for passage of line 206, as previously shown and discussed in connection with FIGS. 13 and 17.

Line 206 is preferably of polyester cord, which can be cut with a knife after touchdown. It may lead to a PLD-DG 129D as in FIG. 17 and thence to a hook like 153 or, instead, directly to the hook, with the lowering reel installed on the ship's suspension boom. The lower end may terminate inside the vessel in a ball of cured epoxy in which its end fibers have first been spread so that they will all be individually locked, or in a compression clamp 146, as shown. Line 206 is led transversely through the hole in tube 201 (and saddle 203, if present), the two layers of vessel fabric within a sealing ring weld, and an optional self-sealing plug 204 of soft elastomer or foam bonded on the outside over the weld area to exclude water when line 206 is severed after the vessel is afloat.

It will be apparent from FIGS. 26 and 27 that a load spreader having a broad, disc-shaped outline will, alternatively, function as well as load spreader 201. It will further be apparent that the disc-shaped load spreader can, but is not required to, be bonded to the inboard surface of inner hull sheet 65, 65B, etc., if line 206, extending upwardly to PLD 129D or to an extraneous payout reel, is firmly secured to itself inboard of the disc via compression clamp 146 or by spreading its strands and encasing them in a ball or disc of cured epoxy. Preferably such disc will taper down to a minimum thickness at its outer rim in accordance with orthodox engineering design principles; but it should not be sharp edged. Such a disc may, alternatively be bonded to outer sheet 64, 64B; but such an outside location requires assurance of an excellent bond and fails of assurance that the occupant can sever the line to detach himself from the stricken ship or oil rig after he has touched water. Drawings will be furnished if required.

Referring now to FIG. 28, there is shown the plan of vessel deck means 210, which may be dimensionally adapted to fit any of the vessel hulls herein described. Upward extensions 61F and 62F are cut as integral parts of the appropriate vessel hull, such as vessel 60B, but here indicated as hull 211. They project upwardly from the bow end in a manner similar to that in which upward extensions 61B and 62B of vessel 60B and other derivatives of vessel 60 were formed; and they extend aft to form the complete deck 210 when joined together by lap seam bond 217 along the deck centerline. Upward extensions 61F and 62F receive inflation gas/air via venting openings 212, 213, leading from the respective upper sides of top segment 214 of upper hull cell 70F, together with which both sides of the full-length inflatable deck 210 may be inflated in one operation, as previously discussed in connection with vessel 60B.

The aft portion of deck 210 is bounded by left and right access fasteners 220, 221, which, when their respective pull tabs are drawn aft, will close the gaps 224, 225, and 226 that separate hull 211 and deck 210 in the drawing, thus pulling and inter-stressing hull and deck together when the closure process and inflation have both taken place. Use of deck 210 provides the fastest possible emergency departure, since only one cartridge, for cell 70F, needs to be actuated for dry, self-righting water entry via this modification when applied to vessels of this invention.

The vessel of which deck means 210 becomes a part can be entered when uninflated by simply stepping backwardly thereinto and pulling it upwardly, inflating upper cell 70F, and closing fasteners 220, 221, after which the occupant can jump off a deck or pier and remain dry and floating erectly, thereafter inflating lower cell 81F to the extent desired and paddling away. It can, of course, be entered directly by a swimmer if the fastener tabs have been placed in the forward, or open, position.

The "tufted" appearance of the inflated segments derives from the discontinuous placement of the spot or ring welds that control the overall inflated thickness. A more uniform distribution of stress in the deck regardless of inflation pressure can be achieved with this type of weld pattern than is likely to be obtained with the longitudinal segmenting that has been used to make most of the hulls built to date. This type of pattern is less likely to result in sticking of the closing fastener. However, longitudinal segmenting of hulls, as distinguished from decks, is still preferable because it reduces drag and enables headway to be more easily maintained.

Figure 29:
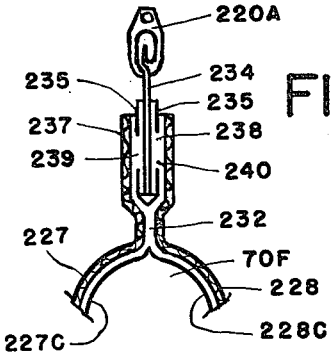
FIG. 29 is a cross-section accompanying FIG. 26 and showing a typical arrangement for structural assembly of one side of a fastener to the fabric of a deck or hull of a vessel of this invention.
Figure 35:
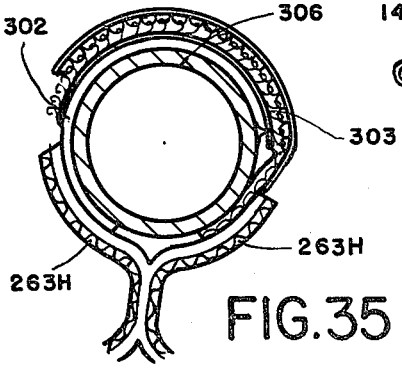
FIG. 35 is a cross-sectional illustration of the manner of attachment of superstructure 307 to the hull of vessel 260H.

Referring now specifically to FIG. 29, the cross section depicts a method of joining one side or "stringer"

of slide fastener 220, here represented by a single one of its series of locking segments or "scoops" 220A, outboard of the sealed boundary of inflatable cell 70F. Cell 70F is formed of a pair of opposed coated sheets of fabric, the coated sides, respectively 227C and 228C, facing each other. Welded joint 232 seals cell 70F. All of the series of identical scoops of the slide fastener are conventionally attached to the "beaded" edge of a tape 234 that in this instance has been pre-coated adjacent its opposite edge with a thermoplastic material 235 compatible with the weldable coating used on the weldable sheets forming the hull. Coated tape 234 is introduced between the opposed seam-edge strips of sheets 227 and 228. When heat and pressure are applied between the strips, the thus-interfaced coatings weld themselves together at 239, 240 to bond this stringer of the slide fastener securely in place. The opposite stringer may be similarly welded to a second panel that is to be joined to the first by the slide fastener. Slide fasteners may, of course, be installed via conventional adhesives, if desired. FIG. 29's attachment scheme is generally applicable wherever a seam-edge strip projecting from a deck or hull can be sandwiched between opposed seam-edge strips projecting from another panel, provided that the thus-mated surfaces have been coated with compatible welding or adhesive bonding materials. Double-coated fabrics, of course, already possess the capability of being welded on both sides.

The most suitable access fasteners for the vessels of this invention are the strong, coarse-pitch, heavy-duty, rustless, slide fasteners, often known as zippers, when equipped with separate pull tabs on both the outer and inner surfaces of the slider. They are desirably very compact; but their chief value is the quick and easy convenience of operation they afford the occupant, once he is afloat. The engagement precision of slide fasteners also enables the designer to predict and perhaps even guarantee the level of stress imparted during specific exposure to measured sea conditions without having to make uncertain allowance for variations of major magnitude in the fastener-matching performance of occupants subjected to wide variations of type, degree, and duration of personal stress while closing up these vessels after opening them for any purpose.

However, hook and pile fasteners, as well as the "Hedlok" brand, are difficult and slow for the occupant to open and close, especially when the water is rough, since he must reach over his head with both hands to pull the two sides together under tension before he can engage them in the shear mode in which they are strongest. If he cannot properly align them, and the agressive hook-and-pile tapes seem to conspire with the waves to defeat alignment by the waterborne occupant, these fasteners will not develop their full strength, especially if the occupant's awkward handiwork creates humps, or "inchworms", in which the tapes are not in contact with each other. By contrast, "Hedlok" fasteners require application of squeeze pressure for closure, also a difficult inch-by-inch operation when it has to be performed overhead in this situation, especially in the dark. If either of these fasteners is positioned by the designer to be utilized in the peel mode in which it depends inwardly from the deck to give the occupant an opportunity to apply squeeze closure and exert better control over alignment, it will lose much of its strength. This discussion is not meant to suggest that such fasteners do not actually qualify as structural when used where they are advantageous.

Referring now to FIG. 30, there is shown a one-piece deck means 250, complete with its own pair of slide fasteners 251, 252 and adapted, with appropriate dimensioning, to be joined by bonding along its peripheral margin to any of the hulls disclosed herein. When deck means 250 is used, upward extensions 61, 62, etc., of vessels 60, 60A, etc., would be omitted from the basic hull pattern and all openings in the corresponding upper cell 70 would be sealed off, the $CO_2$ content of the inflation cartridge for cell 70, etc., being adjusted downwardly, as appropriate. While it is not difficult to install bypasses for inflation gas or air to be ducted around the seam between the deck and the upper hull cell, a preference will generally exist for separate inflators. An oral or stored-gas inflator may be located anywhere that is convenient for the occupant, as on the undersurface of the deck beneath crossmarked point 253.

Especially where width limitations exist for the rolls of coated fabric used in manufacture, deck means 250 will often be preferred over deck means 210. This is particularly true if the service for which the vessel is desired does not require that the deck be inflatable for protection from hypothermia over long periods, in which case, of course, neither inflation outline 254 nor the discontinuous welds typified by 255 will appear. Moreover, since the single sheet will not be shrunk dimensionally by an inflation process, an optimized stretch fit with the inflated hull will be obtained with a reduction of fabric area.

Figure 32:
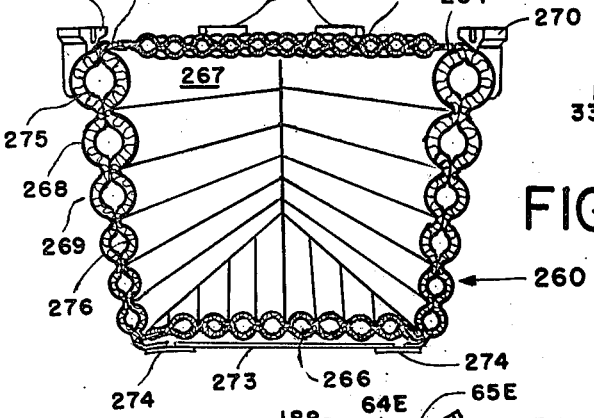
FIG. 32 is a transverse cross-sectional view of closed dry-entry vessel 260.
Figure 31:
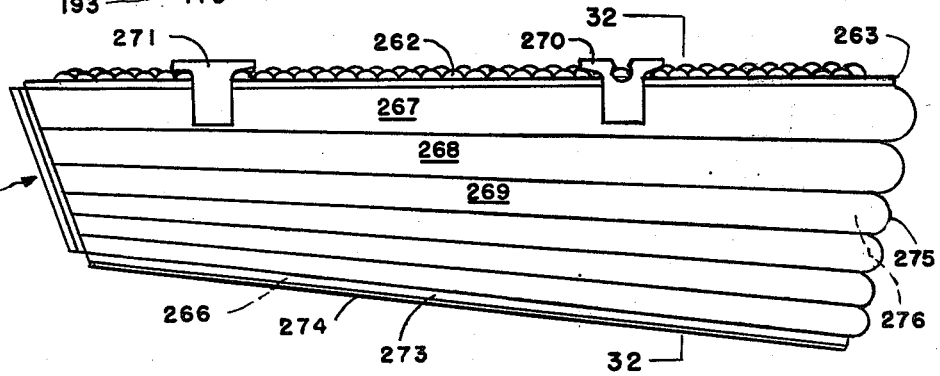
FIG. 31 is an inflated elevation of closed dry-entry vessel 260 of this invention, having a second structural deck below the access deck.

Referring now to FIGS. 31 and 32, there is shown vessel 260, differing from those preceding primarily in its greater length and breadth of beam (by about a third to a half) in order to permit side-by-side seating of a pair of occupants and the structural insertion of a second deck 266 at the bottom to prevent the occupants from being wedged together by the v-bottom characteristic of those vessels shown heretofore. Lower deck 266 provides room for organized stowage of camping equipment used by backpackers, as previously mentioned in connection with vessel 160E. Such stowage may be, selectively, along the bottom or sides via belts, hook and pile fasteners, etc; and may be supported by hull inserts between segments or between the joints of deck 266 and the sides of the hull, in the manner of inserts such as 175 or fasteners applied to hereinbefore-presented vessels. Like vessels 160 and 160E, as well as other vessels of this invention, vessel 260 provides an insulated and sheltered sleeping facility on land or water that is unexcelled for use by outdoor adventurers. Upper deck means 262 of FIGS. 31 and 32 is a dimensionally adjusted version of deck means 250 of FIG. 30, except that fastener 264, secured to upper seam-edge strip 263, is separable and extends completely around deck 262, permitting deck detachment. All such detachable decks, including afterdecks like 78E of vessel 160E when dimensionally adjusted to fit any specific vessel of this invention, can be replaced to enable sleeping in mild weather afloat or on land with a screen bounded by a matching fastener half as a direct but non-structural and non-waterproof substitute for the deck, thus retaining the decked vessel's vermin-proof character and continuously providing safe, screened ventilation over prolonged periods.

Like most vessels of this invention, vessel 260 can be easily boarded from the water if the peripheral fastener 264 for upper deck means 262 is at least partly opened. But, again like the other vessels herein, it is intended primarily for dry-water-entry service. Ordinarily, the two top segments 267, 268 will together constitute the top hull cell; but other arrangements may be provided. As with other vessels of this invention, for long-term service and rugged use, as in "shooting" rapids, the hull of vessel 260, as well as lower deck 266, can be made with extra plies of fabric, which may be of woven or unwoven fabric or of scrim, and may have substantial layers of elastomer between the piles in place of the minimal thickness of coating on lightweight fabrics that has generally been preferred in the past for compact stowage of emergency equipment not intended for frequent use.

The bottom of vessel 260 is shown optionally reenforced against sand and rock abrasion by the readily patchable underskin 273, preferably also attached directly to the hull, one method of attachment being shown in FIG. 32. When wear of this optional underskin 273 has become excessive through prolonged rough usage, leakage of water therethrough can be detected when the vessel is lifted out of water by the sound of its flow between underskin 273 and deck 266, signalling the need for patching before the insulative integrity of deck 266 becomes violated. Numeral 274 identifies the tapes that are lap-bonded in place to attach underskin 273 to the hull outer sheet 275. Lower deck 266 in this case is shown bonded to hull inner sheet 276 between its paired marginal strip means. Other joining arrangements may be substituted. The substantial constructions that are optional enable vessel 260 to be used routinely in locations remote from mother-type work boats for observation, ferrying and monitoring of transducers at remote points, etc. Another example of rough usage would be service as a beach-rescue boat that can easily be carried to lifeguard stations in the morning and be folded, for facile return to remote, theft-proof storage facilities after the day's swimming is concluded. As a lightweight stream or lakeside boat that may be hand-carried for return under roof each evening to prevent theft, it can bring low-cost boating vacations to many persons who could not otherwise afford them.

Like vessels 20, 60, etc., vessel 260 enables self-righting dry entry when deck 262 and the upper hull segments are inflated after entry by the occupant, and the deck is then closed via access fastener 264 before jumping or sliding into the water from a boat, pier, etc.

Vessel 260's 2-passenger capacity is designed to permit experienced persons to jump for safety from distressed yachts and boats while holding novices or children or carrying them so that their fears may be qualmed and they will not be left alone in a smaller vessel without guidance in a situation for which they may be thoroughly unprepared. It will also serve as a dinghy for ferrying groups in relays between shore and mooring.

Vessel 260 is not primarily intended for departure from a high ship's deck or from the deck of an oil rig; but it will also serve in the same manner as do other vessels of this invention if it is equipped in a comparable manner with an appropriate PLD and associated equipment as presented hereinbefore for vessel 60B. The larger occupant will use the buttock straps and embrace the smaller one during descent, with the standing line between them for optimum balance.

In addition, vessel 260 has a dry-entry mode comparable with that of larger boats that are normally tied to piers. This mode has been made possible by insertion of the aforesaid lower deck 266 between the hull walls, giving this vessel the wide, flat "footprint" needed for boarding from pierside via handholds like the cleats 271 and/or combination cleat-oarlocks 270 that enable mooring. These securing devices, preferably elastomeric, are bonded to the outer surface of the uppermost segment, outboard and clear of the fastener for deck 262. With the vessel inflated and fastener 264 opened $\frac{3}{4}$ of the way around the deck, which is pushed aside, the first person coming aboard moored vessel 260 will place one foot centrally or slightly beyond and crouch or sit while lending a hand to the second occupant, who will sit on the moored side and cast off.

Owing to vessel 260's very small size, boarding will require more care than is needed for coming aboard larger boats and yachts with long waterlines, broad beams, and massive hulls that may outweigh these vessels by ratios in the thousands. Decks 262 and 266 are shown to be designed for inflation; but, when vessel 260 is intended for service not requiring prolonged protection from hypothermia, they may be made from single sheets that will be otherwise similar but smaller in area because they will not be susceptible to the area shrinkage resulting from inflation. The segments of the inflatable lower decks are desirably smaller than those in the hull in order to minimize the inflated thickness and maximize roll and pitch stability.

Like the other vessels herein, vessel 260, when occupied, remains highly stable in chop, a characteristic that can even be improved, with sacrifice to hypothermia protection, by deflation of deck 266 and still further improved in warm areas if deck 266 and/or the clearance between it and the optional underskin 273 are filled to somewhat less than full capacity with water. For a variety of sporting uses, top segment 267, and even segments 268 and 269 when they are separately sealed to constitute individual cells, may be left deflated. Such practice, however, will degrade or negate the dry entry and self-righting behavior. So can a reduction in the height of the hull.

Referring now to FIG. 33, there is shown an integrated deck 280 for use with a modified version 260G of vessel 260, which also entails incorporation at the bow end of leg encasement 161E, seen with vessel 160E. Though larger, to fit the more commodious interiors of the 260 series, deck 280 is similar in general construction to deck 210 of FIG. 28 and is designed to enable use of double-decked hulls to make dry water entry while afoot and thereafter make quick transition to the flotation mode.

In FIG. 33, as in the preceding FIG. 28, the fragmentary portion of the hull for vessel 260G is presented in the flat so that the junctural and pneumatic relationship between hull and integral deck means 280 will be clearly apparent. As in FIG. 28, deck means 280 extends full length and is comprised of upward extensions 61G and 62G, containing passageways 212G, 213G that admit inflation gas/air to the bow end of the deck from the hull below. Unlike deck means 210, however, inflation of the aft portion of deck means 280 is separately initiated, (since afterdeck inflation is not desired for the bipedal mode of water entry) via oral inflators dangling below cross-marked points 287, 288. Because the flat layout does not reflect any curvature or bend at the juncture of hull 260G and deck 280, cleat 271 lies across the edge of deck 280, somewhat incongrously, the shortened distance between cleat and the bow edge reflecting the fact that the forward rake of the bow, previously seen for vessel 260 in FIG. 31, has been cut away to simplify the tailoring of leg encasement 161E to fit vessel 260G's derivative design.

Vessel 260G enables a pair of campers or backpackers to explore island groups and venture across lake country without confinement to a single watershed, where roads and habitats are usually strung out closely parallel to the watercourse. One of the adventurers will often make the first dry entry using the leg-encasement 161E and quickly return to a step-off point convenient to the other. With its broad bottom and shallow draft, vessel 260G is especially suited for fishing and hunting in a relaxed attitude in swamp country without wetting the feet, and if desired, with a minimum of sunburn under the partly opened deck 280.

As in vessel 160D, the upper segments of the hull of vessel 260G, combined with all segments at the bow end, constitute the principal inflation cell 70G, which in this case should be inflated by the time the water reaches the knees or just above them, after which the occupant lies back and floats, using the fins attached to leg encasement assembly 161E to maneuver vessel 260G toward the step-off point for the second occupant, meanwhile inflating lower aft cell 81G to prepare for the balance change. Both persons attend to positioning (or tieing up if necessary) vessel 260G before the second occupant comes aboard, as with vessel 260, casts the mooring line free, and inflates deck 266G. The first occupant may continue to propel vessel 260G via kick fins attached to leg encasement 161G, while the other uses a paddle or oar; or he may move aft, draw the leg encasement back to the bow and line-secure it either to a bottom insert 175 or to a cleat. Duties can be apportioned as desired for transit to a deep-water fishing point or to a distant shore, either for temporary mooring or for lift-out and departure to another destination.

Because the primary mode for dry-water entry of vessel 260G is wading, rather than stepping thereinto while it is moored, and because the occupant who has performed the wading will be in full control and can optionally sustain its position either with kick fins 183 or by paddling, the need for cleats 271 or cleat-oarlocks 270 will diminish in the eyes of some purchasers; so these latter may optionally be reduced in number or eliminated. Besides the split-up of inflation cells in deck means 280, still another departure from vessel 260 is seen in the change from the single circumferential and separable fastener 264 to a pair of left and right fasteners 220G, 221G, comparable to those previously shown in FIG. 28, of which deck means 280 is itself a derivative.

Unlike vessel 160E, for individual wading and fishing transit through trout and bass waters, as well as individual flotation fishing wherever opportunity offers, the 2-passenger-capacity vessel 260G, permissibly commodious enough also for camping and back-packing gear and sufficiently heavy to withstand perennial ventures, would have little appeal as an aid to an all-day trout-stream venture. However, when made of light-weight fabric and scaled down to one-person size, its shallower draft would be superior for swamp fishing in the flotation mode.

The predominance in FIG. 33 of identifying numerals bearing the suffix "G" is primarily an indicator of dimensional changes for adaptation of a previously described component to the differently shaped and proportioned vessel 260G, itself derived from vessel 260. Applicant would have provided additional views of vessel 260G had he not been concerned that the Office might consider such additional views redundant under these circumstances, particularly in an application of this length. He will be happy to furnish any additional views the Office may require.

Figure 34:
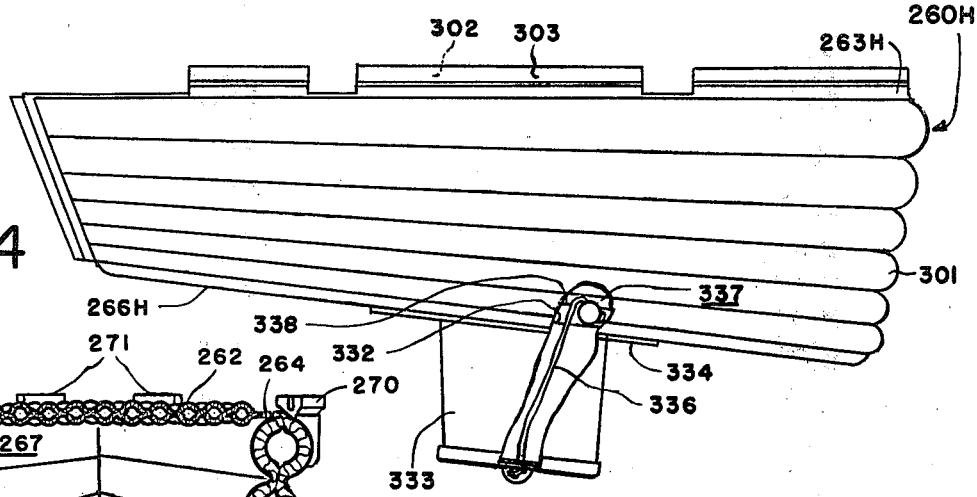
FIG. 34 is a partly cutaway side elevation of the inflated hull portion of dry-entry vessel 260H, a derivative of vessel 260.

Referring now to FIGS. 34–37, the hull 301 of vessel 260H in FIG. 34 is like that of the hull of vessel 260, with certain peripheral modifications. The pair of interrupted seam-edge strips 263H, projecting along the upper edges of the inner and outer fabric sheets of hull 301, are extended in width, as per the cross section of FIG. 35, enlarged to approximately full size, the access fastener having been eliminated. Attached along the outer edges of strips 263H are hook 302 and pile 303 tape fastener strips which enclasp the load diffuser tube 306 that appears in the superstructure assembly 307 in plan, FIG. 37, and in elevation in FIG. 36. In FIG. 37, the tape fastener strips are already in place along the left side. Superstructure 307, and particularly tube 306, provides an additional handhold all along its length for boarding and departing from vessel 260H, as does the mast when in use. This superstructure assembly 307, as shown, provides a means for accepting and "footing out" the loads and moments imposed by either a small sail, whose mast will rest in pocket 308, or a small outboard motor to be suspended on the vertical plate 315 of transom 310. An anchor, if needed, can be secured above or below mast support plate 317 by bungee, or its tines may be passed thru appropriate holes 319 drilled therethrough or in transom 310. Transom 310, shown bolted to load diffuser 306 by screws or bolts 311, etc., supports steering arm 312, which steers vessel 260H via pin-attached 313 rudder 314, except when an outboard motor of a pivot-steering type is mounted on the vertical plate 315 of transom 310. To protect the hull from bow impacts of water-borne debris and from flow-induced initiation of resonances at the bow that would not only reduce speed but might also induce fabric fatigue and possibly cause mushy steering, a foam-lined v-guard plate 316 is welded to the underside of mast-support plate 317, which carries mast pocket 308 and is itself secured to load diffuser 306 by bolts 320, etc. Superstructure 307 would preferably be entirely welded, if of metal, or chemically bonded or welded if of reenforced plastic. Bolts, however, were shown to emphasize the knock-down capability achievable for transport afoot or stowage on or about small vehicles. Of course, those who have station wagons or who can attach vessels 260H to bicycle racks or roof rails on their automobiles will prefer not to perform disassembly and will choose the one-piece version of superstructure assembly 307.

Superstructure 307 is designed to combine in one embodiment the features that not only enable retaining mooring and rowing capabilities of basic vessel 260 via cleat-oarlocks 309, 309 and cleat 305, but also adapt the same basic hull for both sail and motor propulsion. For propulsion by a small, tank-equipped outboard motor, which does not impose the severe moments that are a consequence of use of a high mast and sail, the load-diffuser tube needs to be only long enough to extend from transom 310 slightly forwardly of the cleat-oarlocks 309, which are fastened to it; and the steering arm 312-rudder 314 assembly can be eliminated. The mast-support plate 317 and all centerboard-associated gear would not be needed, cleat 305 being replaced by a cleat 271 bonded to the hull, as in vessel 260. Elimination of the centerboard sheath 333 would restore bottom deck 266H to the original configuration of deck 266 in mini-boat 260. The forward portions of the hook 302 and pile 303 tapes surmounting the lengths of seam-edge strip 263H would be cut away.

Without the additional weight or the bulk of the superstructure that the sailing version would require, vessel 260H would thus be considerably lightened for more efficient propulsion by motor, oars, or paddles. Applicant will furnish any further drawing(s) that may be required by the Office to establish these facts. However, if a motor having horsepower level capable of bringing the speed of vessel 260H up to its limit of safety is employed, it would be desirable to restore the load-diffuser tube 306 to its full length and to attach a v-guard plate like 316 thereto. For a version of vessel 260H that would be intended for sail but not for use of any outboard motor, the most substantial change would be elimination of the vertical plate at the aft end of transom 310.

Since deck 266 H, like deck 266 of vessel 260, is preferably inflatable, with segments aligned longitudinally like those of the hull for maintaining optimum headway, vessel 260H already offers some resistance to lateral skidding. But for optimum performance of so short a vessel when sailing on a close reach or beat, a centerboard (or sideboard) is required. Depending from the bottom of mast packet 308 is an integral projection 325, transversely drilled and capable of receiving a ball-detent pin 326. A centerboard adapter 328 has an arm 327 welded thereto for receiving the centerboard 329, which is tapered down to edges that can be guided with facility through the slot in arm 327 and into the centerboard sheath 333, made of a quality of material similar to that of deck 266H and of sufficient width and depth to clear centerboard 329 without friction and without having to accept its weight. Sheath 333 is flanged 332 all around at the top for bonding to a matching opening in deck 266H and will preferably have a reenforcing piece 334 beneath flange 332 and shaped like flange 332 except that it is slightly larger in area and has a slot therein, whereby the reenforcing piece 334 will be similarly bonded to the underside of deck 266H around sheath 333. The sheath inverter is a cord 336 bonded in a strong, waterproof manner to the bottom of the sheath and terminating in a handhold ball 337, by which sheath 333 may optionally be inverted and drawn within vessel 266H, the ball 337 resting on sheath flange 332 between adjacent inflated segments of deck 266H, such as 338.

The structure of vessel 260H is particularly adapted for alternative use of one or two side- or wing-boards 340 in place of centerboard 329 and its well 339. These are shaped somewhat like the "dagger board", one of the favorite alternatives to centerboards. In FIG. 36, in order to avoid obscuring the view of centerboard-associated components, the left wing-board 340 is shown raised to an aft-directed stowage level, though the actual attitude in which it would be stowed in the tapered hull of vessel 260H would be forwardly. When it is stowed forwardly, of course, clamping screw 345 would be brought to a handy attitude above pivot 346 that projects from saddle block 344 for facile clamping of wingboard 340 in either the active (down) or the forwardly stowed position. Cleat 349 will be useful in rigging sail as well as in mooring and docking. This arrangement provides greater internal stowage space for gear and, of course, much greater room for crew movement when maneuvering vessel 260H.

Generally speaking, vessel 260H, when exposed to the high forces and moments imposed in sailing service, may require fabrication of hull 301 and lower deck 266H of the toughest and heaviest range of skin thickness applicable to small vessels, perhaps up to 0.020" (½ mm) or more. Normally in such cases, pressures well above the oral maximum of about 1 psi (0.07 kg/cm$^2$) would be applied for inflation. The same will be true if heavier engines are mounted to achieve high speeds.

Referring to FIGS. 38–52, death by anoxia of an aviator whose oxygen supply has failed during high-altitude flight is often so rapid that he fails to utter even a word into the microphone in his oxygen mask before becoming unconscious. Yet the accumulation in his breathing atmosphere of carbon dioxide ($CO_2$), often blamed for "suffocation", may not even be noticed by the individual contained in a sealed compartment until the percentage in air reaches 1½ to 2%. At 1½%, the start of hyperventilation or deep breathing, up to double the depth of regular breathing, becomes likely, followed less rapidly by increasing respiratory rates as the concentration of $CO_2$ and the concomitant depletion of oxygen become further developed, severe headaches being experienced at still higher levels as the exposure is prolonged. If exposure remains unabated, narcosis or unconsciousness followed by death can ensue.

The respiratory changes have been termed "adaptive" biochemical changes in that the body uses them to rid itself of the unwelcome storage of excess $CO_2$ in its tissues. These changes also inspire the sufferer to try to make an escape from the chamber of discomfort that has been punishing him with tissue supersaturation by a waste product incidental to the process of living. When these adaptive changes occur in an individual inhabiting an enclosed re-breathing chamber, they signal the accompanying and much more serious depletion of the oxygen supply and the need for exchange with the outside atmosphere.

Although the vessels of this invention are not hermetically sealed and will interchange contained air with the atmosphere, principally via the closed access fasteners, the low rate of such interchange, particularly in still weather, is less than adequate. Supplementary ventilation becomes necessary, especially during long exposures. The occupant will sense a "stuffiness" within the vessel and will generally prefer to open the access fastener temporarily at least part way to let in outside air.

While authorities engaged in comparable atmospheric research, as in space and submarine work, appear to believe that most occupants will make use of these slide fasteners, they caution that persons who are hyperventilating from other causes sometimes enter a doctor's office unaware that they are exhibiting this symptom. There remains, therefore, concern that some persons who have been injured prior to escape or who are beset with panic, severe hypothermia, or seasickness, particularly if they have not been warned regarding the atmospheric problem, may fail to respond properly to degradation of the contained atmosphere. Even though these persons would generally survive only very briefly in a cold ocean if unprotected by a vessel of this invention, manufacturers of these vessels will be well advised to utilize means such as those disclosed hereinafter for further augmentation of occupant survivability time. It would be unfortunate, however, if such heroic measures toward assuring against even small changes in atmospheric content were authoritatively insisted upon that design utility would be penalized to the point that protection against drowning and hypothermia for all escapees had to be sacrificed to regulatory over-enthusiasm.

Current submarine and space vehicle research has progressed far beyond the point reached a generation ago in boosting crew tolerance to high concentrations of $CO_2$ in the breathing atmosphere, particularly under system-failure emergencies resulting from power loss. It is not a purpose of this document to discuss the measures being taken beyond suggesting that some of them may have applicability to the vessels of this invention.

As will be seen, manufacturers of the vessels will have a wide choice among simple design approaches for enchancing the inherent capabilities of the vessels themselves for vastly improved emergency survivability beyond anything that has ever before been available to persons individually exposed to water-borne emergency. Just as the primary purpose of the patented miniboat was the enhancement of survivability over the prior art at the time, so the far greater measure of protection from the twin threats of hypothermia and drowning, hereinbefore demonstrated as achievable, must not be threatened by neglect of refinements that will afford coincident protections against other hazards.

It might appear that oxygen supplies and carbon-dioxide scrubbers ought to have been included in the vessels, until one investigates the weight and bulk demanded by 8 to 24-hour, or longer, regulated supplies of these consumables and the new hazards associated with their ready stowage and use within the vessels, especially by persons who might feel overcome by need for a cigaret, or even to strike a match if a flashlight battery fails. The inventor would have been glad to show how their incorporation could have been made advantageous had he first been able to convince himself.

A rising wave, as observed in the patented miniboat, tends to push one hull wall inwardly and raise the miniboat as its crest passes under the keel. Then, as it departs, the miniboat is lowered and the opposite hull wall is sucked outwardly. The vessels of this invention resist the pronounced deformation of the cantilevered walls of the miniboat, which, especially during storms, would result in the shipment of water aboard, because the vessels are structurally reenforced by the deck that both receives and transmits force. Nevertheless these soft-hulled vessels do respond to waves by breathing outwardly and inwardly via their fasteners with each wave-induced volumetric change. Just as the vessels utilize the fully enclosed occupant's pendulous weight to gain their extraordinary upward stability, so they apply the inertia of his body mass to the new task of pumping, in which the structural deck coacts with the hull as part of a single deformable container. The resilient hull develops deformation in the process of transporting its occupant's body through the wave; and this deformation is recovered as the wave passes. The reactive forces derive from the occupant's own inertia, first resisting both the lateral thrust and the elevation thrust that accompanies it; and again responding with a phase delay as the wave passes, thus producing both a low-level internal air-pressure buildup and a reversal with each wave cycle. An empty closed vessel, weighing perhaps 5 pounds, will simply lie on the top of the water while developing little or no internal pressure change.

As indicated hereinbefore, the closed vessel exercises great buoyancy, enough to force its way upward rapidly through water. However, the buoyancy's real value inheres not in such spectacular performance capability, but on the ability of the vessel to ride stably along the slope to top the crests of most wave fronts, without immersion of either the occupant or itself on either the upslope or the downcoming.

The escapee will normally be extremely inquisitive about the prospect for rescue from such intimacy with an ocean; and he can be expected to thrust his head into the turret for frequent looks at his surroundings for rescue. Unless the water is extremely severe, he will also open the fastener sufficiently to project his head for a less obstructed view, thus ventilating the vessel. Should he note discomfort from the "stuffiness" which his breathing imparts to the small enclosure, he will reflexively (instinctively) open the fastener when he can. To make certain of the need for periodically ventilating the vessel via the access fastener in the event that he has received no prior survival instructions and that he does not attribute incipient hypoxia and hypercapnia to seasickness, chill, or other malady, instructions should be printed in bold contrasting color on the interior of the vessel, where he can easily and repeatedly read them via flashlight 156.

Those who have escaped a greater hazard aboard a distressed boat or ship will generally thereby have acquired a stronger will to live and are well known to take extraordinary measures. If the vessel is exposed to storm conditions severe enough to cast overspray periodically upon the deck, they may even time their use of the access fastener between such events, since higher waves are characterized by longer intervals.

The vessels of this invention are intended to make escape to water and survival thereafter safer for individuals than it has ever been before. To make certain that escape-vessel manufacturers will benefit from all the technology that applicant can presently offer, whereby they may thoroughly test and compare their options in full consideration of life-support value, packaged or stored weight and bulk, and even cost, additional ventilation options are offered in FIGS. 38 through 50.

Referring now to FIG. 38, there is seen an air/gas exchange ventilator 360, suitable for use with a decked vessel of this invention. Numeral 361 indicates the outer, or perhaps only, layer of deck fabric, having a venting opening 362 therethrough. A cylinder 365 of fine screening material, formed of olefin, nylon, metal, or other suitable material, possessing inherent or applied hydrophobic surface character, is adhesed 366 around the periphery of opening 362, via its flange 367. A canopy 368 of water-resistant fabric is formed from a single sheet via the use of pleated darts 370 along its skirt 377, which may be sewn or adhesed; or it may simply be formed thermally via ironed-in pleats that impart a permanent set to the fabric. Canopy 368 is adhesed 371 to the flanged top 372 of cylinder 365.

Lower flange 367 has an upwardly turned lip 375 which bears a suitable coating 379, such as the adhesive material at 366, for retaining any droplets that have managed to penetrate the screen until they leak back from its annular gutter 363 through the base of the screen and drain away from the site along the upper surface of sheet 361.

The length of skirt 377, which is easily deflected against the surface of screen 365 by gusts or spray, is sufficient to bar the entry of significant amounts of water, when a wave overspill impinges upon it, against flooding into the vessel from any direction, the adhesive-lined gutter 363 serving as a secondary barrier. Moreover, the skirt 377 clearance above deck sheet 361 enables contaminated air to be diffused and carried away by the slightest motion of the vessel, even when there is no breeze.

Referring now to FIGS. 39 and 40, there is shown a normally closed outlet check valve 390, responsive to only slight surges in internal vessel air pressure. When such surges are induced, as by the leading edge of a wave which presses on one side of the hull and raises the vessel slightly, light-weight plate 391 is raised off seat 392 and vents internal air that is partly depleted of oxygen and contains carbon dioxide ($CO_2$) in volumetric amount approximately equal to the oxygen depletion. The spent air passes horizontally outwardly via equally spaced vents 393. Plate 391 is stopped at maximum travel by retainer 394, which is spot-welded across the top of valve body 398 as a precipitation barrier. The lower flange of check valve 390 is adhesed to deck fabric 396.

Since vents 393 are raised above the deck, the cylindrical portion 397 therebelow serves as a dike or deflector of moderate wave overspill passing over the deck 396. Valve body 398 may be made taller, with vents 393 correspondingly raised for increasing vessel resistance to occasional droplet infiltration. However, the higher body 398 is raised, the less air it will vent per cycle. Since it is desired that plate 391 be sufficiently sensitive to respond to the slightest pressure surge, it is made of lightweight material in a thin gauge; and no spring is used to augment gravity in holding it down on seat 392. This type of design becomes permissible because of the low cyclic rate of wave transit.

Referring now to FIGS. 41 and 42, there is shown another form of fast-opening check valve 400, having a rectangular valve plate 401 that is gravity unbalanced by cantilevered counterweight 402, which tends to position it in the upwardly closed position indicated by dashed outline 403. As the leading edge of the wave, referred to in connection with check valve 390, passes from under the vessel and crosses the keel, a slight air-pressure depression commences within the vessel, whereupon the external barometric pressure overcomes counterweight 402 and thrusts plate 401 downwardly to the position shown for admitting an increment of pure air during wave departure.

Screen 405, of fine mesh like that shown in the previous examples, tends to shed water droplets because of the surface tension thereof, such shedding being fostered by both the domed contour of screen 405 and a hydrophobic finish, which optionally may be imparted by an olefin (also a candidate material for screen 393 itself) or by a fluorinated hydrocarbon such as "Teflon". Fabric dike 407, adhesively sandwiched 408, 409 between screen 405 and deck sheet 410, is configured to ward off wave overspill and is pierced with small holes 412 to facilitate drainage of intruding droplets. In general, check valves 390 and 400 are intended to be used in pairs, with fore and aft separation generally of a third of the vessel's length and a preference for locating valve 400 near the head of the occupant.

Figure 45:
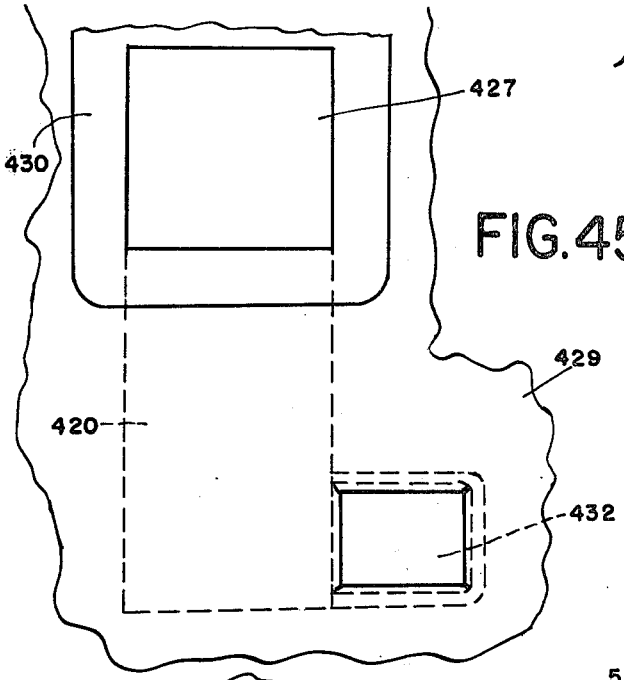
FIG. 45 is an above-deck plan of the installation of FIGS. 42 and 43.

Referring now to FIGS. 43–45, there is shown a balanced, double, check valve 420, having a lightweight, fast-acting, two-way, "butterfly" blade 421 and capable of performing all of the functions of both prior check valves 390 and 400. When pressure 424 within the vessel exceeds the external barometric pressure 425, the spent air at forward orifice 426 rushes upwardly, reversing the tilt of blade 421, and thence forwardly and outwardly of valve 420 and valve-body extension 428. It departs via fabric guide 427, bonded around valve body extension 428, thence upwardly of deck 429, to which the flange 430 of fabric guide 427 is overlapped and welded or adhesed.

Whenever the pressure 424 within the vessel falls below barometric pressure 425, the outside air is routed downwardly via inlet guideway 432 and aft orifice 433 into the aft chamber 434 of valve 420, thrusting blade 421 upwardly as shown to clear its path through chamber 434 toward the aft interior of the vessel.

Deck sheet 429 is shown in FIGS. 44 and 45 to have been cut at the corners above the mouth of inlet guideway 432, the tab ends thus freed having been adhesed downwardly within the mouth of guideway 432 to seal both deck 429 and the inlet guideway against air leakage and providing additional support to the overall valve assembly. The upper surface of valve 420 is, of course, also adhesed to the undersurface of deck sheet 429. The figures reveal inlet guideway 432 to be a rectangular, cup-shaped molding, step-formed to abut against the side and bottom of the body of valve 420. It will have been welded, adhesed, solvent bonded, or otherwise joined to valve 420.

Curtain 435, of appropriate width and depth, is provided to prevent the development of a short-circuiting airflow pattern from the aft end of valve 420 to the forward end, in view of their proximity. The fact that only one of the ends is operative at any given instant is the major inhibitor of any such flow. When valve 420 is, most appropriately, located under the afterdeck in front of the occupant, so that he faces the aft-directed discharge of fresh air from chamber 434, the curtain may carry full instructions regarding optimum long-term survivability. These can be memorized for practice with the aid of flashlight 156 previously seen in FIG. 13 in connection with miniboat 60B. Such instructions can, of course, be placed elsewhere as convenient.

To avoid redundancy and obscuration of the drawings, particularly FIG. 45, details of screens, dikes, shields or other measures for inhibiting water entry through a inlet guideway 432 and outlet guide 427 in deck 429 have been omitted, since these matters have already been comprehensively covered in connection with ventilator 260 and valves 290 and 400, and in the showing the use of interior separator curtain 435 in connection with valve 420. External curtains will have far less significance; but the two openings should not be housed within a single unpartitioned screen.

Figure 46:
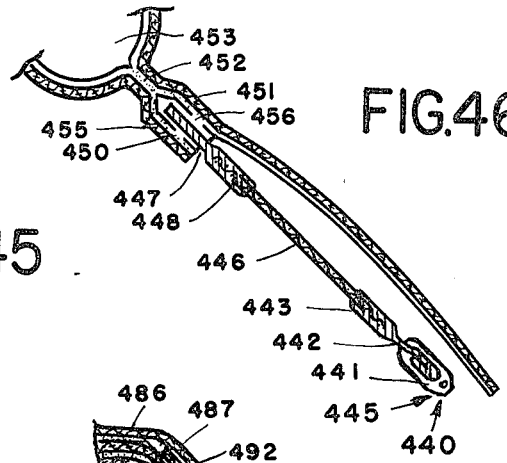
FIG. 46 is a cross section of a vessel-installed construction combining a ventilating screen with slide fastener.

Referring now specifically to FIG. 46, the cross section depicts a venting screen installation combined with a slide-fastener joining two adjacent panels, such as a deck and a hull panel. Slide fastener 440 is represented in cross section in a manner similar to that previously seen in FIG. 29, by a single one of its interlocking scoops 441, which is conventionally assembled with the other scoops in the series to the beaded edge of tape 442 to form a stringer 445. The opposite edge of tape 442 is bifurcated and heavily precoated within the bifurcation with a heat-hardenable coating such as an epoxy cement.

One edge of screen 446, similar to the screens described hereinabove, except for the lack of non-compatible coatings or surface finishes along the edges thereof, is introduced between the cemented surfaces, which are then compressed upon it and heated, with permissible local distortion of the screen material.

A second tape 447 having one bifurcated edge 448, similarly coated in the recess with cement, is placed over the second edge of screen 446 and similarly compressed and heated to harden its grip on the screen. The plain edge of tape 447, coated with a material compatible with the weldable coatings of seam-edge strips 450, 451, which project beyond closing weld 452 of deck cell 453, is placed between seam-edge strips 450, 451, to which pressure and heat are simultaneously applied to create welds 455, 456. All four thermal bonding operations may be performed at once in a single cycle if properly fixtured and electroded in the welder.

The opposite stringer, not shown, which is designed to mate with stringer 445 to form a chain (an incomplete fastener lacking the slide and termini), is conventionally fabricated, except that it, too, will have the free edge of its tape coated for welding between the seam edge strips projecting from a second cell that terminates the gunwale of the hull. When fitted with a slide and termini, the chain becomes a slide fastener 440 for attaching the deck to the hull panel.

Seam edge strip 451 is cut much wider than seam-edge strip 450, in order that screen 446 will be protected from direct impact thereon of such waves as may have sufficient ferocity to break over the deck of the extremely buoyant vessel. It will be obvious that screen 446 could be cut in any other desired shape, such as square or circular, and inset permanently into a deck wherever desired, and that a bifurcated tape, such as 447, could be similarly fitted and sealed on both of its edges between such screen and an outlining cutout in an inflated deck that is edged with coacting seam-edge strip means.

Figure 47:
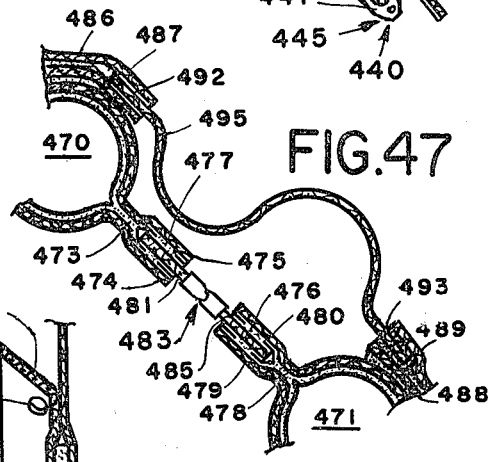
FIG. 47 is another arrangement for a ventilating screen and slide fastener.

Referring now to FIG. 47, there is seen a junction between the deck, represented by its edgewise inflated segment 470, and the hull, represented by gunwale segment 471 of a vessel of this invention. Outline weld 473 seals the deck edge, with coated marginal edge strip means 474 and 475 projecting therefrom. The drawing is necessarily out of scale in order that the very thin fabrics may be shown in detail.

Tape 481 of one stringer of access slide fastener 483 has been coated and bonded 477 between marginal edge strip means 474 and 475. The other stringer has its precoated tape 485 bonded 476 between seam-edge strip means 479, 480. Both longitudinal segments 470, 471, respectively, bear superimposed and bonded pairs of strip patches 486, 487 and 488, 489, each pair having a longitudinal gap between the patches. Ventilating screen 495, comparable to but wider than screen 446 of FIG. 46, is heat and pressure-bonded on opposite edges into the gaps 492, 493 provided between the patches of each pair. Instead of using individual inner and outer patches, single bifurcated tapes similar to 443 and 448 of FIG. 46 could have been used for assembly of ventilating screen 495.

When access slide fastener 483 is opened from inside by the occupant, the deck, which is under structural tension, springs away locally from the hull, stretching screen 495 across the interval thus created and providing a wide area for exchange of fresh air from outside with the $CO_2$-contaminated and $O_2$-depleted air created within by the occupant. As in FIG. 46, the strength of screen 495 enables continuous retention of the structual character of the joint between deck and hull; and its fine mesh and hydrophobic surface shed and drain water along its sloping surface and discourage liquid infiltration. When necessary, the occupant can still assist himself by excluding the fine spray of water impacts from punishing waves against the screen by count-timing of the seconds between such impacts and so operating the slide that spray penetration is baffled.

Presence of the screen above a portion of the fastener reduces its effective length for access; so it is desirable that the location of the screened area not only be convenient for operation but also that the remainder of the fastener be of sufficient length for admission of occupants, especially if the vessel is ever expected to be provided to persons already in the water. It is quite appropriate, of course, to provide the screened portion as either an extension of the access fastener or in a special location independently of the access fastener or even to locate it close to or on the observation turret.

Figure 48:
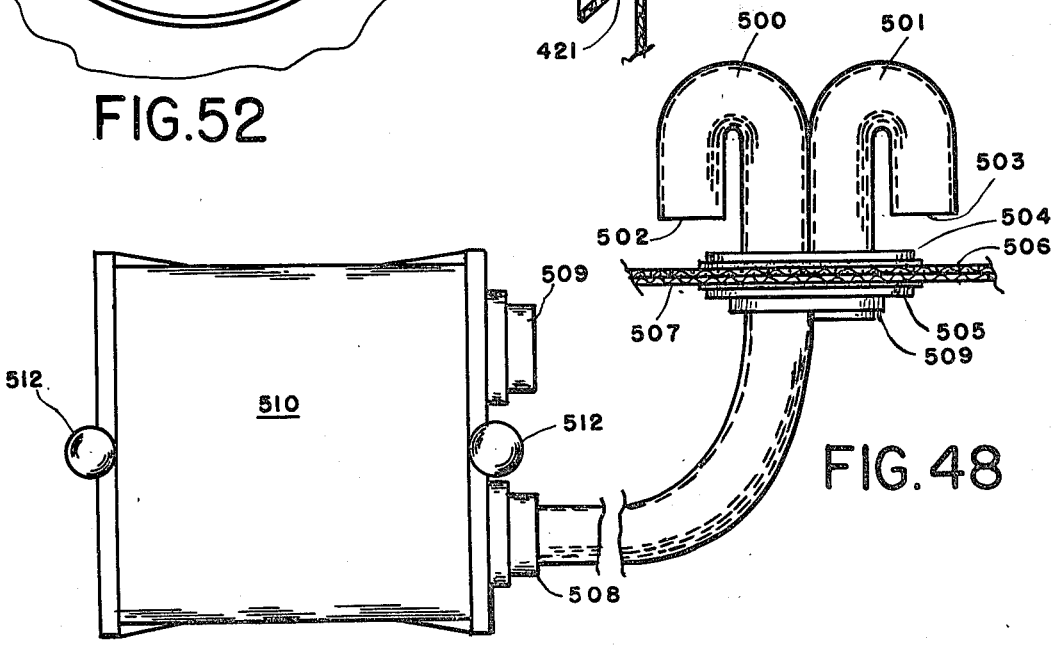
FIG. 48 is an elevation of a vessel-installed hand-powered ventilating system.

Referring now to FIG. 48, there is shown a self-help arrangement that, with a minimum of intermittent effort on the occupant's part, will keep him alive for as long as he chooses to help himself, even with the access fastener closed against severe wave action. It comprises a pair of soft plastic tubes 500, 501, originally extruded as a pair but partly heatreformed to invert tips 502, 503 as shown. It is optional as to whether screen filters should be installed across the openings at tips 502, 503; but applicant's design preference is to omit them for improved continuous air exchange during intervals when occupant may doze. One of the tubes 501 extends hardly more than through deck sheets 506, 507 and the cemented-on, flanged mounting bracket 504. Locking plate 505 slips over the bottom of bracket 504 and is adhesed to both the mounting bracket and the underside of sheet 507. Tubes 500, 501 are adhesed to the inner surfaces of bracket 504.

Tube 500 extends within the vessel to exhaust fitting 508, situated just beyond the internally contained exhaust check valve of conventionally tapered bellows 510, which is seen from the large end. Bellows 510 has a typical capacity of just over 2 liters and is superficially similar to a common design of bellows-type pumps used for inflating life rafts to pressures on the order of 5 psi gauge (about 250 mm Hg.) In this case, however, the maximum back pressure likely to be developed should hardly exceed 3 mm Hg, or about 1 oz/in$^2$; so its weight can be engineered down to a minor fraction of that of bellows intended for life raft inflation, the return spring being made of thin gauge wire for very easy operation and the check valves also being designed for low-pressure use. Only three or four full-amplitude cycles per minute via handles 512, seen endwise, will suffice to maintain desirable levels of O2 and $CO_2$ with the access fastener closed. Since the bellows as described will pump internal air out of the vessel, fresh air will enter via tube 501. However the system will work as well if the check valve connections 508, 509 are reversed. Other types of light-duty hand pumps of comparable capacity that will function well with low-gradient spring replacements may be substituted.

Referring now to FIGS. 49 and 50, there is shown an exhalation mouthpiece 520, adapted to fit over the inner end of tube 500 when the latter is pulled out of its snug fit in bellows 510. Mouthpiece 520, fitted over the end of tube 500, permits the occupant to exhale, with a minimum of effort, the spent air from his lungs directly outboard of the vessel. During normal inhalation through his nose from the interior of the vessel, either a slight retraction of the tongue or the thrust of its tip into or against lip 521 will block any return of exhaled air via tube 500. His breathing sets up a low rate of continuous inward flow of fresh air from the outside via tube 501 in the same manner that was achieved by pumping stale air through tube 500 via bellows 510. Very little practice is required to develop the technique, which, even if imperfect at first, is quickly mastered.

Like the other systems described in connection with FIGS. 38 through 52, mouthpiece 520 preserves the occupant's opportunity to breathe only the well-warmed interior air mixture with far less distress than he would experience if he were required continuously to inhale outside air at temperatures approaching 32° F. (0° C.). Lip 521, resilient and not hard, should be sufficiently large than it will not readily fall from the mouth when the occupant tires; and the biting portion 523, upon which the lips and teeth rest, should remain sufficiently springy to resist being flattened by relaxed jaws and tough enough so that it will not be inadverdently bitten through.

Figure 52:
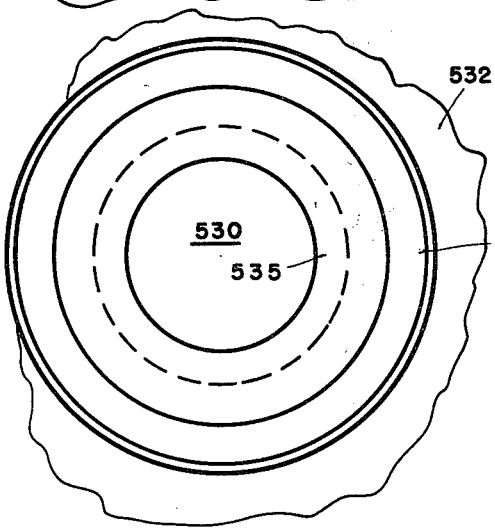
FIG. 52 is a plan view of the installation of FIG. 51.
Figure 51:
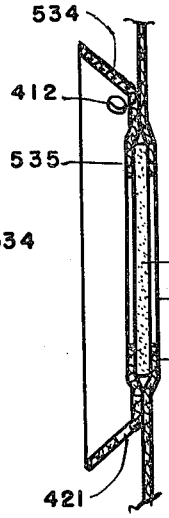
FIG. 51 is an elevation of a time-delay ventilator installation for a vessel of this invention.

Referring now to FIGS. 51 and 52, there is shown a low-cost, time-delay-opening device, whereby untaught persons compelled to use the self-righting vessels of this invention will be enabled to avoid subjection to excessive $CO_2$ levels for the duration of exposure on water therein. The time delay derives from the use of materials similar to those employed in so-called "soluble", "dissolving", or "disappearing" papers. Disc 530 may be pressed from very short fiber cellulose in water solutions of highly soluble materials, such as the sugars that are used in syrups, for example, and then dried; or it may be compacted from dry mixtures of the two or other appropriate materials. Disc 530 may be laminar, the upper, or outer, layer being somewhat spongy, so that it will attract and hold water, which eventually leaches into the lower layer, whereupon the disc crumbles and falls through the opening 531 in deck sheet 532, permitting continuous exchange of interior air with the atmosphere.

Disc 530 is held in place by open retainer 535, which may be of the same fabric used for vessel hulls and decks and may even be integral with the upper sheet of an inflated deck. Retainer 535 is bonded around its periphery to deck sheet 532. When the occupant leaps or is lowered into water, the time delay device, preferably located above his lower legs, is initiated by the dipping of the forward end of the vessel into the water, the time delay lasting well beyond the brief seconds of self righting. There is no need for immediate collapse of disc 530 thereafter; an interval exceeding half an hour or so still being sufficiently timely for $CO_2/O_2$ control initiation. Dike 534 differs from prior dike 407 principally in the fact that it is integral with retainer 535.

Obviously now, certain features of one embodiment may be combined variously with others and with segments of other arts; and they will stimulate imitation in configurations differing in unessential detail from representative showings he herein without departing from these teachings. My invention is not to be limited to specific forms described in the drawings and specification disclosed. All of the equivalent approaches to the structure, objects and functions inferable by one skilled in the applicable arts are intended to be covered by the claims.

Therefore, I claim:

1. A miniature vessel comprising:

a hull of waterproof material, said hull having a relatively deep stern, said stern having an arcuate form when said vessel is inflated and occupied in water;

a bottom tapering upwardly from an inverted apex at said stern to a shallow bow; a gunwale tapering outwardly on both sides of said hull from said bow toward and around said stern; and generally planar, precipitation-excluding, access-deck means, formed of material compatible for attachment to said first-mentioned material;

said deck means being structurally joined to and covering the full area defined within said gunwale, said deck means including access-fastener means adapted, when opened, to permit expeditious, whole-body entry of an occupant into said vessel and his eventual exit therefrom, and when closed by him to complete his whole-body enclosure within said vessel, said hull being formed of superimposed inner and outer sheets of generally similar shape and generally symmetrical about a transverse midline defining the cenerline of said stern, said sheets being welded together along a continuous seam outlining the inflatable area therewithin and leaving seam-edge strip means extending outwardly thereof, said strip means being generally of width adequate for structural bonding of at least one seam outwardly of said continuous seam, said sheets being further bonded together discontinuously inwardly of said seam to form inflatable segments, said segments being so proportioned that their inflated thicknesses and, consequently, the inflated thickness of said hull, will increase from said bow to said stern and from said bottom toward said gunwale, the left and right halves of said strip means projecting below and forwardly of said hull being sealably, structurally and medially bonded thereacross, permissibly via medial attachment thereto of at least one of a bottom deck and forward extension, said vessel including inflation means therefor, said hull being adapted for inflation in a vertical, stern-uppermost attitude in behalf of an occupant standing therewithin on said bow and facing said deck means, whereupon, with said access fastener closed, said occupant may jump, slide or be lowered into water or dry, self-righting water entry and insulated flotation thereafter, and whereby, with the buoyancy of the interior air retained by said deck means around and above the ballasting weight of said occupant now thrusting directly upwardly against said deck means in addition to the upwardly directed buoyancy so patterned among said so-proportioned segments, said vessel achieves extraordinary buoyancy and upright stability against steeply rising wave fronts and a high self-righting moment after a plunge into water, even at initially unfavorable attitudes.

2. A vessel as in claim 1, said deck means being inflatable at least in part.

3. A vessel as in claim 1, said deck means being generally inflatable.

4. A vessel as in claim 1, said deck means comprising a sheet portion of lobular configuration proportioned to become structurally loaded in tension by said hull when said vessel is inflated and occupied, whereby said gunwale is deflected slightly inwardly, said deck means being bonded peripherally to said seam-edge strip means extending upwardly from said gunwale.

5. A vessel as in claim 4 said sheet portion comprising outer and inner sheets outline-welded together within an outer margin to create new inflatable cell means and discontinuously welded together within said outline to limit both the inflated thickness of said cell means and the post-inflation area of said deck means, whereby said cell means enhances the insulative protection for said occupant, the inflated stiffness of said deck means, the buoyancy of said vessel, and the self-righting and rising responses of said vessel when occupied.

6. A vessel as in claim 1, said vessel including therewithin a personnel-lowering device (PLD), said PLD carrying body-attachment means adapted for securement to the person of said occupant, said vessel having a sternwise opening therethrough, said PLD having a suspension line passing from dispensing means therethrough and outwardly of said vessel via said opening, the upper terminus of said line being adapted for attachment to extraneous suspension structure, the reserve portion of said suspension line being of length sufficient to enable PLD control of descent speed for a specified vertical distance to water, said reserve portion being stored in dispenser means attached to one of said vessel and said PLD, whereby such occupant can be lowered at a safe speed for said distance within the protection of said vessel, and whereby he can accomplish dry self-righting water entry and flotation in said vessel.

7. A vessel as in claim 1, at least the distal portions of said strip means having been bonded together medially over area thereof adequate for constitution of a strong suspension base capable of resisting intense local forces arising from wedging action by a heavy occupant's shoes when standing suspended thereupon during bow-downward descent within said vessel.

8. A vessel as in claim 7, said vessel having structural reenforcing means bonded upon said distal portions.

9. A vessel as in claim 8, said reenforcing means having sufficient strength and rigidity in combination with said distal portions to serve as a platform base, whereby an occupant may stand thereupon with his shoes firmly supported side by side.

10. A vessel as in claim 7, said suspension base having a standing line structurally affixed thereto, said vessel having a small sternwise opening therethrough, said line being adapted for coupling of the upper end thereof to a line-payout means.

11. A vessel as in claim 1, said vessel having a small sternwise opening therethrough, said vessel having a load-spreading structural member positioned inboard of said opening, said member having a standing line structurally affixed thereto and passing through said opening, said member being dimensionally adequate for spreading the occupant-suspension load over a comparatively large area of said sheets, whereby the unit loading on the fabric of said sheets will be reduced to a minor fraction of the unit strength thereof, said line being adapted for coupling of the upper end thereof to a line-payout means.

12. A vessel as in claim 11, said structural member having a smooth finish, whereby, when said vessel is occupied and inflated and said fabric is under occupied load and locally deformed by the pressure of said member thereagainst, dynamic resonance in said line-payout means or other irregularities in the loading value imposed on said fabric may be compensated for by low-friction lateral sliding of the said fabric against the surface of said member, with minimal local build-up of peak stress in said fabric.

13. A vessel as in claim 1, said vessel having a sternwise-located, load-spreading member of maximum thickness and stiffness centrally and preferably tapering outwardly to a relatively thin peripheral edge, said edge preferably being somewhat flexible, said member including a centrally located attachment means having a standing line structurally secured thereto, whereby said load-spreading member may, at choice, be bonded to the outer sheet of said hull, with said line extending therebeyond, or positioned interiorly against a small opening through said stern, with said line extending through said opening in said stern, said interiorly positioned member being optionally bonded to said inner sheet, whereby it can be made smaller in area, said line passing from said vessel and being adapted for coupling thereof to a line-payout means.

14. A vessel as in claim 1, said vessel including a forward extension having a tubular rim portion circumferentially, sealably and structurally bonded medially to said strip means at the distal end of said vessel and having crotch-joined, weight tolerant, individual, leg-encasement means depending therefrom, wherein an occupant can stand suspended in said vessel, said vessel having a small sternwise opening, and inverted yoke means comprising a standing-line stem and two arms extending therefrom, a said arm being structurally anchored to each of said individual leg-encasement means, said standing line at its upper end anchoring a personnel lowering device (PLD), said PLD having a suspension line of length sufficient to enable PLD control of descent speed for a specified distance to water-touchdown level, said suspension line passing from dispensing means through said PLD and thence through said opening to an upper terminus located outside of said vessel and adapted for attachment to an extraneous suspension structure, whereby said vessel becomes a multi-mode vehicle that enables the following modes of use by an occupant thereof:

a. walking, negotiating stairs and ladders, b. wading through partly flooded compartments or floating therethrough, c. stepping or jumping into water from a low elevation, d. descending via said PLD from a high elevation, e. making a self-righting dry touchdown in water, followed by flotation and the continued hypothermia protection afforded by enclosure within said vessel and the insulation inherent in the construction thereof.

15. A vessel as in claim 14, said individual leg-encasement means bearing thereon rotatable fins adapted to alternately stream when the occupant's leg moves forwardly through water and to rotate 90° from the streaming attitude when said leg moves aft through water, whereby said occupant can propel said vessel.

16. A vessel as in claim 14, said arms, after said vessel has touched down on water and said occupant has moved aft, being retractable into said vessel, thereby drawing and collapsing said leg-encasement means back upon itself, whereupon said arms may be secured in retracted position to a structural member, permissibly with the aid of a belt means for so holding said arms and said encasement means in retracted position.

17. A vessel as in claim 14, having height-compensating, body-retention means adapted to slide vertically on said yoke arms and be engaged by said occupant around his body near his center of gravity, whereby said center of gravity will remain positioned between said arms for minimal offset thereof from the plane of said yoke means during descent, and whereby said occupant can release himself therefrom after touchdown.

18. A vessel as in claim 14, said individual leg-encasement means bearing thereon rotatable fins adapted to alternately stream when the occupant's leg moves forwardly through water and to rotate 90° from the streaming attitude when said leg moves aft through water, whereby said occupant can propel said vessel.

19. A vessel as in claim 1, including a forward extension having a rim portion circumferentially, sealably and structurally bonded medially to said forwardly projecting strip means and having crotch-joined, weight-tolerant, individual leg-encasement means depending therefrom, whereby an occupant can stand or walk within said vessel, said vessel also including inverted yoke means having two arms, a said arm being structurally anchored to each of said individual leg-encasement means, said vessel having a sternwise opening therethrough, said yoke means passing outwardly via said opening and having an upper terminus adapted for attachment to a line-payout means extraneous to said vessel, said deck means including transparent viewing means and sealed, right and left sleeve means below said viewing means and projecting outwardly therefrom, whereby said occupant can do work outside said vessel while enclosed therein in an exposed position above water, said line-payout means permissibly also including retraction means.

20. A vessel as in claim 1, said deck means including fastener means bridged at least in part by a length of screen bonded externally on both sides thereof to said vessel across the gap created when said fastener is opened thereunder, said screen having a liquid-discriminating, not necessarily waterproof, surface character.

21. A vessel as in claim 1, said deck means including an elongated strip of screen having a liquid-discriminating, not necessarily waterproof, surface character, said screen being interposed alongside said access fastener as a structural bridge between said access fastener and the adjacent structural strip means, said fastener including a mounting tape situated adjacent to one edge of said screen and bonded thereto, the opposite edge of said screen being bonded to structural strip means, said last-mentioned strip means having an elongated external projection extending across the width of said screen and guarding said screen against impact of precipitation thereupon.

22. A vessel as in claim 1, said planar deck means including water-resistant, transparent, viewing means integrated as part of the continuous surface thereof, whereby the standing occupant will have a conical forward-looking field of view from within said vessel during the initial disaster-escape phase and, after jumping, sliding, or being lowered into water for the flotation phase, will have a generally upward field of view for recognition of arrival of rescue aircraft.

23. A vessel as in claim 22, said viewing means being extensible beyond the outer surface of said planar deck means, whereby said occupant may also project said viewing means upwardly, extend his head thereinto and view his surroundings in all directions throughout the hemisphere whose base is projected beyond the planar surface of said deck means.

24. A vessel as in claim 1, said planar access-deck means having a sheet portion comprising inner and outer sheets in a lobular configuration, said sheets being outline-welded together within an outer margin thereof to create inflatable cell means within said deck means inboard of said outline to limit both the inflated thickness of said cell means and the post-inflation area of said deck means, said sheets being proportioned to become slightly loaded in compression when said hull is inflated and occupied and said deck means is also inflated, whereby said deck means normally assumes a slight outward camber or can be pushed by said occupant into assuming said camber, whereby the height clearance for tall occupants can be increased without increasing the depth of said hull, particularly at said stern, whereby said contour is more conductive to rapid shedding of precipitation and spray from said deck, and whereby the internal air-breathing supply for said occupant is augmented.

25. A vessel as in claim 1, said vessel including:

a standing line firmly anchored structurally at its lower end at a point on the bow of said vessel; and a personnel lowering device (PLD) in turn anchored to the upper end of said standing line;

said bow having local reenforcing means within an area surrounding said point for transmitting the weight of a heavy standing occupant as a live load to said standing line during up-ended descent of said vessel, bow down, as regulated by said PLD, whereby said occupant may use one of said standing line and said PLD as a handhold while he stands during descent of said vessel, said vessel having a small sternwise opening therethrough, said PLD having a suspension line passing therethrough and thence outwardly via said opening to an upper terminus adapted for attachment to an extraneous overhead support, the remainder of said suspension line constituting a reserve supply of length specified for suspended descent from a required elevation to a touchdown level, said reserve supply being stored in dispenser means attached to one of said vessel and said PLD, whereby the occupant thereof will be relieved of the former requirement for time-wasting donning and adjustment of conventional body-attachment means directly to his person prior to descent within said vessel and further relieved of both the hazard of suffering painful and injurious suspension-load transfer improperly to his person and the further hazard of fall injuries resulting from improper adjustment and/or use of such attachment means, and whereby said occupant can be lowered within the protection of said vessel at a safe speed for said distance and be assured of dry water entry and self-righting, insulated flotation thereafter.

26. A vessel as in claim 25, said vessel also including height-compensating support means for safe retention of said occupant's body against said standing line during descent, whereby offset of his center of gravity from the line of suspension is held to a minimum, said support means incorporating provision for release of his body therefrom upon water touchdown.

27. A vessel as in claim 1, said deck means having a small, ventilating opening therethrough and a gravity operated, liquid-discriminating, upwardly facing, ventilator means guarding said opening, said ventilator means comprising:

a canopy overhanging said opening for excluding precipitation and falling spray;

a waterproofed, upwardly projecting lip immediately surrounding and protecting said opening; and a peripheral ventilating screen outwardly of said lip and spaced therefrom by a toroidal cavity;

said screen supporting said canopy, whereby any water droplets penetrating said screen will drain downwardly into said cavity and water accumulating in said cavity will drain outwardly via the adjacent portion of said screen.

28. A vessel as in claim 1, said vessel including:

an outward guard screen and a through-deck ventilating device comprising an air-pressure-responsive, check-valve means for admitting air into said vessel via said screen when the air pressure therewithin falls cyclically below the incident air pressure from without.

29. A vessel as in claim 1, said vessel including an outward guard screen and a through-deck ventilating device comprising an air-pressure-responsive, check-valve means for passage of air out of said vessel via said screen when the air pressure therewithin rises cyclically above the incident air pressure outside said vessel.

30. A vessel as in claim 1, said vessel including an outward guard screen and a through-deck ventilating device comprising an air-pressure-responsive, check-valve means for:

(a) admitting air into said vessel via said screen when the air pressure therewithin falls cyclically below the incident air pressure from without, and (b) passage of air out of said vessel via said screen when the air pressure within said vessel rises cyclically above the incident air pressure outside said vessel.

31. A miniature vessel comprising:

(a) a hull with a relatively deep stern, said stern having an arcuate form when said vessel is inflated and occupied in water;

(b) a bottom apex at said stern, and a bottom tapering upwardly toward a shallow bow;

(c) a gunwale tapering outwardly from said bow toward and around said arcuate stern; and (d) generally planar, precipitation excluding, vessel-closing, access-deck means joined to and spanning said gunwale and including access-fastener means adapted for admitting an occupant when open and fully enclosing his whole body under said deck means and said fastener means when thereafter closed;

said access-deck means forming, together with said hull, a closed, inverted-pyramidal, floating container for said occupant, said hull being formed of superimposed inner and outer sheets of generally similar shape and generally symmetrical about a transverse midline defining the centerline of said stern, said sheets being welded together along a continuous seam outlining the inflatable area therewithin and leaving seam-edge strip means extending outwardly thereof, said strip means being generally of width adequate for structural bonding of at least one seam outwardly of said continuous seam, said sheets being further bonded together discontinuously inwardly of said seam to form inflatable segments, said segments being so proportioned that their inflated thicknesses and, consequently, the inflated thickness of said hull, will increase from said bow to said stern and from said bottom toward said gunwale, the left and right halves of said strip means projecting below and forwardly of said hull being sealably, structurally and medially bonded thereacross, permissibly via medial bonding of at least one of a bottom deck and a forward extension, said vessel including inflation means therefor, said hull being adapted for inflation in a vertical, stern-uppermost attitude in behalf of an occupant standing forwardly therewithin and facing said deck means, said gunwale being surmounted by integral right and left upward extensions of at least one of said sheets beginning at the distal ends thereof and having a peripheral strip means outwardly therearound and continuous with said first-mentioned strip means, said extensions proceeding a desired distance aft along said gunwale, the portions of said strip means projecting above said extensions being structurally joined together along the centerline of the foredeck thus formed, said vessel also including an afterdeck means comprising sheet material and including said access-fastener means and supplementing said foredeck to constitute said deck means for said vessel, said afterdeck means having a peripheral portion structurally and continuously joined therearound to the remaining portion of said peripheral strip means projecting aft of said foredeck and said strip means projecting upwardly of the aft portion of said gunwale, whereupon, with said access fastener closed, said occupant may jump, slide or be lowered into water for dry, self-righting water entry and insulated flotation thereafter, and whereby, with the buoyancy of the interior air retained by said deck means around and above the ballasting weight of said occupant now thrusting directly upwardly against said deck means in addition to the upwardly directed buoyancy so patterned among said so-proportioned segments, said vessel achieves extraordinary buoyancy and upright stability against steeply rising wave fronts and high self-righting moment after a plunge into water, even at initially unfavorable attitudes.

32. A vessel as in claim 31, said gunwale also being surmounted by integral right and left upward extensions of the second of said sheets, said continuous seam, seam-edge strip means and discontinuous bonding between said sheets being expanded into said extensions, the portions of said seam-edge strip means projecting above said extensions now coinciding with and comprising both said peripheral strip means joined together along the centerline of said foredeck thus formed and said peripheral strip means projecting aft of said foredeck, said foredeck being inflatable.

33. A vessel as in claim 32, said upward extensions being in inflatable communication with the segment therebelow along the top of said gunwale.

34. A vessel as in claim 32, said extensions each including an integral elongated portion extending aft beyond said desired distance and each approximating the contour of the appropriate half of a longitudinally divided said deck means, said elongated portions also being included within said continuous seam and said strip means, said deck means including fastener means adapted to join said extensions to each other longitudinally, said elongated portions being structurally bonded along and to the proximate sides of said gunwale via the intervening said strip means, whereby said elongated portions constitute afterdeck means supplementing said foredeck, said foredeck and said afterdeck means together forming the aforesaid deck means.

35. A vessel as in claim 32, said extensions each including an integral elongated portion extending aft beyond said desired distance, each of said extensions approximating the contour of the appropriate half of a longitudinally divided said deck means, said elongated portions also being included within said continuous seam and said strip means, said deck means including fastener means adapted to join strip means outlying each of said portions to the proximate strip means above said gunwale, said extensions being longitudinally bonded to each other.

36. A miniature vessel comprising:

(a) a hull with a relatively deep stern, said stern having an arcuate form when said vessel is inflated and occupied in water;

(b) a bottom apex at said stern, and a bottom tapering upwardly toward a shallow bow;

(c) a gunwale tapering outwardly from said bow toward and around said arcuate stern; and (c) precipitation-excluding, planar, deck means structurally joined to and spanning said gunwale and including access-fastener means for whole-body admission of occupant into said vessel when said fastener means is open and whole-body enclosure therebelow when closed;

said access deck means and the remainder of said vessel together forming a closable container for said occupant, said hull being formed of superimposed inner and outer sheets of generally similar shape and generally symmetrical about a transverse midline defining the centerline of said stern, said sheets being welded together along a continuous seam outlining the inflatable area therewithin and leaving seam-edge strip means extending outwardly thereof, said strip means being generally of width adequate for structural bonding of at least one seam outwardly of said continuous seam, said sheets being further bonded together discontinuously inwardly of said seam to form inflatable segments, said segments being so proportioned that their inflated thicknesses and, consequently, the inflated thickness of said hull, will increase from said bow to said stern and from said bottom toward said gunwale, the left and right halves of said strip means projecting below and forwardly of said hull being sealably, structurally and medially bonded thereacross, permissibly via medial insertion therebetween of at least one of a bottom deck and a forward extension, said vessel including inflation means therefor, said hull being adapted for inflation in a vertical, stern-uppermost attitude in behalf of an occupant standing therewithin on said bow and facing said deck means, whereupon, with said access fastener closed, said occupant may jump, slide or be lowered into water for dry, self-righting water entry and insulated flotation thereafter, and whereby, with the buoyancy of the interior air retained by said deck means around and above the ballasting weight of said occupant now thrusting directly upwardly against said deck means in addition to the upwardly directed buoyancy so patterned among said so-proportioned segments, said vessel achieves extraordinary buoyancy and upright stability against steeply rising wave fronts and an extremely high self-righting moment after a plunge into water, even at initially unfavorable attitudes, said vessel including therewithin a personnel-lowering device (PLD), said PLD carrying body-attachment means adapted for securement to the person of said occupant, said vessel having a sternwise opening therethrough, said PLD having a suspension line passing from dispensing means therethrough and outwardly of said vessel via said opening, the upper terminus of said line being adapted for attachment to extraneous suspension structure, the reserve portion of said suspension line being of length sufficient to enable PLD control of descent speed for a specified vertical distance to water, said reserve portion being stored in dispenser means attached to one of said vessel and said PLD, whereby such occupant can be lowered at a safe speed for said distance within the protection of said vessel, and whereby he can accomplish dry self-righting water entry and flotation in said vessel.

37. A compact, pneumatic vessel, constructed primarily of waterproof-coated fabric and comprising: an inflatable hull and a generally planar, precipitation-excluding, access-deck means, said hull having:

(a) a relatively deep, arcuate stern angled outwardly aft to incline the torso when said vessel is inflated and carrying an occupant on water;

(b) a closed bottom tapering downwardly from a shallow bow to an inverted apex for receiving the buttocks of said occupant at the junction of said bottom with said stern; and (c) a gunwale tapering outwardly along the sides of said vessel from said bow toward and around said arcuate stern;

said access-deck means being matched for bonding attachment to strip means projecting upwardly from said hull and so attached for complete hull closure, said hull being formed of superimposed inner and outer sheets of similar shape, symmetrical about a transverse midline and tapering distally on the right and left sides of said midline, said sheets being welded together along a continuous seam outlining the inflatable area therewithin and leaving seam-edge strip means extending outwardly thereof, said strip means being of width adequate for bonding at least one additional seam beyond said continuous seam, said sheets being further bonded together discontinuously inwardly of said continuous seam to form a pattern of inflatable segments, said segments being so proportioned that their inflated thickness and, consequently, the inflated thickness of said hull will increase from said bow to said stern and from said bottom to said gunwale, said deck means preferably being proportioned to draw said gunwale slightly inwardly when said vessel is inflated and occupied and thus reduce buckling distortion of said gunwale in rough seas, said deck means being thereby also stressed, said access-deck means including a closable and reopenable, whole-body admitting, access-fastener means, said access-deck means being capable of serving as a water-excluding air-water diaphragm during brief immersion intervals, as upon said vessel's initial occupied plunge into water from above, said stern and said bottom, together, supporting said occupant in a posture resembling that which he could achieve in a lounge chair or recliner, whereby said vessel assumes, when inflated, afloat, occupied and closed, the general configuration of a closed, inverted deltoid or inverted apex-charaterized pyramid, symmetrical about its longitudinal centerline, said deck means constituting the base of said inverted pyramid, whereby the buoyancy of said tapering hull is distributed preponderantly upwardly and sternwardly for efficiently balanced support on water of the non-uniformly distributed weight of the human body as represented by said occupant, whereby the contained breathing air between said occupant and said access-deck means constitutes both augmented thermal protection for the occupant and a major buoyancy gain across the entire planform area of said access-deck means for maximizing vessel and occupant upright stability and righting moment, whereby the rise rate of said vessel against rising waves is greatly augmented, whereby the center of gravity of said occupant is well below the waterline, along the centerline, and close to said inverted apex for optimal ballasting of said vessel and optimal comfort for said occupant, and whereby a would-be escapee from marine disaster is enabled to gain admission to the interior of said vessel when said access fastener is open, to entirely enclose himself therein quickly and fully from within said vessel as the occupant thereof, to depart expeditiously from a point of danger above water by jumping or sliding down to auto-erected, dry and stable flotation on said water, and to open said fastener and depart expeditiously from said vessel when he is later being rescued.

38. A vessel as in claim 37, said access-deck means also being inflatable, whereby the body-insulating value of said inflated hull and of the interior air trapped by the deck are further supplemented by the pneumatic insulation of said deck means, and the rising and self-righting responses of said vessel are still further accelerated.

39. A vessel as in claim 37, said access deck means including 360° structural-fastener means for securing at least a portion of the area of said deck means to the gunwale of said vessel, whereby at least a portion of the area thereof may be detached.

40. A vessel as in claim 37, said vessel also having a forward extension comprising a tubular rim portion and terminating forwardly in crotch-joined leg-encasement means, said rim portion having been medially and circumferentially bonded to and joining seam-edge strip means projecting distally from the left and right sides of said hull and said foredeck, whereby dry wading entry and dry transition to the flotation mode and dry exit from water become additional capabilities, said vessel also including line means attached inwardly to the forward ends of said leg-encasement means and a structural member for attachment of said line means thereto, whereby said vessel assumes a quiescent flotation mode when said occupant moves aft from said leg-encasement means to seat himself at said apex and thereafter retracts said encasement means via said line means and secures said line means to said structural member.

41. A miniature vessel comprising:

(a) a hull with a relatively deep stern, said stern having an arcuate form when said vessel is inflated and occupied in water;

(b) a bottom apex at said stern, and a bottom tapering upwardly toward a shallow bow;

(c) a gunwale tapering outwardly from said bow toward and around said arcuate stern; and (d) a foredeck structurally joined to and spanning the forward portion of said gunwale;

said hull being formed of superimposed inner and outer sheets of generally similar shape and generally symmetrical about a transverse midline defining the centerline of said stern, said sheets being welded together along a continuous seam outlining the inflatable area therewithin and leaving seam-edge strip means extending outwardly thereof, said strip means being generally of width adequate for structural bonding of at least one seam outwardly of said continuous seam, said sheets being further bonded together discontinuously inwardly of said seam to form inflatable segments, said segments being so proportioned that their inflated thicknesses and, consequently, the inflated thickness of said hull, will increase from said bow to said stern and from said bottom toward said gunwale, the left and right halves of said strip means projecting below and distally of said hull being sealably, structurally and medially bonded thereacross, permissibly via medial attachment of at least one of a bottom deck and a forward extension, said vessel including inflation means therefor, said vessel also including a waterproof forward extension having a rim portion circumferentially, sealably, and structurally bonded medially to said distally projecting strip means, said forward extension also comprising a pair of crotch-joined, individual, articulable, leg-encasement means depending from said rim portion, whereby an occupant may stand, walk, or wade for dry water entry at choice within said vessel, whereby said occupant may also lie back and float within said vessel and, using hands or a paddle, may cross deep water while remaining dry, and whereby he may also retract his legs from said leg-encasement means and float, still dry, with his buttocks at said apex.

42. A miniature vessel comprising, when inflated and occupied in water:

a hull having a relatively deep and arcuate stern portion and a closed bottom portion extending forwardly and inclined upwardly from its intersection with said stern portion and terminating in a shallow bow portion rising therefrom, said intersection being configured as an inverted apex for receiving the buttocks of an occupant, said stern portion and said bottom portion together supporting said occupant in a lounge-chair posture, whereby the center of gravity of said occupant is in near proximity to said apex, a gunwale tapering outwardly from said bow portion toward and around said stern portion, said gunwale surmounting left and right sidewall portions approximately tangent to said stern portion, said hull being formed of superimposed inner and outer sheets of similar shape, symmetrical about a transverse midline and tapering distally on the right and left sides of said midline, said sheets being welded together along a continuous seam outlining the inflatable area therewithin and leaving seam-edge strip means extending outwardly thereof, said strip means below and distally of said continuous seam being of width adequate for bonding at least one additional seam outwardly of said continuous seam, said sheets being further bonded together discontinuously inwardly of said continuous seam to form a pattern of inflatable segments, said segments being so proportioned that their inflated thickness and, consequently, the inflated thickness of said hull will increase from said bow to said stern and from said bottom to said gunwale, whereby the buoyancy of said hull is distributed preponderantly upwardly and sternwardly for efficiently balanced support on water of the nonuniformly distributed weight of said occupant, said symmetrical left and right sides of said so configured hull being formed and joined forwardly of said apex to constitute said vessel via medially inclusive structural bonding of at least one of a bottom deck and a forward extension to the portions of said seam-edge strip means below and distally of said continuous seam, the remaining unbonded length of said described portions of said strip means, when present, also being medially bonded, said vessel also including, a medially inserted, lobular-shaped bottom deck, extending forwardly of said transverse midline and having a peripheral bonding margin therearound, said margin being bonded to said downwardly projecting strip means, said bottom deck sloping upwardly from said inverted apex toward said shallow bow when occupied, whereby the transverse cross section of said vessel becomes flat-bottomed, whereby said vessel acquires upright stability even when unoccupied, whereby dry water entry from shore, shallow pier or larger boat by stepping into said vessel is enabled, whereby very bulky individuals may be more comfortably reclined and whereby said vessel can alternatively provide side-by-side seating for a plurality of occupants at the thereby-broadened apex.

43. A vessel as in claim 42, said vessel also including a structural foredeck spanning the forward portion of said gunwale for a desired distance aft of said bow, said vessel also having a forward extension comprising a tubular rim portion and terminating forwardly in crotch-joined leg encasement means, said rim portion having been medially and circumferentially bonded to and joining seam-edge strip means projecting distally from the left and right sides of said hull, said bottom deck, and said foredeck, whereby dry wading entry into water, dry transition to the flotation mode and dry exit from water become additional capabilities, said vessel also including line means attached inwardly to the forward ends of said leg-encasement means, and a structural member for attachment of said line means thereto, whereby said vessel assumes a quiescent flotation mode when said occupant moves aft from said leg-encasement means to seat himself at said apex and thereafter retracts said encasement means via said line means and secures said line means to said structural member.

44. A vessel as in claim 42, said strip means above said gunwale also being of width adquate for bonding at least one additional seam outwardly of said continuous seam, said vessel also including a generally planar, lobular, precipitation-excluding, access-deck means structurally spanning and closing said gunwale via peripheral bonding to said last-mentioned strip means, said deck means including closable access-fastener means for rapidly admitting an occupant into said vessel when open, fully enclosing him therebelow when closed, and permitting egress by again opening said access-fastener means when he desires to leave, said deck means being proportioned to draw said gunwale slightly inwardly when said vessel is inflated and occupied and thus transmit to and receive stress from said hull and reduce buckling distortion of said hull under wave action.

45. A miniature inflatable vessel having a hull with an arcuate stern of greater depth than the shallower bow, said hull having a gunwale thereabove, said hull being formed of superimposed inner and outer sheets of generally similar shape and symmetrical about a transverse midline defining the stern centerline of said vessel, said sheets being welded together along a continuous outline seam defining their joint inflation perimeter and leaving seam-edge strip means extending outwardly around said seam, said sheets being further welded together discontinuously within said perimeter to form inflatable segments constituting the walls of said hull, said segments being so proportioned that their inflated thicknesses and, consequently, the inflated thickness of said hull will increase from said bow to said stern and from the bottom of said hull upwardly to the gunwale thereof, said hull, when inflated and occupied, being inclined outwardly from said bottom toward said gunwale, and tapered outwardly from said bow to said arcuate stern, the right and left halves of said strip means below and distally of said hull being of width adequate for bonding at least one additional sealable and structural seam outwardly of said continuous seam, said halves of said strip means being so bonded thereacross, with sealed structural accommodation medially of at least one of a forward extension and a bottom deck, said vessel having a lobular-shaped bottom deck, said bottom deck having a bonding margin therearound, said bonding margin being bonded sealably, structurally and medially to the portion of said seam-edge strip means projecting below said hull, the distal halves of said strip means being bonded structurally and medially to close the forward portion of said vessel, said bottom deck sloping upwardly from said inverted apex toward said shallow-bow when so occupied, whereby said vessel acquires a broad bottom between separated hull sides and a new and inherent upright stability, even when unoccupied, whereby said vessel also gains a new dry-entry-from-alongside characteristic, and whereby a plurality of occupants can sit side-by-side.

46. A vessel as in claim 45, said vessel also having seam-edge strip means projecting above said hull, said seam-edge strip means comprising two plies of fabric, one of said plies being integral with said inner sheet, the second ply being integral with said outer sheet, said inner and outer plies being of sufficient width to be rejoined to each other thereabove via bonding or a fastener and admit therebetween an inserted load-diffusing structural member, said load-diffusing member conforming in lateral curvature with the curvature of said outline seam when said vessel is inflated, whereby the pitching, rolling, and yawing reactions of a transom-fitted small engine may be reacted and damped via said load-diffusing member bearing along the length thereof against said gunwale, said transom being secured to said load-diffusing member and adapted for supporting at least one of an engine and rudder thereon.

47. A vessel as in claim 46, said load-diffusing member being adapted to support oarlocks, mooring means, cleats, a light-weight motor and/or towing connection at choice.

48. A vessel as in claim 46, said load-diffusing member extending the length of said gunwale on both sides, whereby said load-diffusing member and said vessel are, together, enabled to react propulsion and wave action of greater intensity.

49. A vessel as in claim 48, said load-diffusing member supporting forward structure carrying thereon a receptacle for a mast, said load-diffusing member also supporting at least one of a centerboard and a sideboard for said vessel.

50. A vessel as in claim 45, said bottom deck being comprised of two sheets continuously outline-welded together to define the inflatable area thereof and leave said bonding margin therearound, said sheets being bonded together discontinuously within said inflatable area to control the inflated thickness of said bottom deck.

51. A vessel as in claim 45, said vessel having a strip means of width adequate for bonding at least one additional structural seam outwardly of said continuous seam above the forward portion of said gunwale, said vessel having a foredeck bonded to said last-mentioned strip means and stretched across the forward portion of said gunwale by inflation of said hull, whereby a measure of protection from bow initiated wave overwash is achieved.

52. A vessel as in claim 45, said gunwale being surmounted at least in part by matching integral upward extensions of said sheets forming said hull, said extensions beginning at the distal extremities of said sheets and terminating a desired distance aft along said gunwale, the portions of said strip means above said extensions being bonded to each other to describe the centerline of the thus-constituted foredeck transversely stretched across said hull upon inflation of said vessel, said extensions being in inflative communication with the segment immediately therebelow forming said gunwale, said vessel including a forward extension having a rim and terminating in bi-pedal foot encasement means, said extension being sealably and structurally bonded circumferentially to the distal portions of said strip means.

53. A vessel as in claim 45, said gunwale being surmounted at least in part by matching integral upward extensions of said sheets forming said hull, said extensions beginning at the distal extremities of said sheets and terminating a desired distance aft along said gunwale, the portions of said strip means above said extensions being bonded to each other to describe the centerline of the thus-constituted foredeck transversely stretched across said hull upon inflation of said vessel, said vessel including a forward extension comprising a tubular rim portion circumferentially, sealably and structurally bonded medially to said strip means projecting beyond the distal end of said hull, and crotch-joined, individual leg-encasement means depending therefrom, wherein an occupant can stand and walk about before water entry and can wade for dry water entry and flotation thereafter.

54. A vessel as in claim 53, said upward extensions each including an integral elongated portion extending aft beyond said desired distance to said stern centerline and thereby approximating the contour of the appropriate half of a longitudinally divided upper deck means, said extensions being longitudinally bonded structurally to each other, said deck means also including structural fastener means adapted to join the strip means outlying said elongated portions to the proximate portion of the aforesaid strip means above said gunwale.

55. A vessel as in claim 4, or claim 5, or claim 24, said access-fastener means being contained within said sheet portion and bonded on both sides thereinto.

56. A vessel as in claim 4, or claim 5, or claim 24, said sheet portion being bonded at least in part to peripheral access fastener means bonded on one side to said sheet portion and on the other side to said seam-edge strip means.

57. A vessel as in claim 56, said peripheral access-fastener means traversing 360° around said sheet portion, said access fastener means being separable into two halves, whereby said sheet portion can be removed from said vessel.

58. A vessel as in claim 31, or claim 13, or claim 15, or claim 16, said vessel having a forward extension constituting an articulable, waterproof, crotch-joined, bipedal carrier for at least the feet of said occupant, said carrier being surmounted by a circumferential rim, said rim being sealably, circumferentially, and structurally bonded medially to and between the distal ends of said right and left halves of said strip means, all remaining length of said halves being sealably and structurally bonded together to close the bottom and bow of said vessel along the median line thereof, whereby an occupant of said vessel can waddle or shuffle a limited distance to a point of emergency departure from a distressed yacht, secure the deck and inflate said vessel before leaping off to dry and self-righting water entry and insulated flotation thereafter.

59. A vessel as in claim 11, or claim 10, said line-payout means being an extraneous overhead line-payout mechanism.

60. A vessel as in claim 11, or claim 10, said line-payout means being a personnel lowering device (PLD) of the automatically speed-governed type, said PLD being coupled to said standing line beyond said sternwise opening, said PLD having a suspension line passing therethrough, the upper end of said suspension line terminating in attachment means for coupling said suspension line to an extraneous overhead support, the remainder of said suspension line constituting a reserve supply of length specified for suspended descent from a required elevation to a touchdown level, said reserve supply being stored in dispenser means attached to one of said vessel and said PLD, whereby PLD's can permissibly be separately, strongly, and securely locked away above the spaces provided in storage lockers for emergency vessels of this character.

61. A vessel as in claim 60, said reserve supply being stored in dispenser means attached to said PLD, said standing line being equipped with means for quick coupling to said PLD, whereby PLD's may be stored separately nearby as kits for greater security and protection against theft of misuse by unauthorized persons.

62. A vessel as in claim 41 or claim 53, having also a structural member sealably, structurally and medially bonded to said strip means depending below said hull, said member including adjustable belt means, whereby said occupant will achieve improved freedom of action and mobility when standing or wading.

63. A vessel as in claim 62, including also line means having two foward termini, said termini being anchored near the forward ends of said encasement means, whereby, following flotation, said encasement means may be collapsed upon itself and retracted toward said bow, said line means being then secured to said member.

64. A vessel as in claim 1 or 41, said vessel also including a bottom deck having an arcuate stern portion and side portions tapering inwardly and terminating distally, said bottom deck being surrounded by a continuous bonding margin, said bonding margin being bonded sealably, structurally and medially to contiguous seamedge strip means projecting below said hull, the distal portion of said bonding margin providing continuity with the distal strip means of said hull and said extensions, said continuous distal strip means and distal portion of said bonding margin matching in total girth for bonding purposes the girth of said rim, said rim being sealably, structurally and circumferentially bonded medially to said distal strip means and bonding margin portion, whereby dry flotation in said vessel can be accomplished both by stepping thereinto from a low pier and by initial wading entry.

65. A vessel as in claim 43, or claim 41 or claim 40 or claim 53, said leg-encasement means being equipped with at least one fin mounted upon each leg portion thereof and adapted to stream behind the leg during forward leg motion, said fin having hinge means adapted to swing the blade end thereof forwardly to approximately a right angle from the streaming attitude when the leg moves aft, whereby said vessel becomes operable in 3 modes:

a. standing, portaging and wading, b. operative propulsion while afloat, c. rest, fishing, paddling, or other activity when occupant has moved aft to a seated position.

66. A vessel as in claim 51 or 41, said strip means above said gunwale and aft of said foredeck also being of width adequate for bonding at least one additional structural seam outwardly of said continuous seam, said vessel also including an afterdeck having a bonding margin bonded across said gunwales and the interval between said foredeck and said stern, the forward end of said afterdeck means being structurally secured to said strip means projecting aft of said foredeck, the remainder of said afterdeck means being structurally joined to the proximate portions of said strip means above said gunwale, said afterdeck means including a closable access-fastener, said foredeck and said afterdeck means together constituting upper access-deck means for said vessel.

67. A vessel as in claim 1, said vessel having a time-delay ventilating system mounted upon said deck means and including:

a disc conforming to and closing a forwardly located opening in said deck means, whereby said vessel, when occupied and launched bow downwardly with said access fastener closed, will temporarily expose the outer surface of said disc to the water and then revert to self-righting flotation, said disc being formed of inert material having a porous outer surface and a water soluble binder, whereby, when exposed to water for a few seconds, an appropriate amount of water will be absorbed via said outer surface, said amount being adequate for softening of a sufficient proportion of said binder in less than three quarters of an hour to weaken said disc and initiate crumbling thereof, whereby said occupant is first protected from a wetting during water entry and thereafter remains protected by normal air exchange via said opening from excessive degradation of the atmosphere within said vessel.

68. A vessel as in claim 67, said opening being laterally surrounded by an upwardly projecting guard surrounding said opening, said guard being positioned for diverting water coursing upon said deck means from entry into said vessel via said opening, whereby said occupant will be protected from wetting of his legs by seas otherwise capable of wetting said deck means, and whereby, during the immersion and self-righting processes additional water will be trapped by said guard means for hastening said crumbling.

69. A vessel as in claim 1, or claim 31, or claim 34, or claim 35, said vessel including a forward extension comprising a tubular rim portion circumferentially, sealably and structurally bonded medially to said strip means at the distal end of said vessel; and crotch-joined, weight tolerant, individual leg-encasement means depending therefrom, wherein an occupant can stand suspended in said vessel, said vessel having inverted yoke means comprising a standing line stem and two arms depending therefrom, said vessel having sternwise opening means for passage of said yoke means therethrough, a said arm being firmly anchored to each of said individual leg-encasement means, said standing line extending beyond said vessel via said sternwise opening means and being adapted for coupling thereof to a line-payout means.

70. A vessel as in claim 1, or claim 31, or claim 34, or claim 35, said left and right halves of said strip means projecting below said hull being medially joined together therebetween and thereacross via an insert having its peripheral margin continuously bonded thereabout to said strip means, said insert being a lobular bottom deck, preferably smaller in area than the said deck means spanning said gunwale, said bottom deck sloping upwardly from said inverted apex toward said shallow bow when so occupied, whereby the transverse cross section of said vessel becomes trapezoidal, whereby dry water entry from shore, shallow pier or larger boat by first stepping into said vessel is enabled, whereby a very bulky occupant can be comfortably accommodated, and whereby said vessel can alternatively provide side-by-side seating for a plurality of individuals at the thereby-broadened inverted apex formed by the intersection of said bottom with said stern.

71. A vessel as in claim 70, said bottom deck being inflatable as a unit inwardly of said margin.

72. A vessel as in claim 1 or claim 37, said bonding of an additional seam to downwardly projecting portions of said outwardly extending strip means being via a medial, lobular-shaped bottom deck inserted between said sides, said bottom deck extending forwardly of said transverse midline and having a peripheral bonding margin therearound, said bottom deck sloping upwardly from said inverted apex toward said shallow bow when so occupied, whereby the transverse cross section of said vessel becomes flat-bottomed, whereby said vessel acquires upright stability even when unoccupied, whereby dry water entry from shore, shallow pier or larger boat by stepping into said vessel is enabled, whereby very bulky individuals may be more comfortably reclined, and whereby said vessel can alternatively provide side-by-side seating for a plurality of occupants at the thereby-broadened apex.

* * * * *